US009463142B2

(12) United States Patent
Viscomi

(10) Patent No.: US 9,463,142 B2
(45) Date of Patent: Oct. 11, 2016

(54) VARIABLY ERGONOMIC BOTTLE EXTENSION SYSTEM

(71) Applicant: Brian David Viscomi, Easton, PA (US)

(72) Inventor: Brian David Viscomi, Easton, PA (US)

( * ) Notice: Subject to any disclaimer, the term of this patent is extended or adjusted under 35 U.S.C. 154(b) by 524 days.

(21) Appl. No.: 13/911,178

(22) Filed: Jun. 6, 2013

(65) Prior Publication Data

US 2014/0360967 A1 Dec. 11, 2014

(51) Int. Cl.
*A61J 9/06* (2006.01)

(52) U.S. Cl.
CPC . *A61J 9/06* (2013.01); *A61J 9/063* (2015.05); *A61J 9/0638* (2015.05); *A61J 9/0661* (2015.05); *A61J 9/0676* (2015.05); *A61J 9/0692* (2015.05)

(58) Field of Classification Search
CPC ..... A61J 9/06–9/085
USPC ..... 215/11.1–11.6, 379–385; 248/102–107
See application file for complete search history.

(56) References Cited

U.S. PATENT DOCUMENTS

| | | | | |
|---|---|---|---|---|
| 2,496,478 A * | 2/1950 | Kinnebrew | ..... | A61J 9/06 248/103 |
| 7,100,782 B2 * | 9/2006 | Hanna | ..... | A61J 9/00 215/11.1 |
| 2011/0155684 A1 * | 6/2011 | Sirota | ..... | A61J 9/04 215/11.5 |

* cited by examiner

*Primary Examiner* — Matthew F Desanto

(57) ABSTRACT

In accordance with the present invention, a variably ergonomic bottle extension system to increase a bottles feeding range comprising a baby bottle (2) having a first articular surface to pivotably conjoin with an elongated extension rod (12) having a second articular surface, wherein conjoining the surfaces creates a joint, so that the bottle (2) can pivot along one or more axes. Whereby conjoining the bottles (2) articular surface with the extension rod's (12) articular surface pivotably extends the bottles feeding range and furthermore, pivotably accommodates a number of feeding positions. Whereby a caretaker can, while cradling an infant, grip the extension rod (12) with their cradling arm or other arm and use the bottle's (2) extended feeding range to feed an infant with their cradling arm or other arm. Whereupon, if a caretaker uses their cradle arm to feed, they can unencumber their other arm for other purposes.

12 Claims, 61 Drawing Sheets

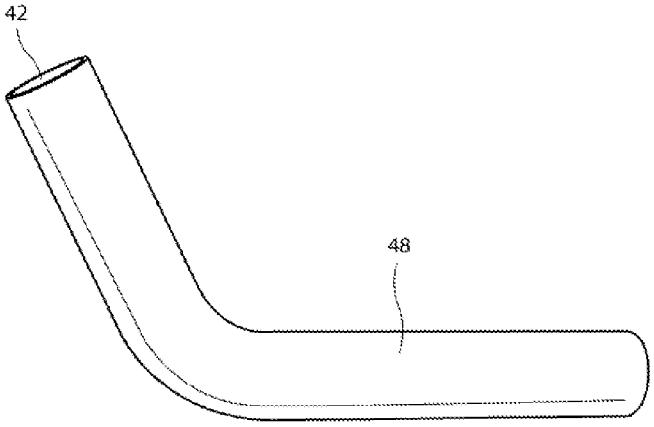
FIG 26A
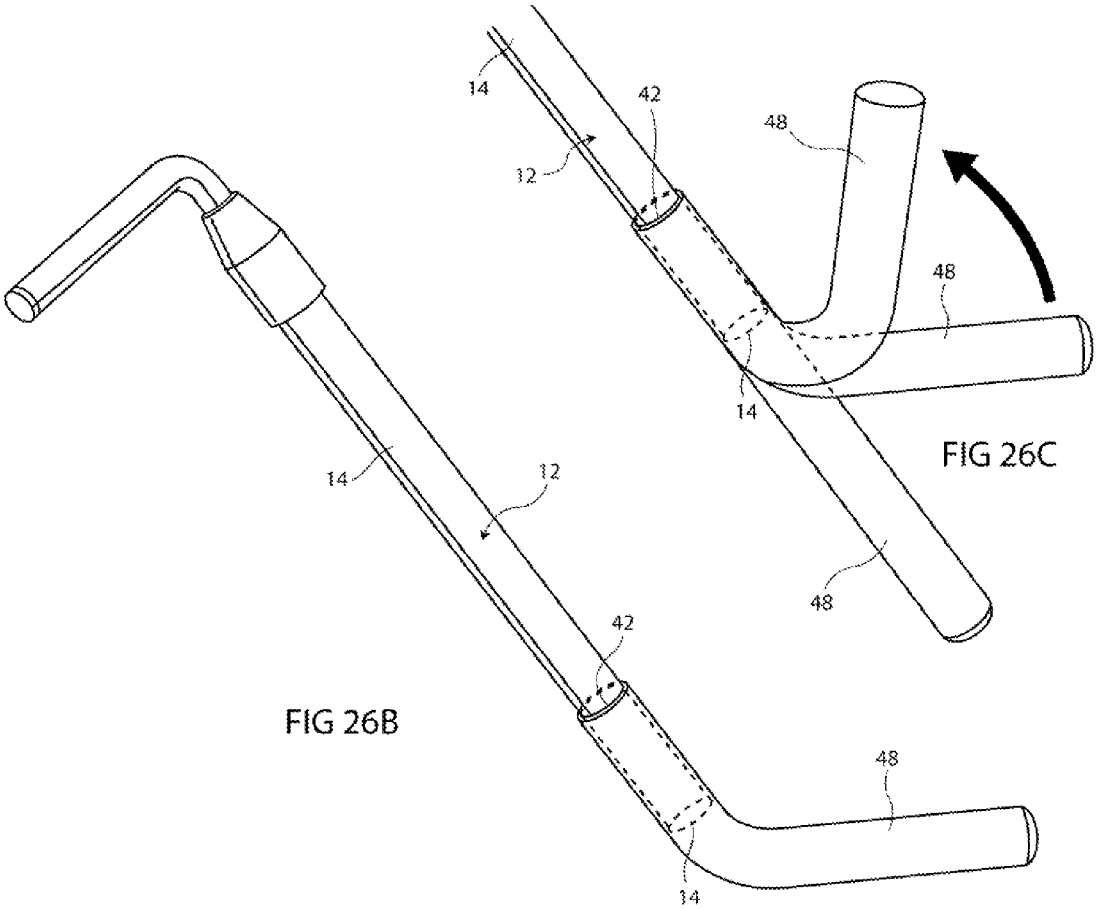
FIG 26C
FIG 26B

VARIABLY ERGONOMIC BOTTLE EXTENSION SYSTEM

CROSS-REFERENCE TO RELATED APPLICATIONS

This application claims the benefit of Provisional Patent Application Ser. Nos. 61/6561,809, filed Jun. 7, 2012 and 61/723,249 filed Nov. 6, 2012 by the present inventor

FEDERALLY SPONSORED RESEARCH

Not Applicable

SEQUENCE OR LISTING PROGRAM

Not Applicable

BACKGROUND OF THE INVENTION

1. Field of Invention

This invention relates to baby bottles, specifically the manner in which they are held by an operator while feeding an infant.

2. Background of the Invention

A baby bottle is a common receptacle for delivering liquid nutrients to infants throughout the world. Baby bottles generally comprise a bottle for holding a liquid and a nipple to securely cover the bottle opening. Furthermore, the nipple has an opening at its end to permit the passage of a liquid. Thus, in tandem or in lieu of breastfeeding, baby bottles are utilized to deliver expressed breast milk or hydrated formulas.

Since infants cannot reliably hold a bottle, however, they generally require assistance from an adult or guardian operator. The process of feeding an infant with a bottle requires the utilization of both arms. An operator generally cradles the infant with one arm for support (often while seated), while using the other arm to hold the bottle. Note, the bottle holding arm is positioned appropriately thereby allowing the infant to obtain the liquid via the nipple. Consequently, feeding an infant is a highly repetitions and time consuming activity that generally involves both arms. The result encumbers upon an operator's ability to perform ancillary activities. In response, inventors have created a number of hands free devices to alleviate these constraints.

U.S. Pat. No. 6,971,612 to Wilson-Lowery (2005) discloses a bottle feeding holder that has a flexible stalk portion having two clamping ends. On one end is a clamp like device to hold the bottle. On the other end is support clamp to attach to another object. In between is a stalk that can be flexibly bent to attain a proper feeding position. This invention, by nature of having clamps and moving part is expensive to manufacture. Furthermore, it presents a one size fits all clamping device that may not reliably hold bottles of different manufacturers. Furthermore, it requires a suitable object to attach the clamp device to. Lastly, it has no means in which to overcome the "propping", or tilting the bottle, a positioning that can contribute to an undesirable constant flow of liquid.

U.S. Pat. No. 6,581,866 to Suh (2003) Shows another bottle holder having a flexible central body with two clamping ends. One end clamps onto an object while the other is a holder for a bottle. By nature, articulating parts are expensive to manufacture and require assembly. Clamping devices, that accommodate diverse attaching surfaces, present problems for use on a device with a flexible body.

Furthermore it assumes that the infant's desired feeding position will remain constant. Lastly, it is doubtful that a universal clamp can accommodate the variety of bottle shapes.

U.S. Pat. No. 5,603,479 to Kristy (1997) shows a bottle clamping holder with flexible body. This invention has many of the problems associated with clamping devices. Namely, the expense of manufacture, the suitability of finding an appropriate surface for attaching, the assumption that the infant's feeding position will remain constant and the assumption that a universal clamp will reliably accommodate all bottle varieties.

Thus, all holders heretofore share a number of disadvantages:

(a) They encourage infant neglect as a caretaker performs other tasks.

(b) They promote "propping" which is a non intuitive, fixed bottle orientation that delivers a constant, non adjustable flow of liquid to the feeding infant.

(c) They negate the nurturing participation of the feeding process.

(d) They have an array of bases/clamp designs that may not be suitable for universal attachment to a surface.

(e) They depend on clamps and holders that must be reliably adjustable to accommodate the array of manufactured baby bottles.

(f) They can promote overfeeding in the caretaker's absence (g) They possess substantial assemblies, and parts which result in a more complex and expensive product.

OBJECTS AND ADVANTAGES

Accordingly, several of the objects and advantages of the present invention are:

(a) To provide greater intimacy and bonding with an infant while simultaneously allowing the caretaker/operator to perform additional tasks (b) To provide caretaker discretion and control to eliminate propping (c) To provide allow caretaker multi-tasking during the feeding process (d) To enhance intimacy with traditional bottle feeding (c) To provide an intuitive operation (d) To provide an economical apparatus.

(e) To enhance safety (f) To enhance productivity

Further objects and advantages are to provide a bottle extending system that allows a caretaker to intimately engage in the feeding process with greater ergonomic freedom and activity potential. The extension system allows a caretaker to variably choose the feeding arm. Unlike the prior art, it obviates the need for complicated clamps, flexible rods, holders and attaching surfaces. Most critically, it promotes participation as opposed to the neglect readily encouraged with total hands-free systems. Lastly it helps the caretaker to control bottle propping. Still further objects and advantages will become apparent during the ensuing description and drawings.

SUMMARY

In accordance with the present invention, a variably ergonomic bottle extension system to increase a bottles feeding range comprising a baby bottle having a first articular surface to pivotably conjoin with an elongated extension rod having a second articular surface, wherein conjoining the surfaces creates a joint, so that the bottle can pivot along one or more axes. Whereby conjoining the bottles articular surface with the extension rod's articular surface pivotably extends the bottles feeding range and furthermore, pivotably accommodates a number of feeding positions. Whereby a caretaker can, while cradling an infant, grip the extension rod with their cradling arm or other arm and use the bottles extended feeding range to feed an infant with their cradling arm or other arm. Whereupon, if a caretaker uses their cradle arm to feed, they can unencumber their other arm for other purposes.

BRIEF DESCRIPTION OF THE SEVERAL VIEWS OF THE DRAWINGS

Figures

FIG. 26A shows a rigidly angled gripping extension.

FIG. 26B shows a rigidly angled gripping extension attached to an extension rod handle bottom.

FIG. 26C shows a variably bendable gripping extension attached to an extension rod handle bottom.

DRAWINGS

Reference Numerals

Figure 1A:
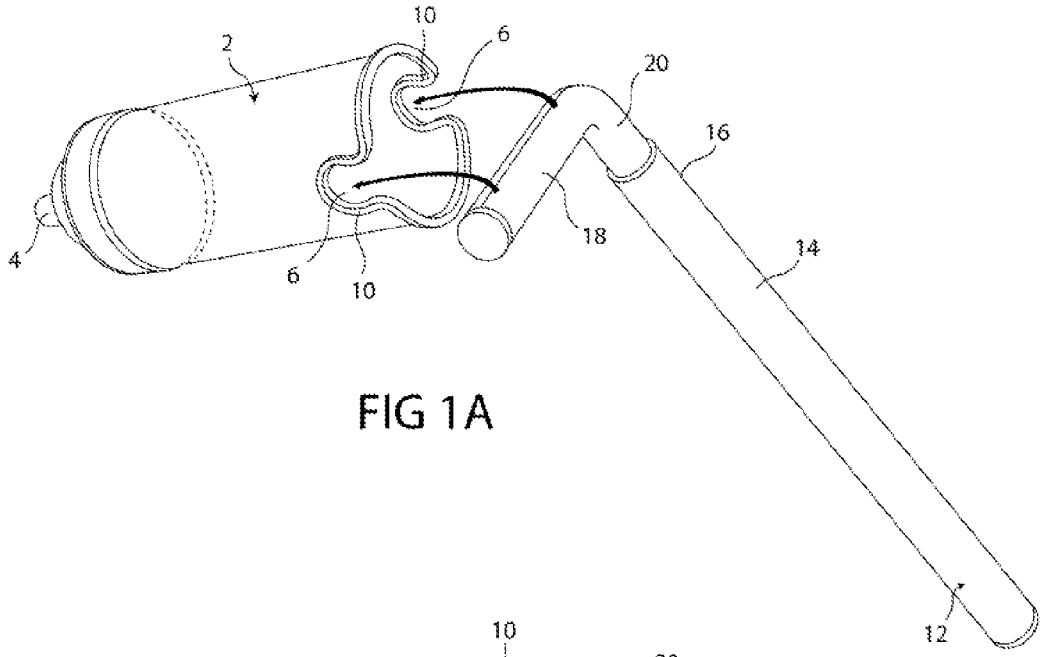
FIGS. 1A and 1B (perspective views) show the preferred embodiment's extension rod disjoined and conjoined with a bottles socket member.

2. Bottle
4. Nipple
6. Socket Member
10. Elastomeric body
12. Extension Rod
14. Handle
16. Grip
18. Articulating member
20. Shaft
22. Vent
24. Fluted elastomer
26. Disc
28. Infant
30. Operator
32. Cradle arm
34. Standard feeding arm
36. Extending member
38. Tightening member
40. Flexible member
42. Aperture
44. Attaching articulating member
46. Threading
48. Gripping extension
50. Stabilizer
52. Clipping member
54. Flexing channel
56. Hinge
58. Notch
60. Attaching articular member
62. Rim
64. Groove
66. Sleeve
68. Velcro
70. Axle
72. Elastomeric extrusion
74. Ratchet
76. Extrusion
78. Latching member
80. Lead in channel
82. Locking member
84. Spring Hinge
86. Spring

DETAILED DESCRIPTION

FIGS. 1A-15D—Preferred Embodiment

Figure 1B:
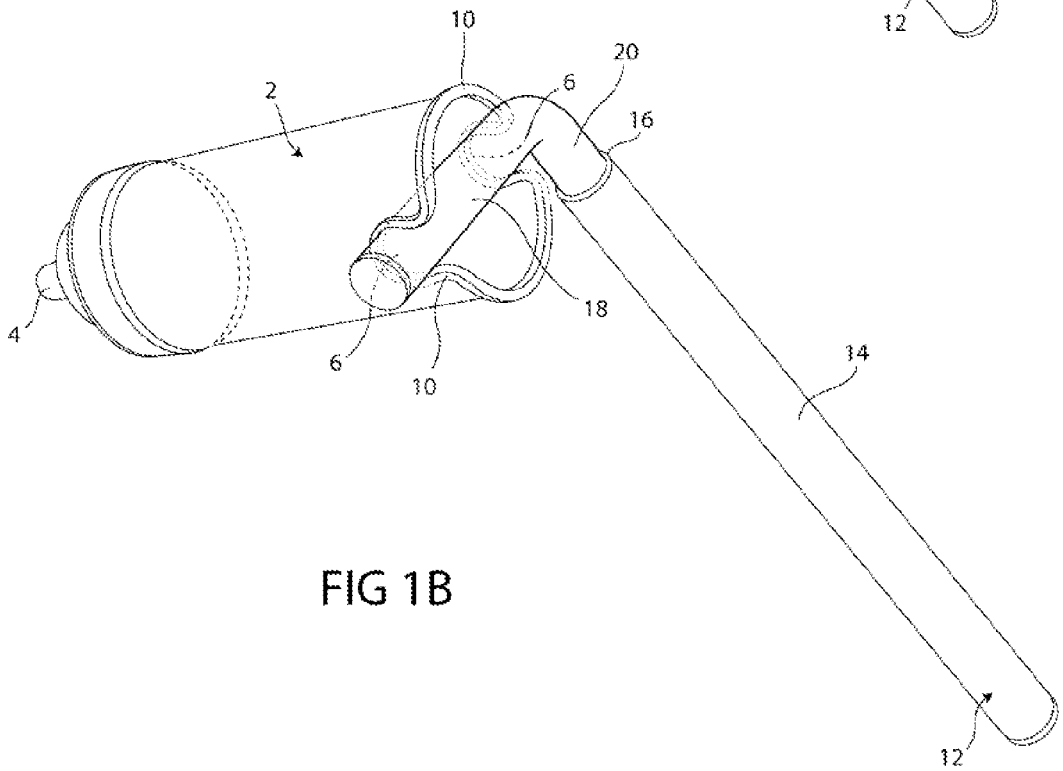

A preferred embodiment for the variably ergonomic bottle extension system is illustrated in FIG. 1A (a disjoined dimensional view) and FIG. 1B (a conjoined dimensional view).

Overview

Figure 2:
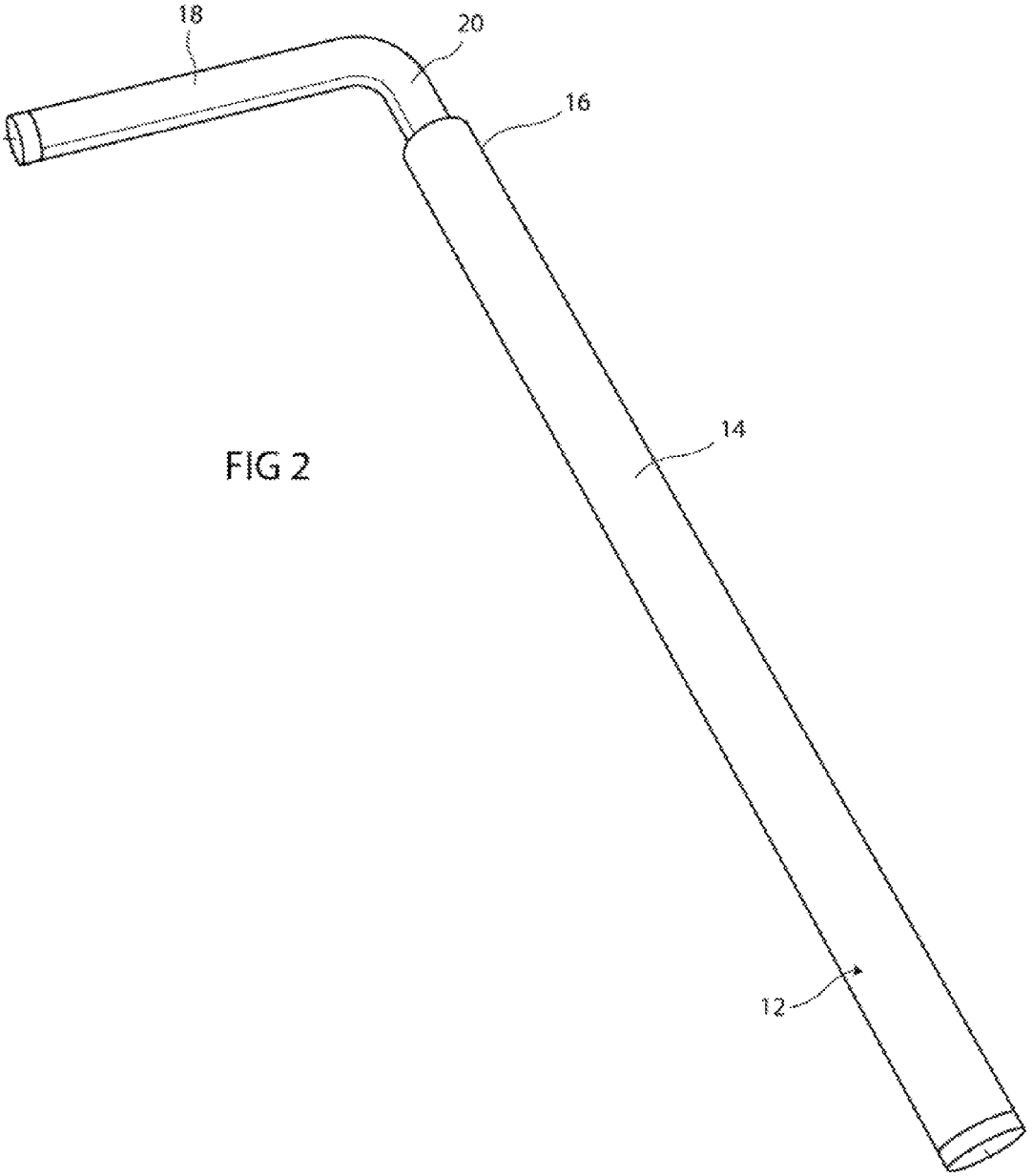
FIG. 2 (dimensional view) shows the preferred embodiment's extension rod.
Figure 3A:
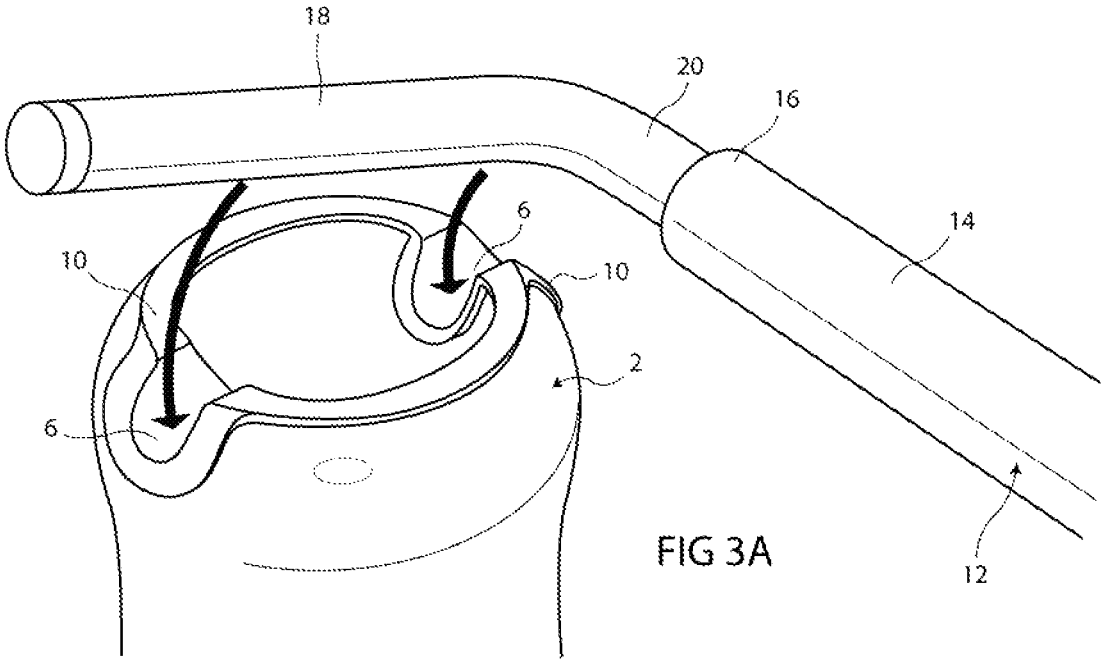
FIGS. 3A and 3B (detail dimensional views) show an extension rod's articulating member before conjoining and after conjoining with a bottle's socket member.
Figure 4:
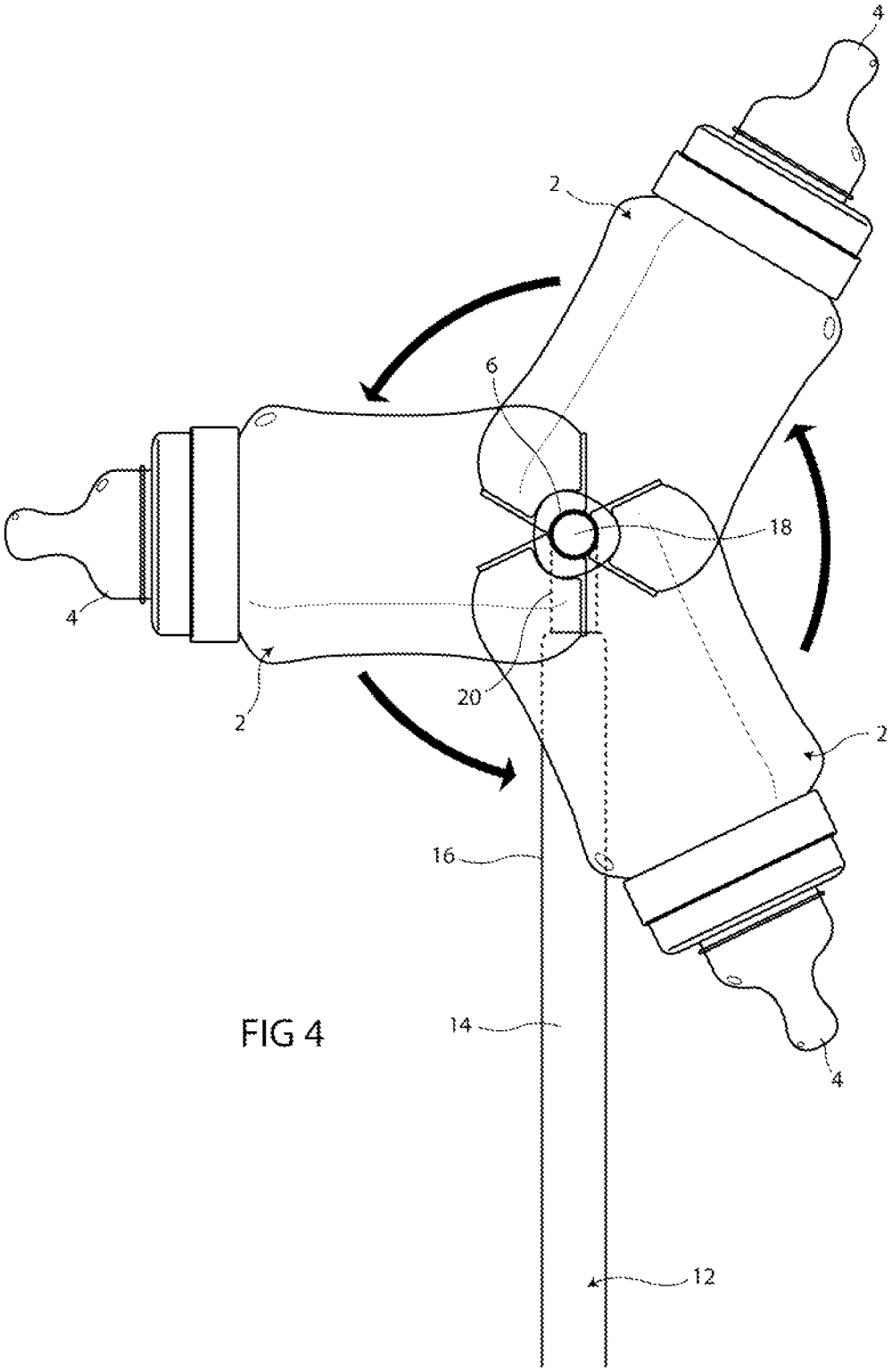
FIG. 4 (side view) shows a bottle's pivoting range of motion while conjoined with an extension rod.
Figure 5A:
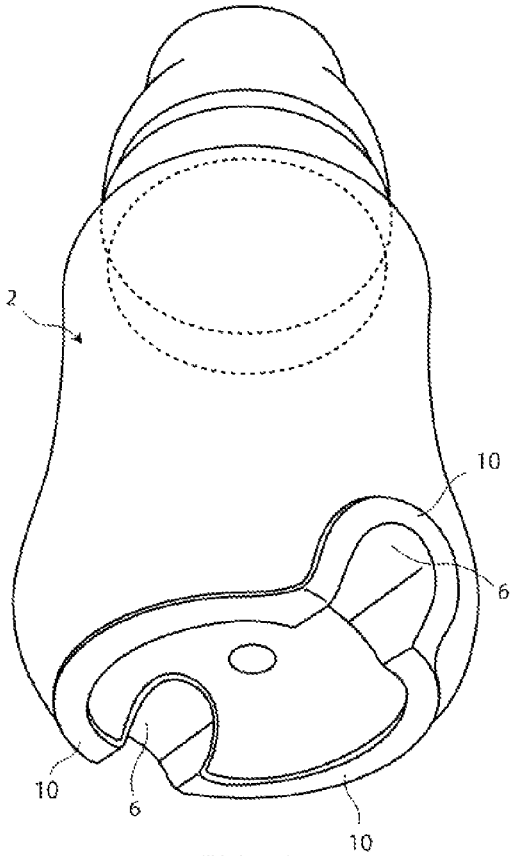
FIGS. 5A and 5B (dimensional views) show traditional style bottles having bilateral socket member openings on their bottoms, wherein one bottle has an elastomeric body adhered to its socket and the other does not.
Figure 5B:
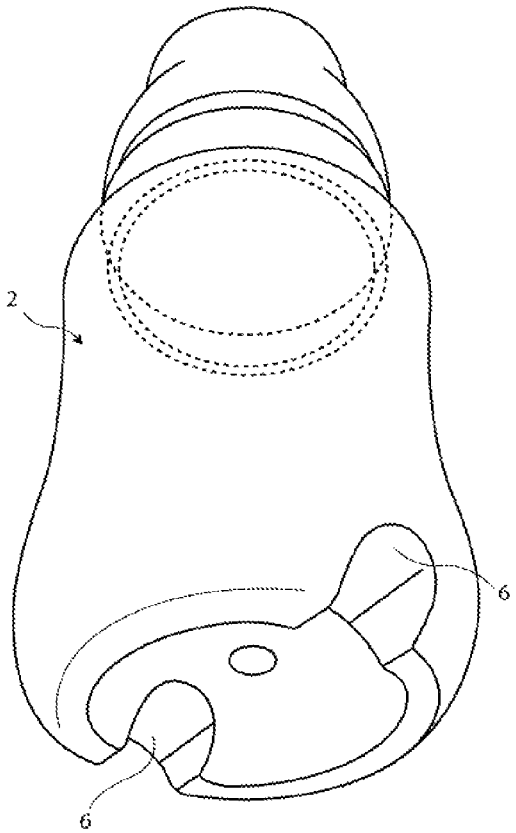
Figure 5C:
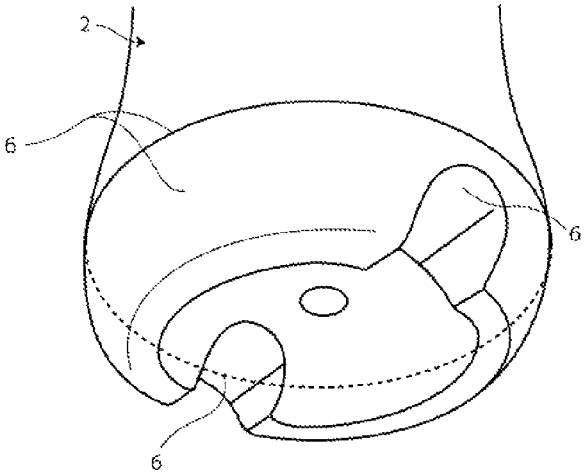
FIG. 5C (dimensional detail view) shows a bottle having a separate, cup-like socket member that has been integrally fused onto its base.
Figure 6A:
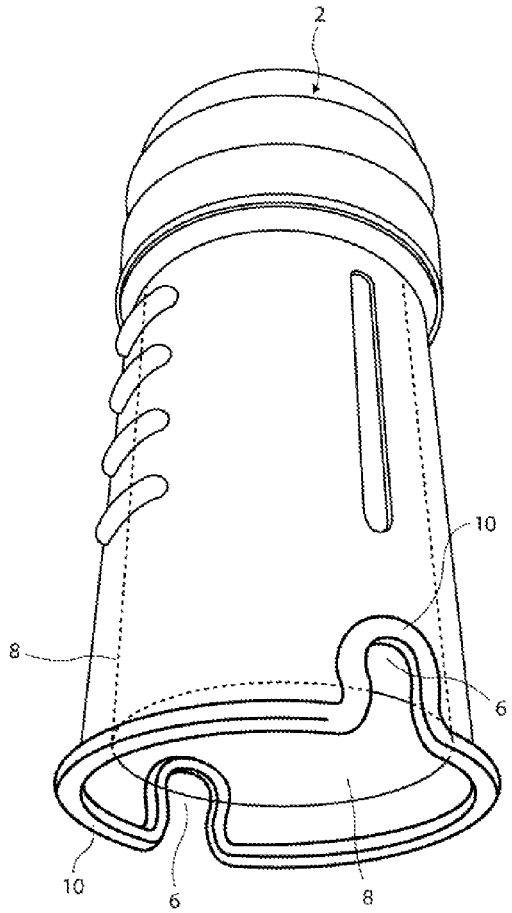
FIGS. 6A and 6B (dimensional views) show two liner style bottles having bilateral socket openings formed into their bases, wherein one bottle has an elastomeric body adhered to its socket and the other does not.
Figure 6B:
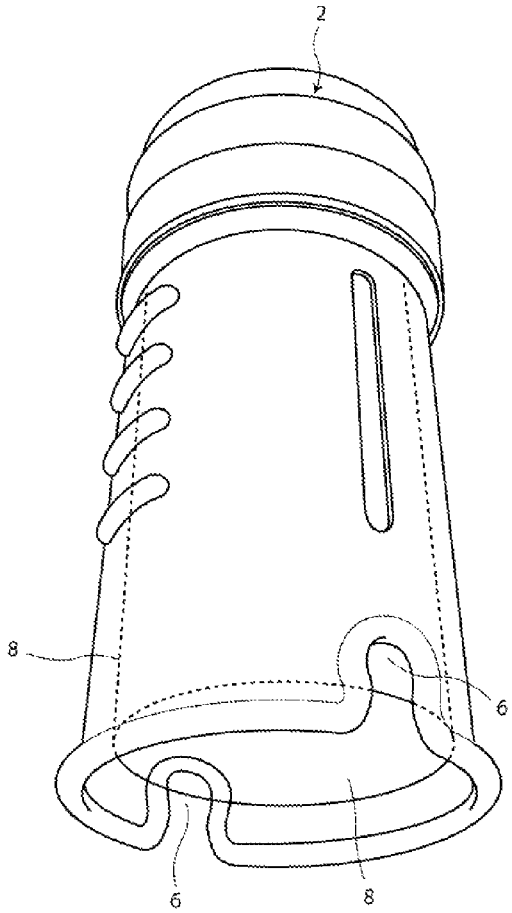
Figure 7A:
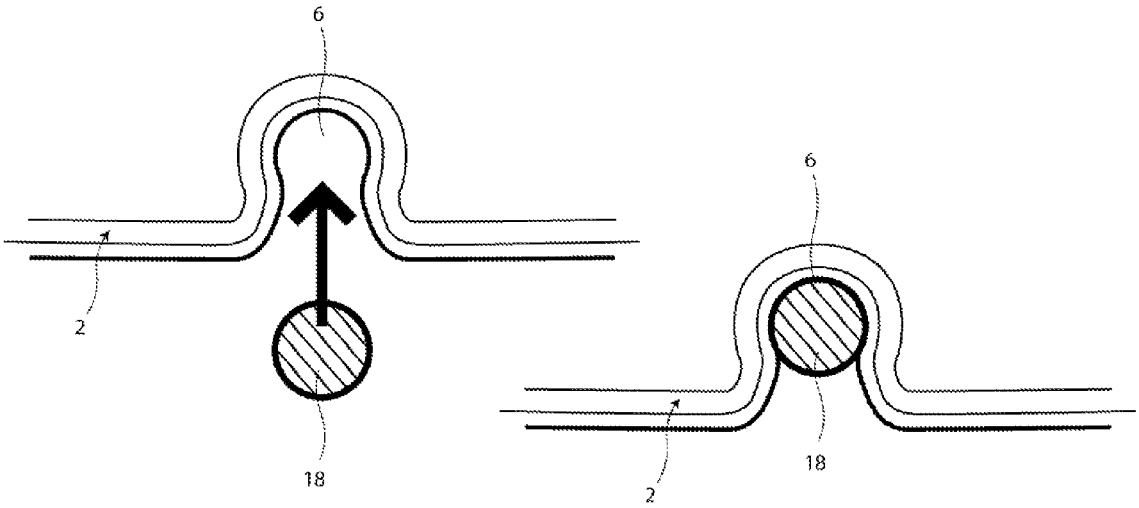
FIG. 7A (side view) shows a socket member having a superiorly constricting insertion channel that leads into a semicircular socket hole and a corresponding articulating members insertion therein.

Generally speaking, the presently preferred embodiment comprises a baby bottle (2) having a first articular surface, articular holder, or socket member (6) thereon to pivotally conjoin with an extension rod (12) having a second articular surface, articular holder, or articulating member (18). An extension rod (12) is a gripping shaft or handle (14) that has a desirably angled, generally cylindrical rod or articulating member (18) emerging from one end (FIG. 2). Whereby, conjoining the extension rod's (12) and it's axle-like articulating member (18) with a bottle's socket member (6) forms a hinge joint (FIGS. 3A, 3B, 4), and furthermore, pivotably extends a bottle's (2) feeding range. The bottle (2) is preferably made from a food grade, BPA free plastic, glass or metal. It has an open top and a nipple (4) to securely cover thereof and a means for dispensing a liquid. Bottle types suitable for this invention can include traditional baby bottle styles (FIGS. 5A-5C), liner style baby bottles (FIGS. 6A and 6B) or any other bottle type provided that a bottle has an articular surface suitable for coupling with an extension rod (14). More specifically, the bottle's (2) articular surface or socket member (6) comprises two bilateral openings formed onto or into its base area (FIGS. 3A, 5A and 6A). These openings constrictively lead into superior, semi-circular holes that are sized and shaped to pivotably conjoin with the extension rod's articulating member (18) (FIG. 7A).

Figure 7B:
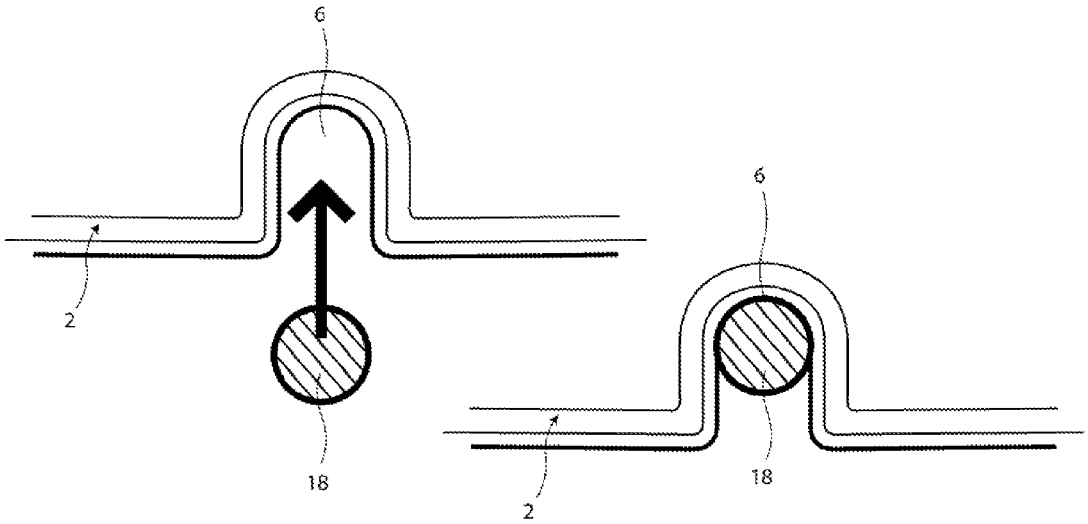
FIG. 7B (side view) shows an inverted "U" shaped socket member having a substantially parallel contour and a corresponding extension rod's insertion therein.

The superiorly constrictive portion (the narrowest portion) is desirably wide to both permit an articulating member's (18) insertion therein and also to facilitate its retention within the socket (6) once fully inserted. Alternatively, provided that there is sufficient conjoining friction with an articulating member (18), the bilateral openings may have a non-constricting or a substantially parallel configuration (FIG. 7B). In either case, the bilateral openings may have sufficiently wider entries (wider than the articulating member), to facilitate articulating member (18) insertion within (FIG. 6A).

Furthermore, the socket member's (6) bilateral openings are axially aligned and diametrically opposed (FIGS. 7A and 7B) to pivotably correspond with the extensions rods axle-like articulating member (18). A socket member (6), however, does not have to diametrically bisect a bottle (2). Practically speaking, a socket member (6) simply permits a bottle (2) to conjoin with an extension rod (12) so that it can rotate about one or more axes (FIG. 4) Therefore, a desirably sized socket member (6) can be positioned anywhere on a bottle deemed necessary. Furthermore, although the preferred embodiment depicts a bottle (2) with a single socket member (6), additional embodiments may have a plurality of socket members (6). Operably speaking, conjoining and disjoining a bottle (2) and extension rod (12) are accomplished by either pushing the articulating member into or pulling it out of the socket member (6). Thus, a caretaker simply needs to employ sufficient force to insert or remove the extension rod's (12) articulating member (18) from the bottles (2) socket member (6). Additionally, the preferred embodiment's socket member (6) (and surrounding area) has a resilient elastomeric material adherent thereon.

Figure 11A:
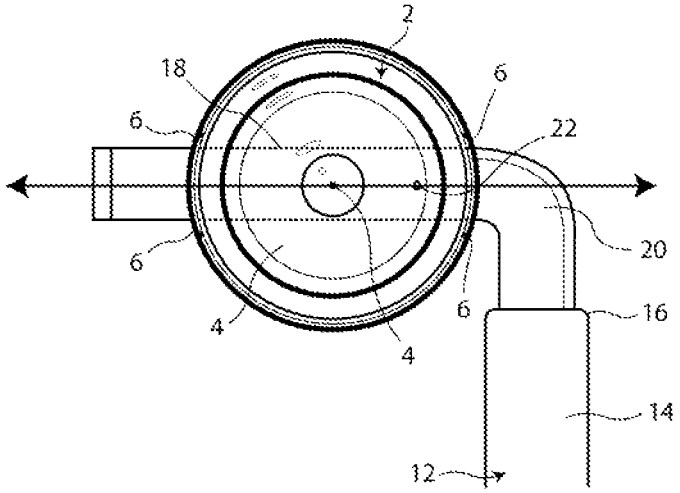
FIGS. 11A to 11C (top views) show various socket member to air vent orientations.
Figure 11B:
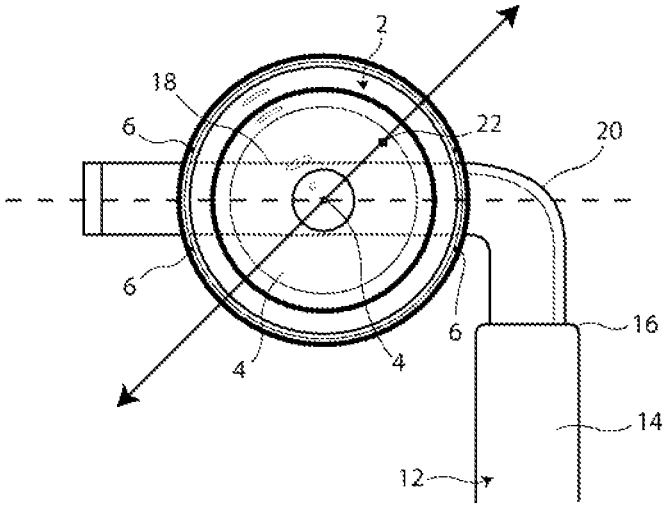
Figure 11C:
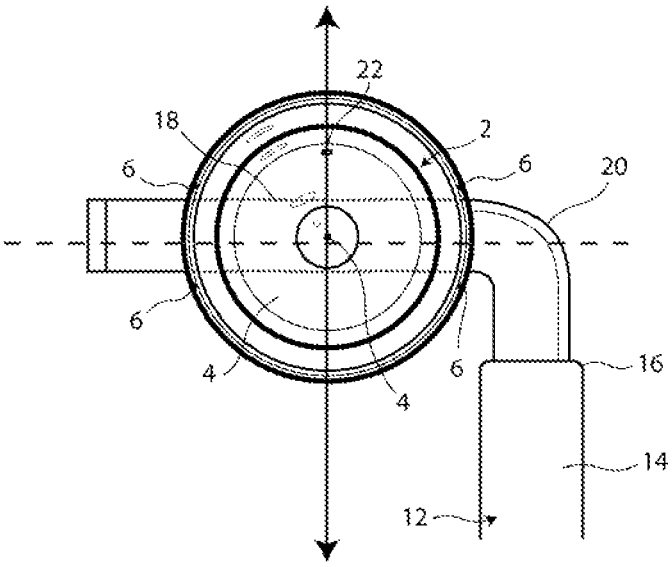
Figure 12A:
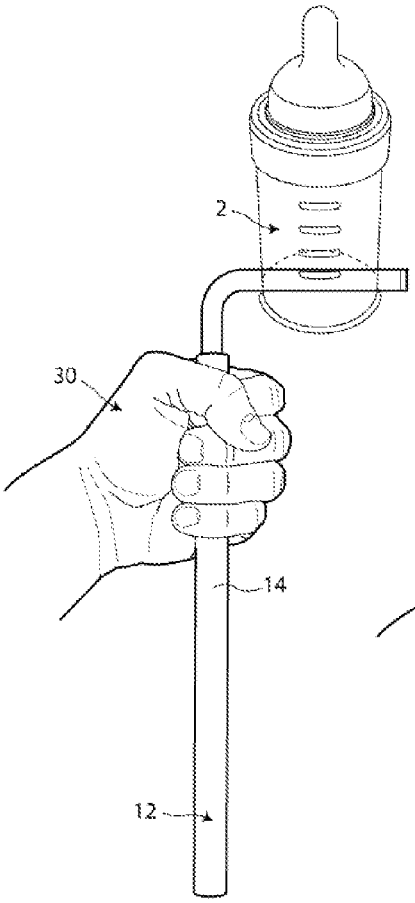
FIGS. 12A to 12C (progressive views) show an operator's handle style grip while holding an extension rod's handle and several gripping points along thereof.
Figure 12B:
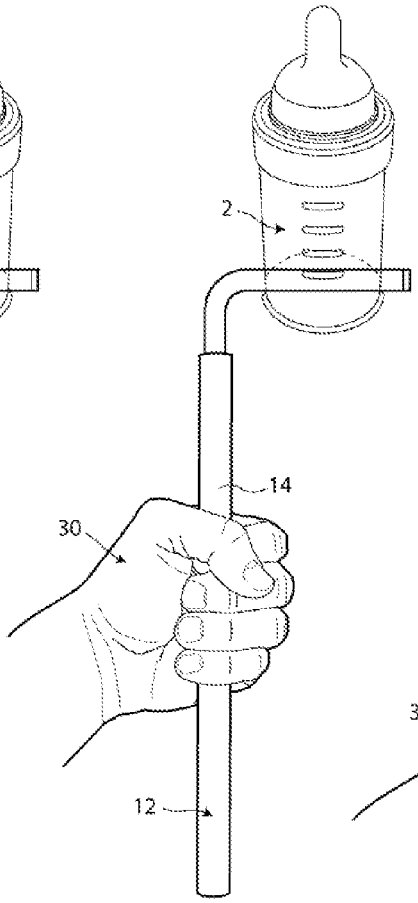
Figure 12C:
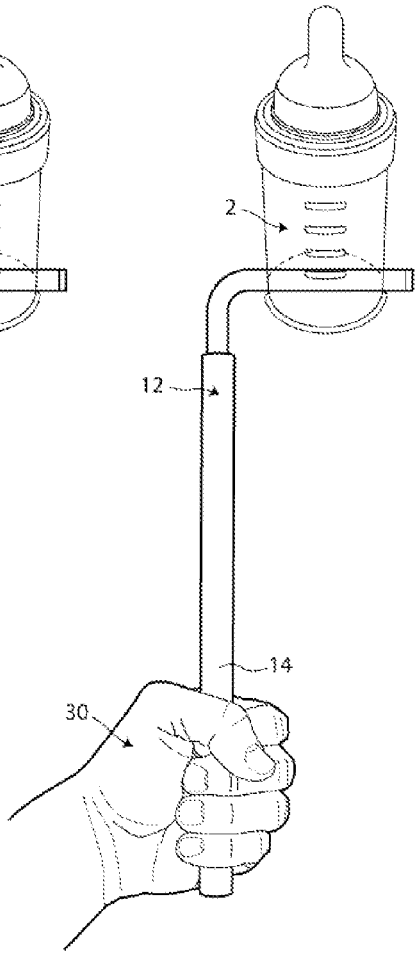

This elastomeric material or elastomeric body (10) lines the socket member's (6) bilateral openings and covers its peripheral rim area (FIGS. 5A and 6A). The elastomer desirably reduces the sockets member's (6) size relative to a corresponding articulating member (18) so that when that they are conjoined, they compressively communicate. This resultant compression is sufficient to aid with articulating member (18) retention within the socket (6) and to produce desirable pivotal friction. Note, an elastomeric body (10) can be smooth or conversely have grooves, channels or embossing formed therein to further modulate compression and pivotal friction. Alternatively, the elastomeric body (10) can be omitted altogether (FIGS. 5B, and 6B). In this instance, the socket (6) can be homogenously formed as part bottle's (2) base material (plastic or glass for example). Lastly, an elastomeric body (10) may be made from any suitable rubber plastic or silicone. It can be formed onto a bottle using adhesives, bonding, coating or injection molding. Note, many commercially available baby bottles utilize anti-colic air systems or vents (22). These systems may require proper positioning for optimal operation. Under these circumstances, it is important to ensure an optimal socket (6) to vent (22) orientation. Therefore, a proper orientation will desirably position the vent (22) while the bottle is operably attached to an extension rod (12). Several vent (22) to socket orientations are shown in FIGS. 11A, 11B and 11C. FIG. 11A shows a vent (22) having a parallel or inline relationship to the socket member (6) and conjoined extension rod. FIG. 2B shows a vent (22) having 45 degree relationship to the bottle's socket member (6) and conjoined extension rod (12). FIG. 2C shows a vent (22) having a vertical, or perpendicular relationship to the socket (6) and its conjoined rod (12). For the purposes of this invention, however, any degree socket to vent (22) relationship may be utilized.

Figure 8A:
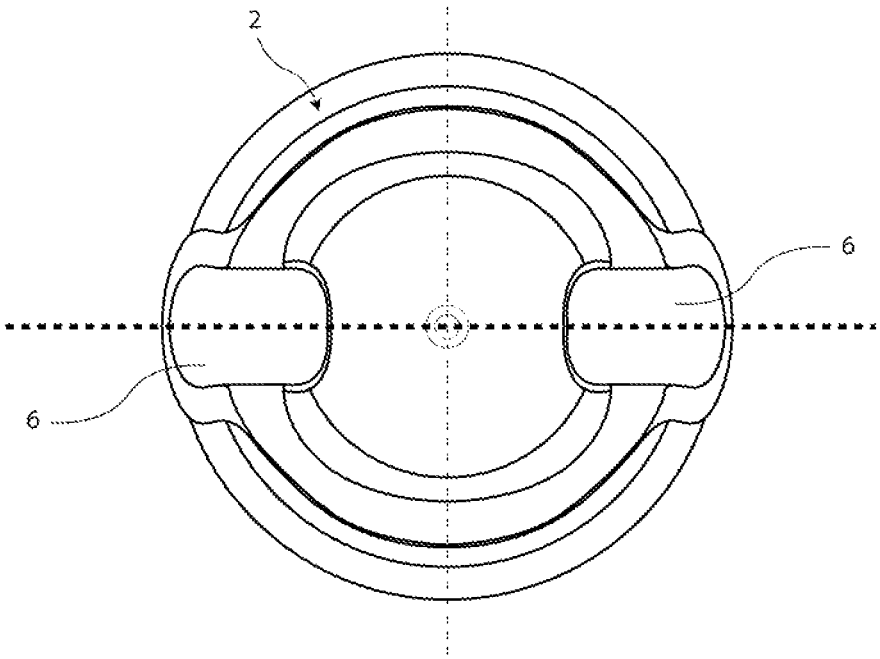
FIGS. 8A and 8B (bottom views) show a traditional style bottle and a liner style bottle's axially aligned socket members.
Figure 8B:
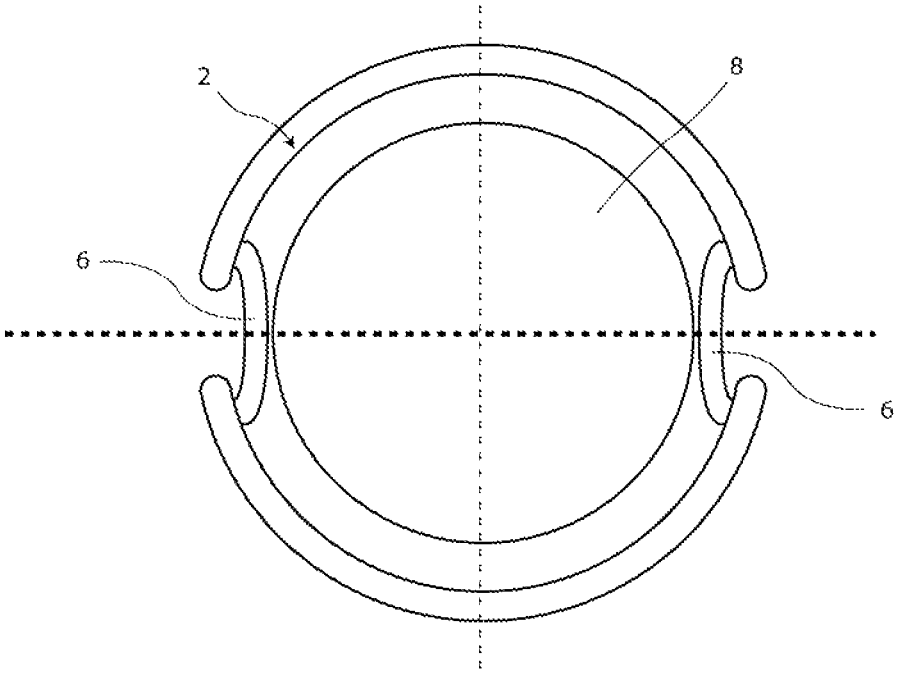

As previously disclosed, the extension rod (12) is a rigid, wand-like shaft having an elongated handle (14) on one end, a substantially shorter, desirably angled articulating member (18) on another end and a connecting shaft (20) in-between. It is generally "L" shaped wherein its articulating member (18) is bent at about 90 degrees to the handle (14) (FIG. 2 and FIG. 8). Note, the shaft (20) of this embodiment generally comprises the curved radial expanse in between the handle (14) and articulating member (18). Practically, however, it is not necessarily an integral feature and may be eliminated. More specifically, the extension rods "L" shape configuration renders the shaft (20) and handle (14) as essentially coincident. This is especially pertinent if a handle's (14) operable length terminates adjacent to the articulating member (18) (a situation wherein the entire handle and shaft expanse is operably graspable). Therefore, the extension rod (12) for this embodiment (and all applicable embodiments) may simply comprise an elongated gripping shaft (20) having a desirably angled articulating member (18) on one end.

Figure 9:
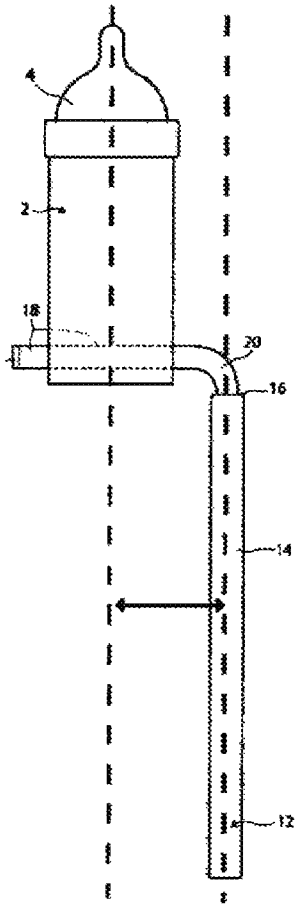
FIG. 9 (plan view) depicts the extension rod's "L" shaped operating configuration, wherein the handle is positioned to one side of the articulating member and is therefore offset from the articulating member's (and conjoined bottle's) center.
Figure 10:
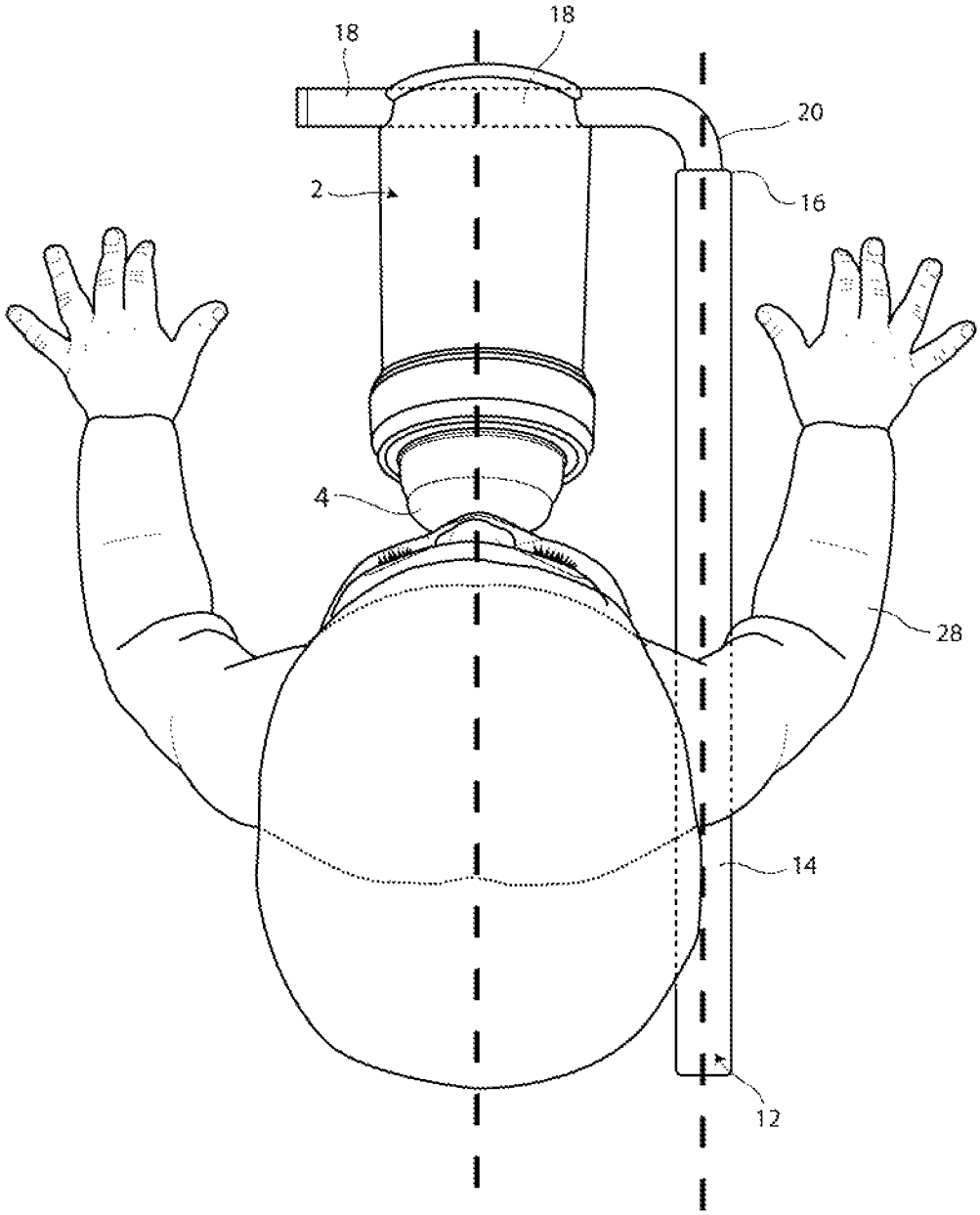
FIG. 10 (top view) depicts the extension rods offset operating configuration while feeding an infant.

Note, the extension rod's handle (14) is positioned to one side of the articulating member (18) and is thereby offset from its center (FIG. 9). During feeding, this offset creates accommodating space (within the rod's "L" shape) for an infant's (28) body (FIG. 10). Operably speaking, the handle (14) will remain offset, or to one side of an infant's (28) body, while the articulating member (18) (and conjoined bottle) (2) will remain centrally positioned for feeding (FIG. 10). Note, the degree of feeding offset is due firstly to the articulating member's (18) length and secondly a conjoined bottles (2) position thereon. Therefore, an extension rod's (12) articulating member (18) is desirably long to sufficiently offset an extension rod's (12) handle (14) for feeding.

Furthermore, the extension rod's handle (14) is a generally straight and adequately thick shaft for gripping. It is sufficiently long to afford a number of gripping positions along thereof (FIGS. 12A, 12B, 12C a handle gripping style), (13A, 13B, 13C a utensil gripping style). In the preferred embodiment, it has a pliant cap, covering or elastomeric body (10) on its bottom. Moreover, it has a tubular covering or grip (16) thereon that substantially sheaths its length. Although the preferred embodiment's handle (14) and grip (16) are depicted as generally straight and cylindrical, this is not a limiting. A handle (14) or grip (16) therefore, can be curved or ergonomically shaped as needed for function and comfort. Note, a handle (14) may be made from metal, plastic, composite wood or any other appropriately rigid material. Its grip (16) can be made from plastic, silicone, rubber or foam or other material. Furthermore, a grip (16) can be attached to a handle (14) by sheathing, wrapping, taping, coating, adhesion, bonding or through injection molding. If deemed necessary, the grip (16) can be eliminated altogether. Lastly, the extension rod's (12) articulating member (18) is a generally straight, cylindrical axle rod that is sufficiently long to hold a bottle (2) thereon. It optionally has a pliant elastomer cap or elastomeric body (10) on its end. Its length is variable however and can be increased or decreased for operative purposes (a handle's offset for example). Furthermore, its diameter/thickness both attachably and pivotally corresponds with a bottle's socket member (6). It can be made from metal, plastic or wood or any combination thereof. As with the extension rod's (12) handle (14), the preferred embodiment's articulating member (18) can have a sheath or covering thereon. Specifically, a desirably thick and pliant, tubular elastomeric body (10) can be applied onto the articulating member's (18) surface (FIGS. 14A to 15D). This elastomeric body (10) is preferably made from silicone plastic, foam, or rubber.

Figure 14A:
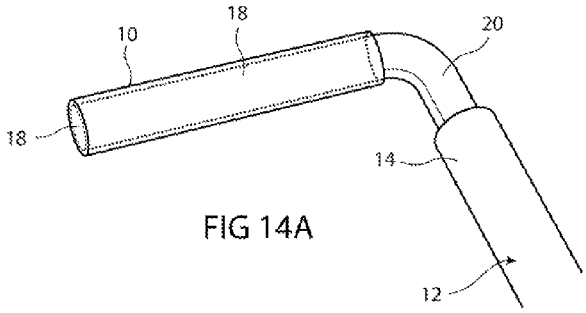
FIGS. 14A to 14C (various detail views) show an extension rod's articulating member having an elastomeric covering, wherein 14C shows addition of sidewall discs.
Figure 14B:
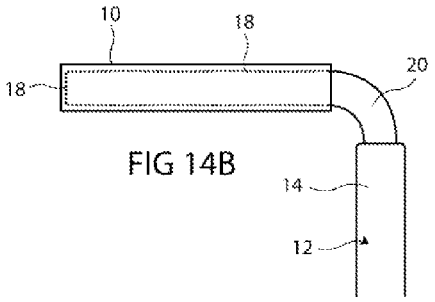
Figure 14C:
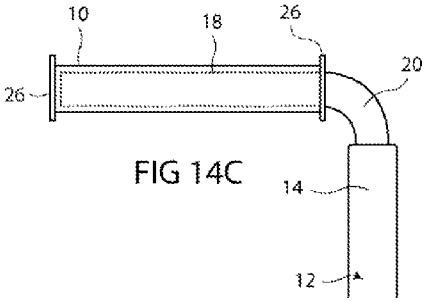
Figure 15B:
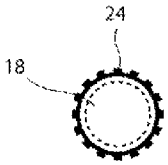
FIGS. 15A to 15D (various detail views) show an extension rod's articulating member with a fluted elastomeric covering, wherein 15B shows a side view and 15C, 15D shows one with and one without disc sidewalls.
Figure 15C:
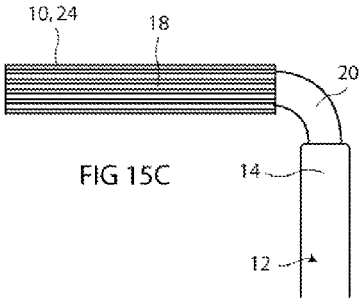
Figure 15A:
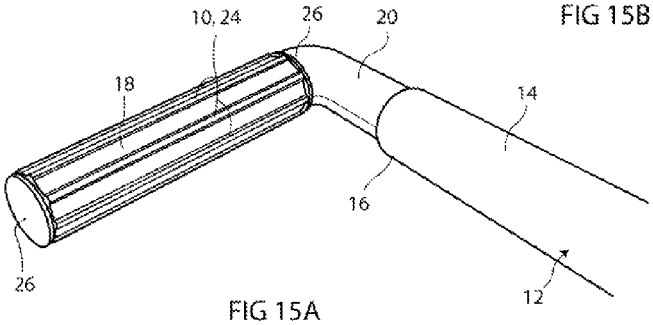
Figure 15D:
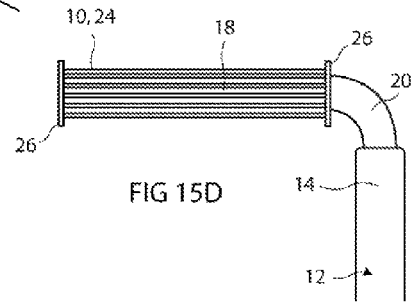

Its surface can be smooth (FIGS. 14A to 14C), embossed, or fluted (24) (FIGS. 15A to 16D). The body (10) can have sidewalls or disc (26) extrusions on either end so that a conjoined bottle will not slide beyond thereof (FIGS. 14C and 15D).

Alternatively, an articulating member's (18) elastomeric body can comprise a series of elongated strips adherently formed or molded onto the articulating member's (18) surface. The extension rod (12) of the preferred embodiment may be fabricated by stamping, bending, extruding, welding, cutting, injection molding or 3-D printing. It may be hollow or solid. It may be comprise a single unit or comprise an assembly of parts which may be screwed, glued, welded, bonded or snapped together. For example, a handle (14) and articulating member (18) may be independently fused together. The extension rod (12) may be made from any suitable plasticized material, fiber glass, metal, composite, wood, foam, or any combination thereof. Likewise, the bottle (2) and its socket member (2) may be formed as a single unit or conversely be formed by independently molding, screwing, fusing, bonding or gluing a socket member (6) onto a bottle (2) (FIG. 5C). Note, although the presently preferred embodiment's extension rod (12) is rigid, this is not limiting. Extension rods (12) may be flexible, adjustable, or bendable (18), wherein an operator can adjustably bend, stretch or elongate the rod (12) for operation. For example, a rod may utilize telescoping parts, internally flexible wire or a series of flexibly conjoined members or hinges.

Figs Alternative Embodiments

Figure 23A:
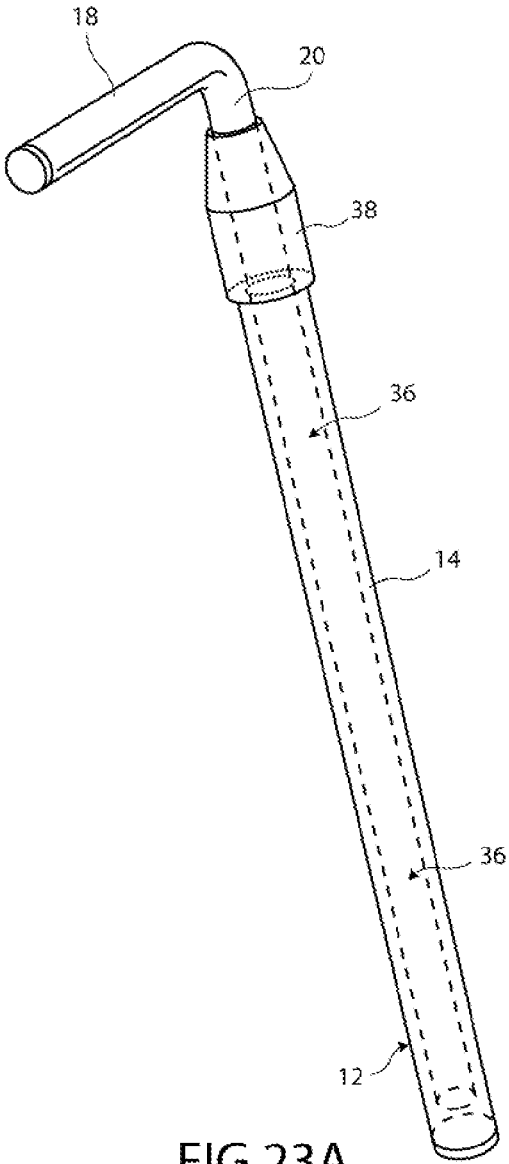
FIGS. 23A and 23B (progressive views) show an extension rod having a telescoping extending member, wherein retractably extending the member increases the rod's operating length.
Figure 23B:
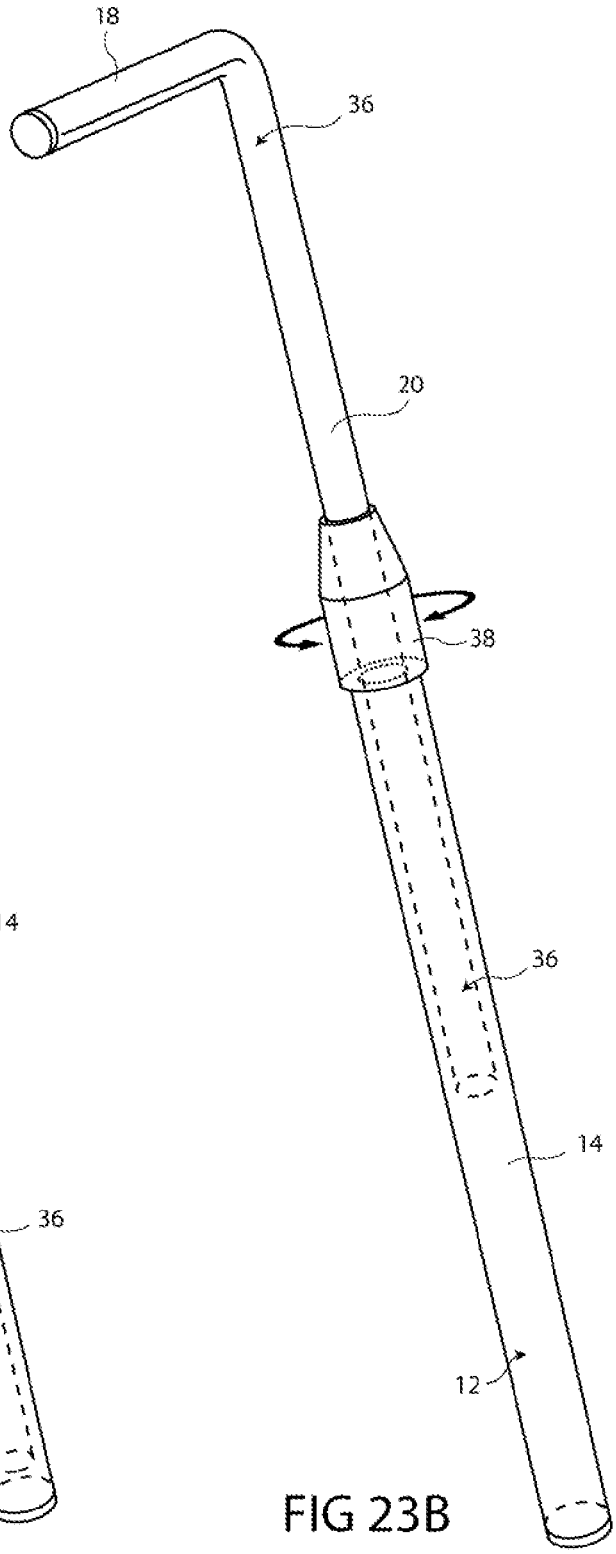

There are many possible extension rod and bottle embodiments. For example:

FIGS. 23A (Nested view) and 23B (extended view) show an extension rod (12) having an extending member (32). The extending member (32) is an "L" shaped telescoping shaft (20) having an articulating member (18) bent at about ninety degrees at its end. More specifically, the extension rod's (12) handle (14) is hollow and has an open end that slidably houses the extending member's (32) retractable shaft portion (20). Furthermore, the handle (14) and its nested extending member (32) are adjustably conjoined by a tightening member (34) or collar. The tightening member (34) can be screwed to tighten it or unscrewed to loosen it. When the tightening member (34) is sufficiently loose, an operator can retract the extending member's nested shaft to increase the extension rods (12) length (FIG. 23B). Conversely, the member (34) can be tightened to retain the telescoping shaft (18) in a desired position. In summary, the extension rod (12) of this embodiment comprises is a hollow gripping body that houses a retractable shaft (18) having a desirably angled articulating member on its end, wherein the hollow gripping body and retracting shaft are adjustably conjoined by a tightening member (34) or collar.

Figure 24A:
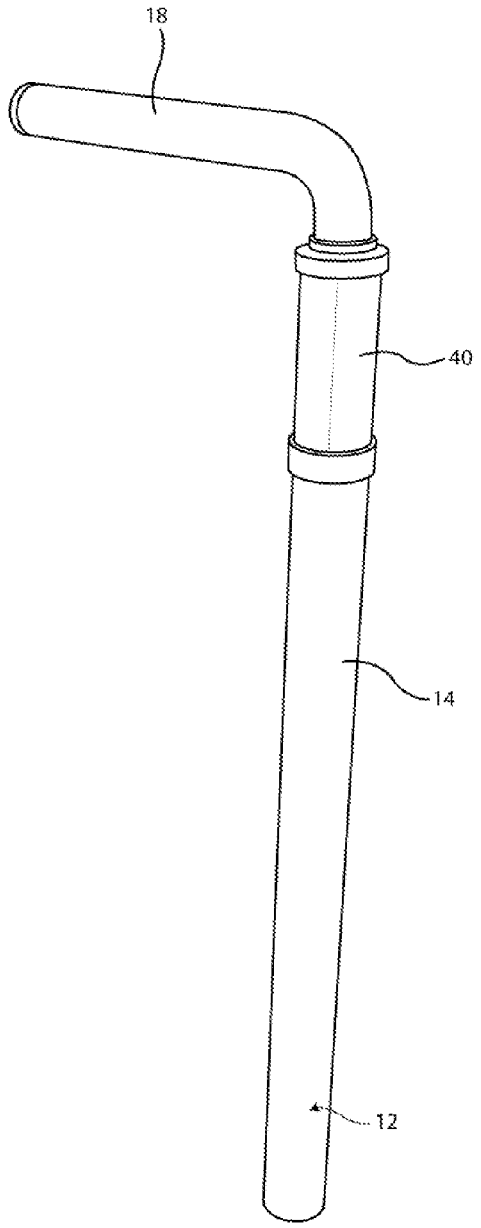
FIGS. 24A and 24B (progressive views) show an extension rod having a flexible member in between its handle and articulating member, wherein bending the flexible member adjustably positions the articulating member.
Figure 24B:
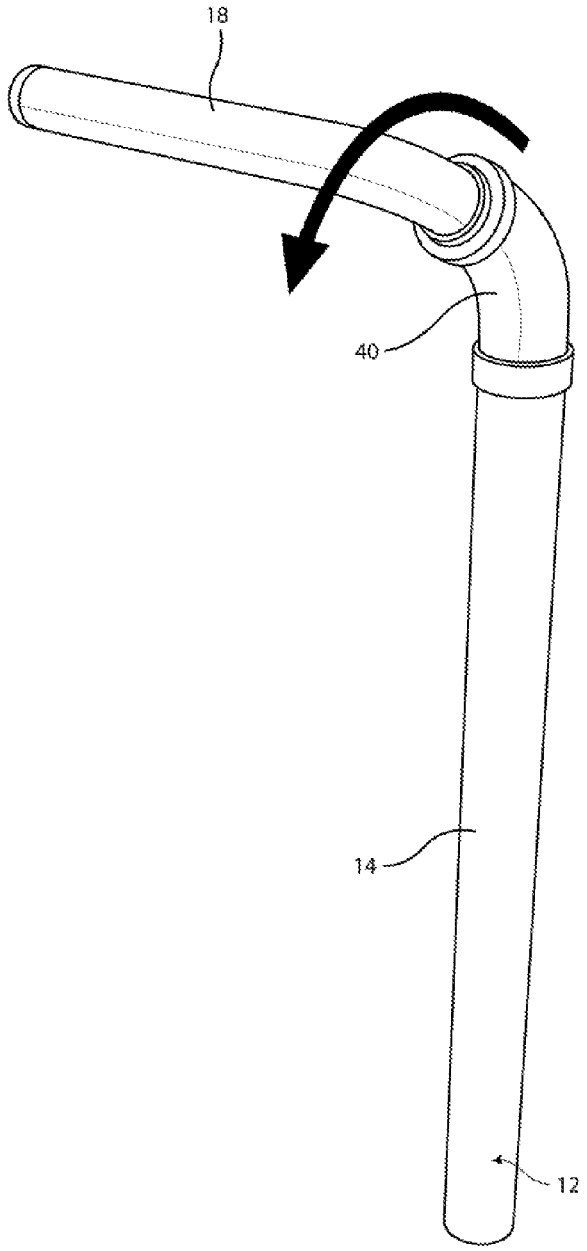

FIGS. 24A (an unbent view) and (24B a bent view) show an extension rod (12) having a flexible member (36) thereon. Specifically, the extension rod's (12) handle (14) and articulating member (18) has a variably bendable, connecting shaft or flexible member (36) in-between. Bending the shaft changes the positional relationship between the handle (14) and articulating member (18) (FIG. 24B).

Note, the flexible member (36) portion can be made from bendable plastic, metal, rubber, elastomer, articulating joints, internally flexible wire or any combination thereof. Lastly, it can have any length, wherein the extension rod's (12) entire handle (14) can comprise a flexible member (36).

Figures 25A, 25B, 25C:
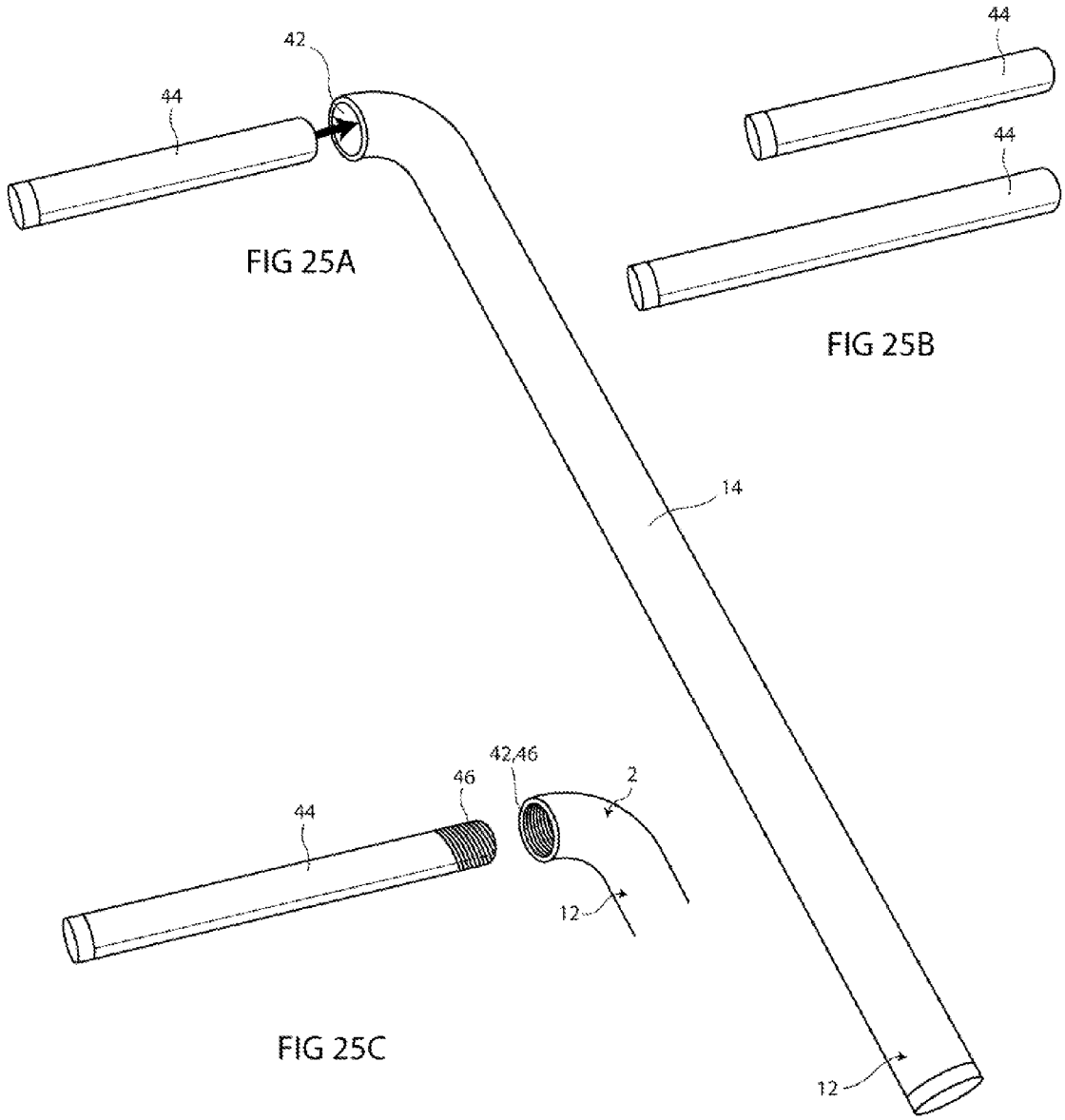
FIGS. 25A and 25B (various views) show a modular extension rod having an aperture on one end to conjoin with a number of variably long attaching articulating members.
FIG. 25C (Dimensional detail view) shows a modular extension rod having a threaded aperture on one end to conjoin with a number of variably long threaded attaching articulating members.

FIGS. 25A to 25C show a modular extension rod (12) having a handle (14) with an aperture (42) at one end to removably conjoin with one or more attaching articulating members (44), wherein an attaching articulating member (44) has a pre-determined length and thickness. Note, an attaching member (44) is generally cylindrical axle rod that is variably long (FIG. 25B), and thick so that it can pivotably conjoin with a bottles socket member (6). Furthermore, depending on its length, it can increase or decrease the extension rod's (12) operable offset (FIGS. 9 and 10). An attaching articulating member (44) is preferably made from metal or plastic and can conjoin with the handles aperture (42) through a number of means. For example, the attaching articulating member (44) may frictionally insert into the handle's (14) aperture (42). Alternatively, they can be threaded (46) and screw into a handle's (14) aperture (42) having corresponding threading (46) (FIG. 25C). Lastly, an attaching articulating member (44) and handle aperture (42) can have corresponding interlocking extrusions (not shown).

FIGS. 26A (a gripping extension) 26B (a gripping extension conjoined with a rod) and 26C (a flexible gripping extension) show a removably attachable gripping extension (48) The gripping extension (48) comprises a desirably angled handle having an aperture (42) on one end to removably attach with an extension rod's (12) handle (14) end (FIGS. 26A and 26B). Note, a gripping extension (48) may have any length, shape, thickness and gripping angle as deemed appropriate for operation. Furthermore, It can be flexible or variably bendable (FIG. 26C).

Figure 26D:
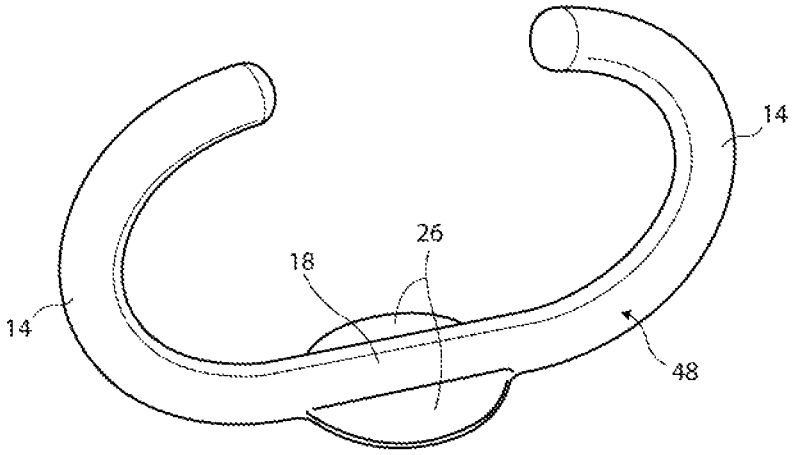
FIG. 26D (a dimensional view) shows children's gripping extension having an articular member and conjoined base that non-pivotably inserts into a bottle's socket member.
Figure 26E:
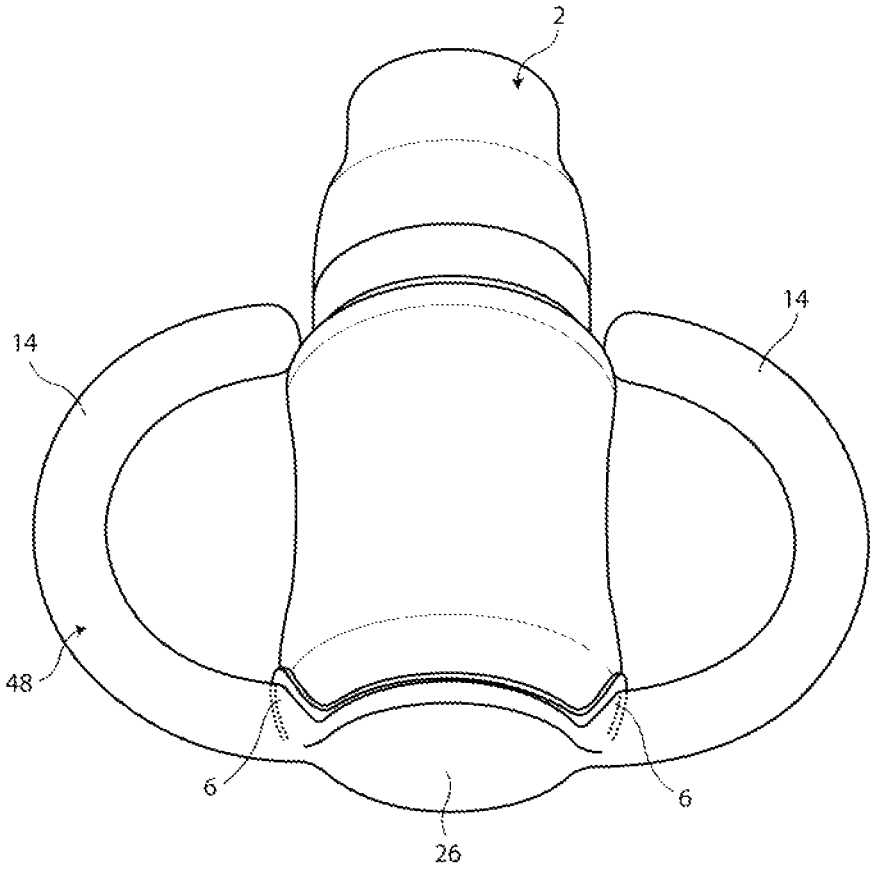
FIG. 26E (a dimensional underside view) shows a children's gripping extension non-pivotably conjoined with a bottle's socket member.

FIGS. 26D (a dimensional view) 26E (a dimensional conjoined view) show a mostly oval shaped gripping extension (48) having bi-lateral gripping handles on its sides and a mostly cylindrical axle-like articulating member (18) on its bottom, wherein the articulating member (18) has a circular platform, base, or disc (26) formed onto its bottom (FIG. 26D) and the disc has a top side to communicate with a bottles (2) bottom and a bottom side for resting on a surface. Furthermore, the gripping extension's (48) articulating member (18) non-pivotably conjoins with a corresponding bottle's (18) socket member. More specifically, the articulating member (18) attachably inserts into a bottle's (2) socket (6) while disc's (26) top forms a tangential communication with the bottle's (2) bottom so that the gripping extension (48) cannot pivot along its articulating member (18). Note, additional embodiments for this gripping extension (48) may eliminate the disc (26) base so that if desired, the gripping extension (48) can pivot within a bottles (2) socket (6).

Figure 27A:
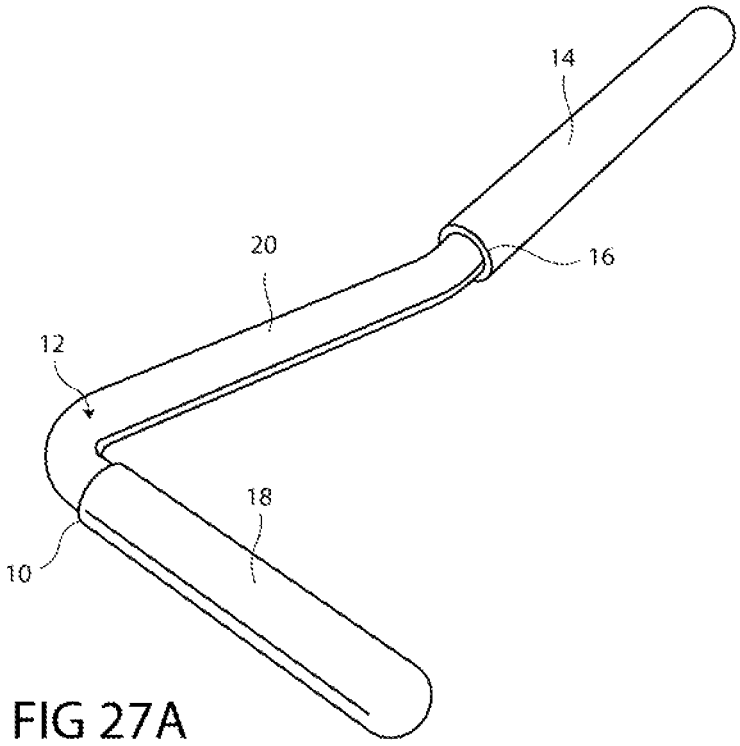
FIGS. 27A and 27B (a dimensional view and plan view) show an extension rod having a handle that is perpendicular to and axially in-line with the articulating member's middle.
Figure 27B:
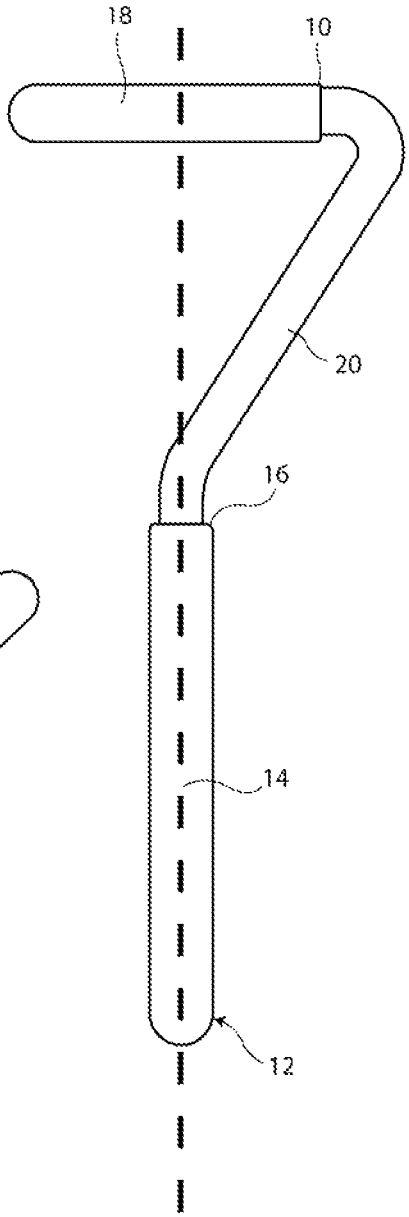

FIGS. 27A (dimensional view) and 27B (plan view) show a number "7" shaped extension rod (12), wherein the handle (14) of this extension rod (14) is not offset. Instead, shaft (20) is variably angled so that the extension rod's (12) handle (14) is axially in line with the articulating member's (18) middle (FIG. 27B).

Figure 28A:
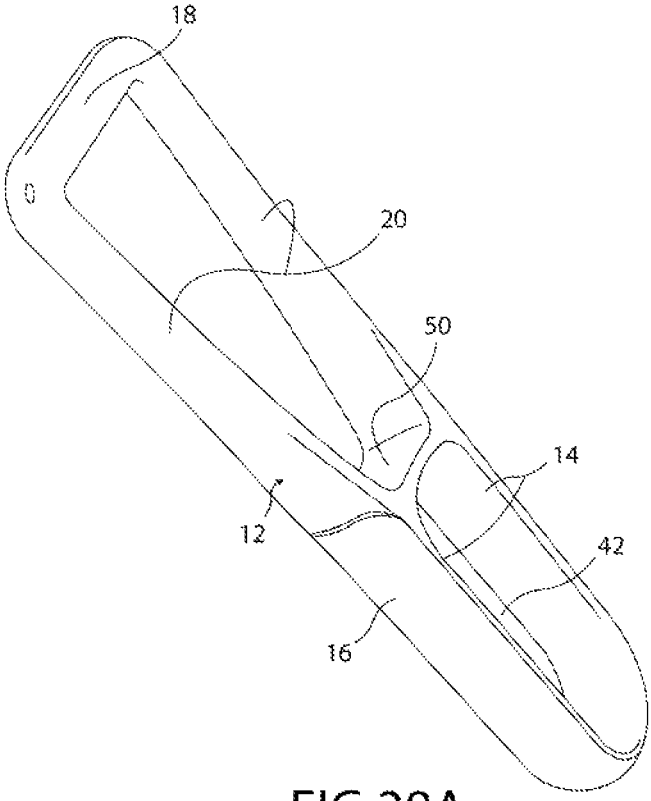
FIGS. 28A and 28B (dimensional views) show two generally triangular shaped extension rod variations having bifurcated handles with bifurcated shafts emerging from thereof, wherein one extension rod has an abridging stabilizer and the other does not.

FIG. 28A (dimensional view) shows a generally triangular shaped extension rod (12) having a handle (14) with a bifurcated shaft (20) emerging from thereof and an axle-like articulating member (18) that terminally abridges the bifurcated shaft (20) ends. Note, the articulating member (18) and the adjacent space in-between the bifurcated shaft (18) area is wider than a bottle (2) and its socket member (6) so that when the rod/bottle are conjoined, the bottle can desirably pivot without interruption.

The extension rod's (12) handle (14) is adequately thick for gripping and sufficiently long to afford various gripping points along thereof. Note, there is an elongated opening formed through the handles (14) center. This hole, or handle aperture (42) substantially spans the handle's (14) length and is large enough for a user to place a thumb there through. Inferiorly, the handle's aperture (42) terminates a distance above the handle's (14) curved bottom. Superiorly, the aperture (42) terminates as the underside or bottom of an abridging span or stabilizer (50). The stabilizer (50) is a connecting juncture that demarcates the handle's (14) upper end while simultaneously demarcating the bifurcated shaft's (20) inferior origin. Lastly this embodiment's handle (12) incorporates elastomeric inserts or grips (16). The (16) grips may be applied by coating, gluing, adhesion, bonding or through injection molding processes.

Figure 28B:
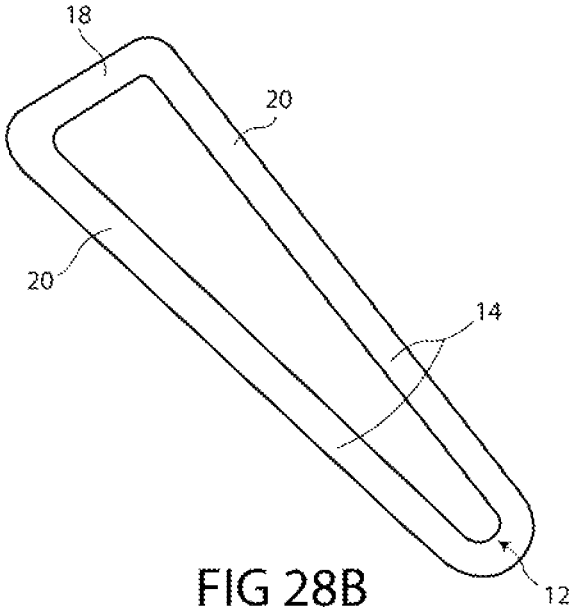

FIG. 28B (dimensional view) shows a generally triangular shaped extension rod (12) without a demarcating stabilizer (50)

Figure 29:
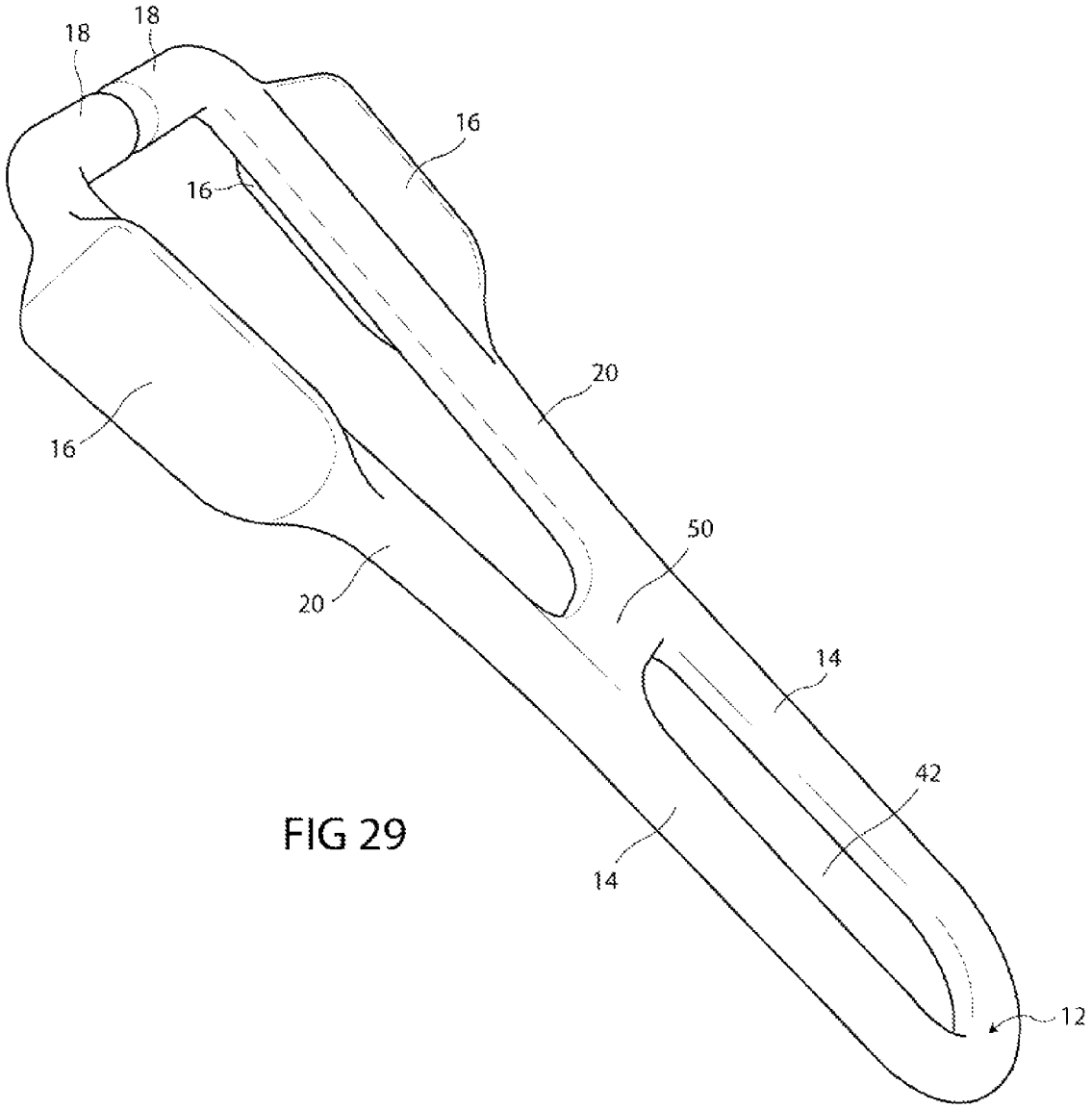
FIG. 29 (dimensional view) shows a triangular shaped extension rod having flared grips bilaterally formed into its bifurcated shaft area.

FIG. 29 shows an extension rod (12) embodiment that is has bilateral grips (16) formed into its bifurcated shaft (20)

Figure 30:
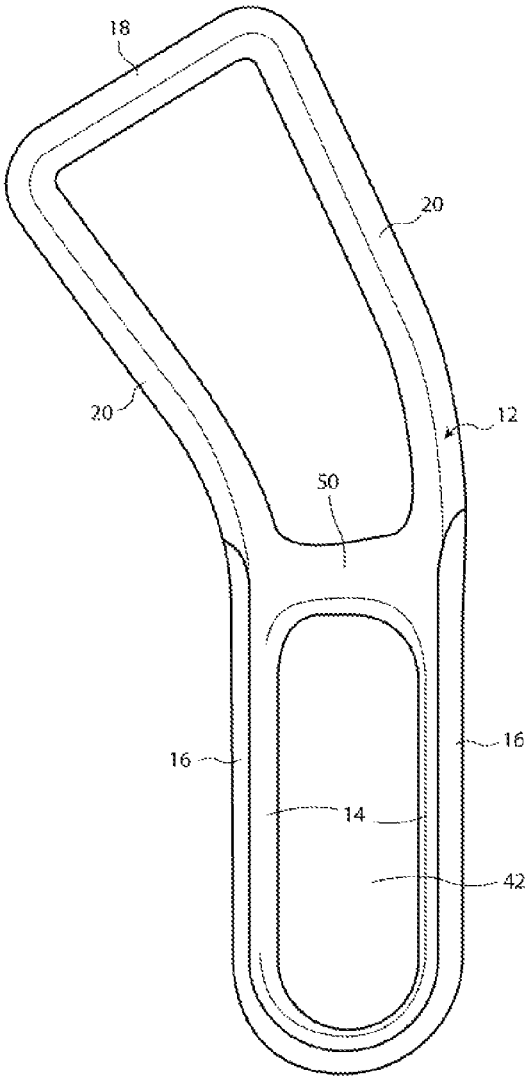
FIG. 30 (front view) shows an extension rod bent or angled to one side.
Figure 31:
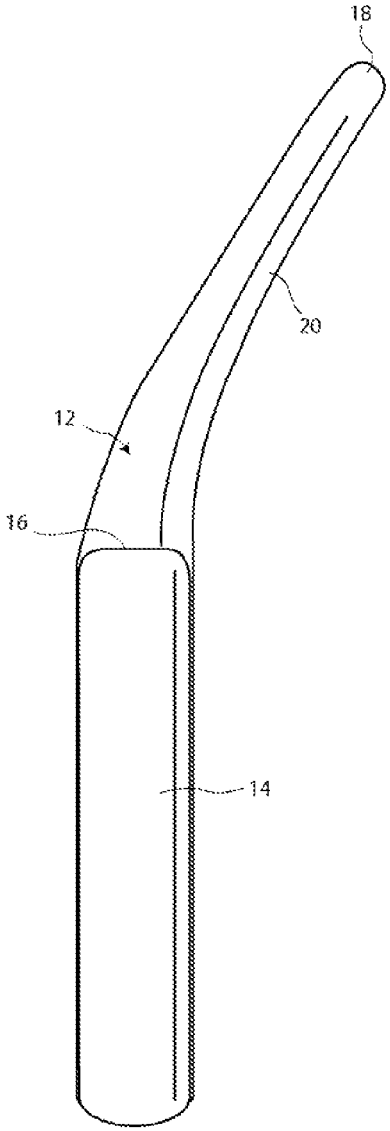
FIG. 31 (side view) shows an extension rod bent or angled forwards (or backwards).
Figure 32:
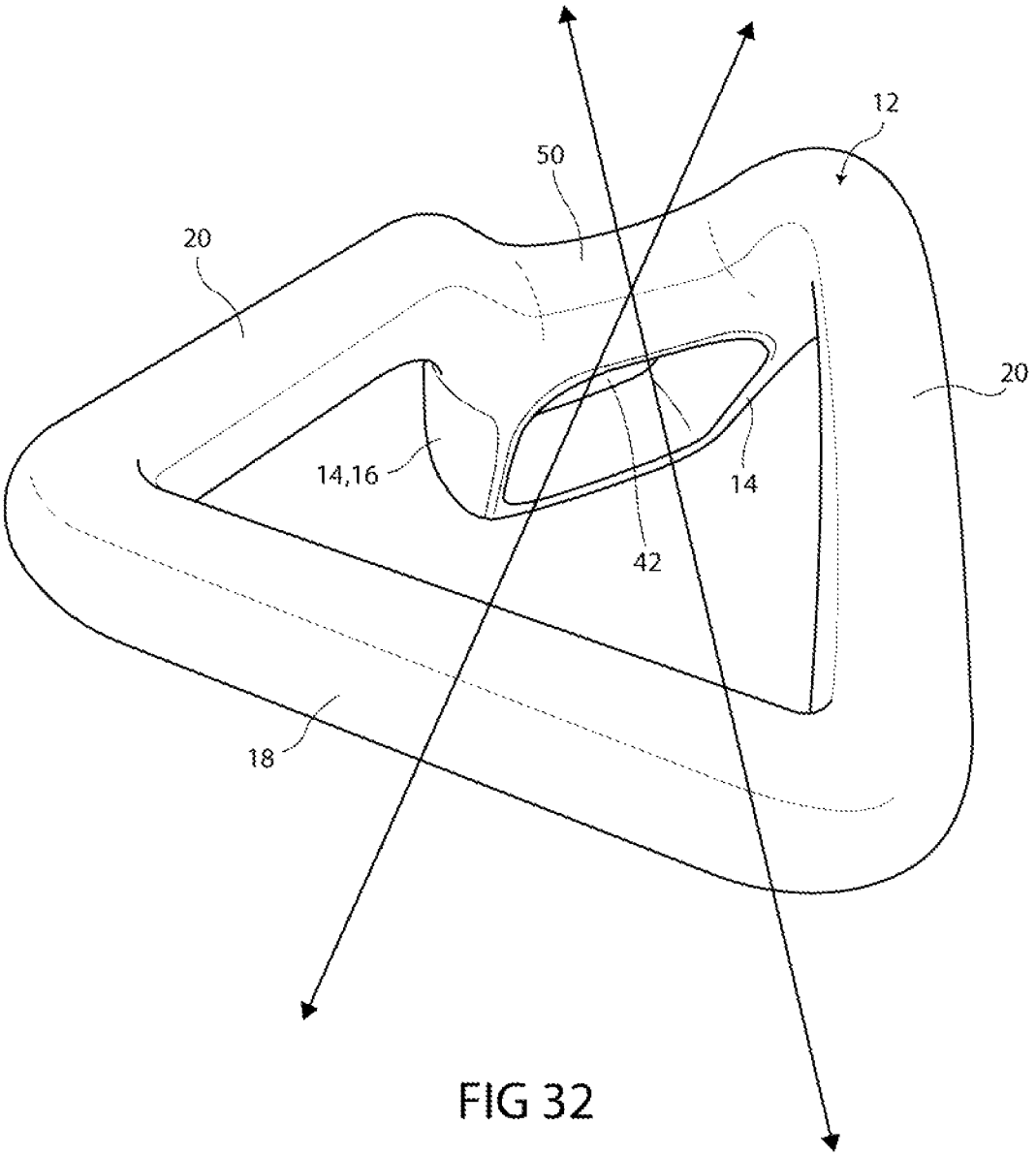
FIG. 32 (dimensional view) shows an extension rod twisted or angled along multiple axes.
Figure 33A:
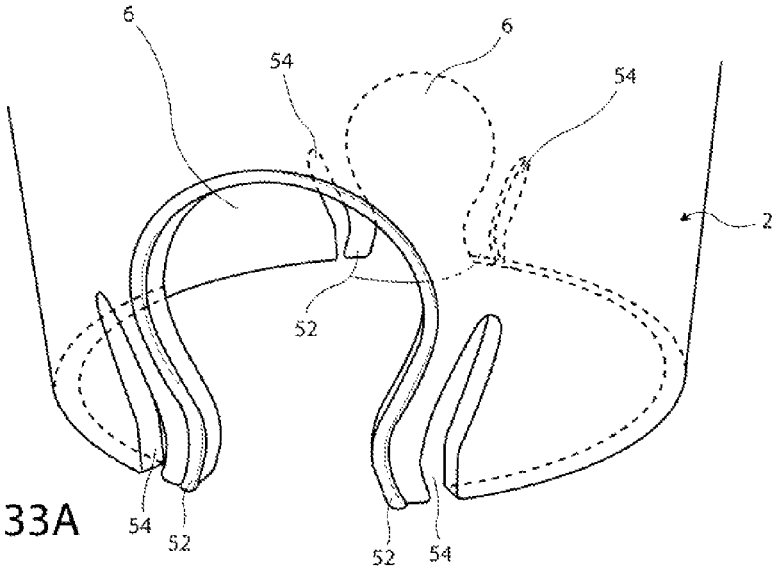
FIGS. 33A to 33D (dimensional and progressive socket side views) show a bottle having pressure sensitive bilateral socket openings and several corresponding socket side views of an extension rod's insertion therein.
Figure 33B:
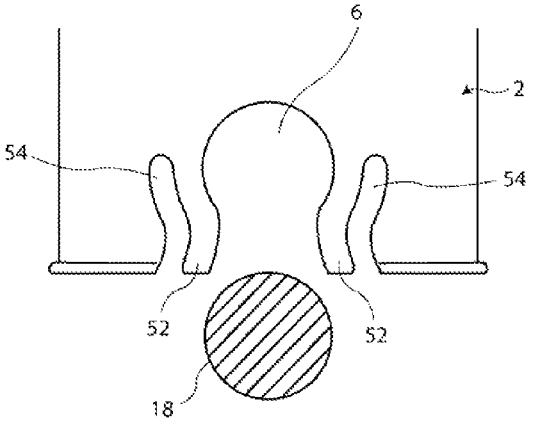
Figure 33C:
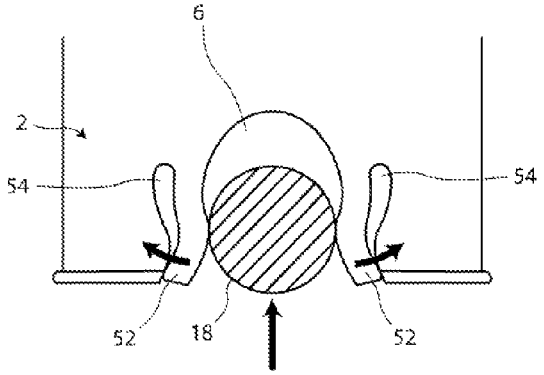
Figure 33D:
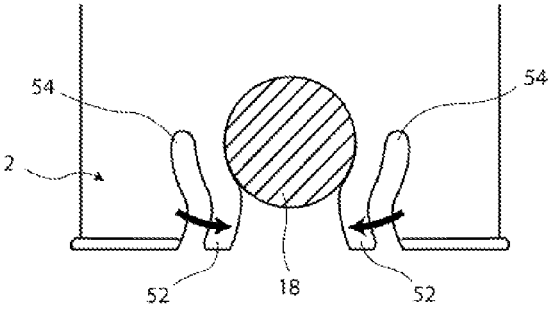

FIG. 30 shows an extension rod (12) embodiment that is bent or angled laterally FIG. 31 shows an extension rod (12) embodiment that is bent or angled forwards FIG. 32 shows an extension rod (12) embodiment that is bent or twisted along multiple axes FIGS. 33A to 33D show a bottle (2) having bilateral, horseshoe shaped sockets (6) formed into its base and lower sides (FIGS. 33A and 33B), wherein the sockets (6) have flexibly open bottoms. Specifically, each socket (6) opening has bilateral appendages with adjacent flexing channels formed therein (54), wherein the appendages widen when a larger volume passes through its constrictively open bottom (FIG. 33C). Collectively, the flexible appendages and their adjacent flexing channels (54) comprise a variably accommodating means or clipping member (52). Thus, as a wider articulating member (18) inserts through the constrictively narrower socket bottom (6), the clipping member's (52) appendages flexibly widen so that an articulating member (18) can pass there through (FIG. 33C). Note, as the appendages widen, the flexing channels (54) provide expansion space. Lastly, after the articulating member (18) enters the socket (6), the clipping member (52) appendages reflexively return to their base position and facilitate (18) with retention within the socket (6) (FIG. 33D).

Figure 34A:
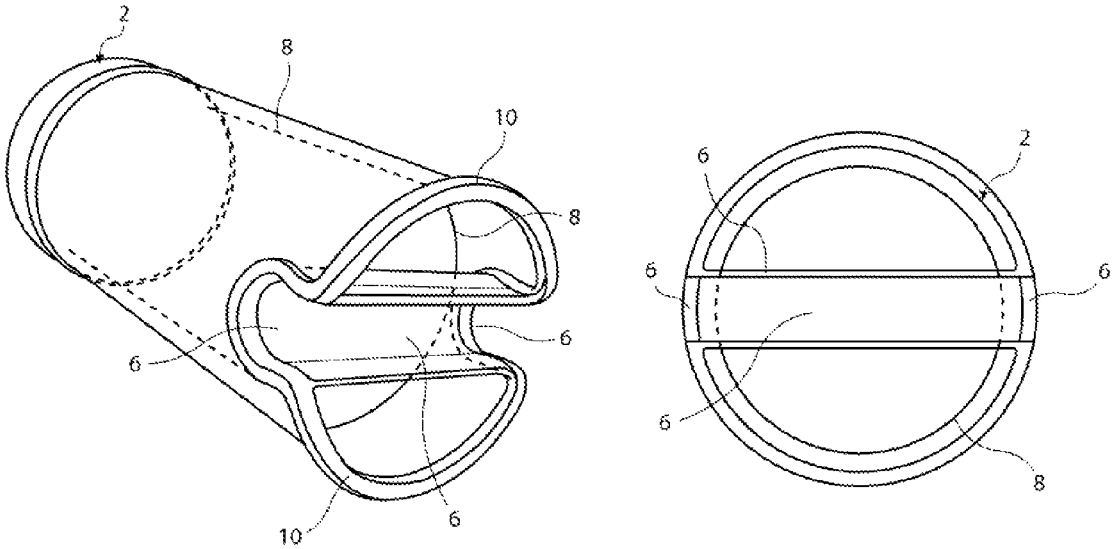
FIGS. 34A and 34B (dimensional bottom views) show a liner style bottle and a traditional style bottle having mostly tubular sock members formed across their bottoms.
Figure 34B:
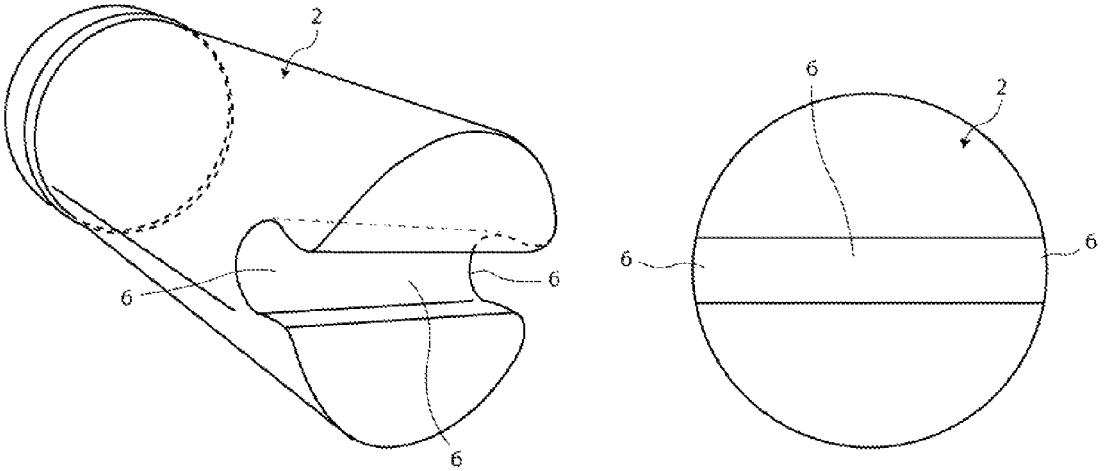

FIGS. 34A and 34B show two bottle (2) variations having mostly tubular sockets traversing across their bottoms. FIG. 34A shows a liner style bottle (2) having a mostly tubular socket member (6) diametrically traversing its open bottom (2). FIG. 34B shows a traditional styled bottle (2) having a mostly tubular socket member (6) formed through its closed bottom. Either of these sockets members (6) may incorporate flexibly accommodating grooves, channels or slits in their tubular walls.

Figure 3B:
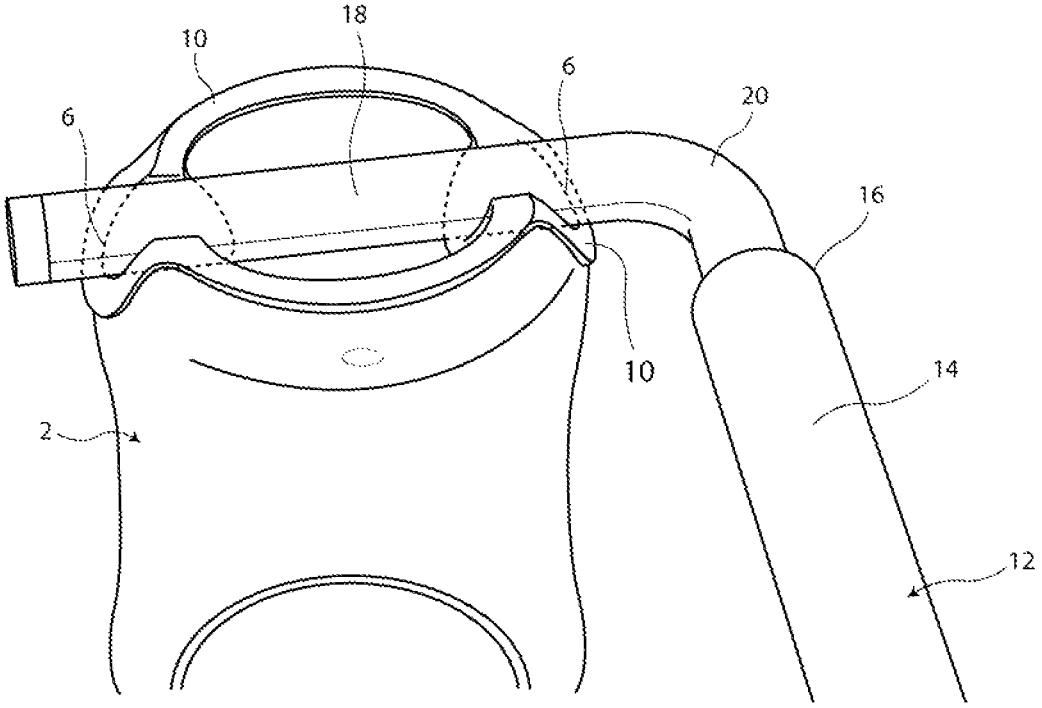
Figure 35A:
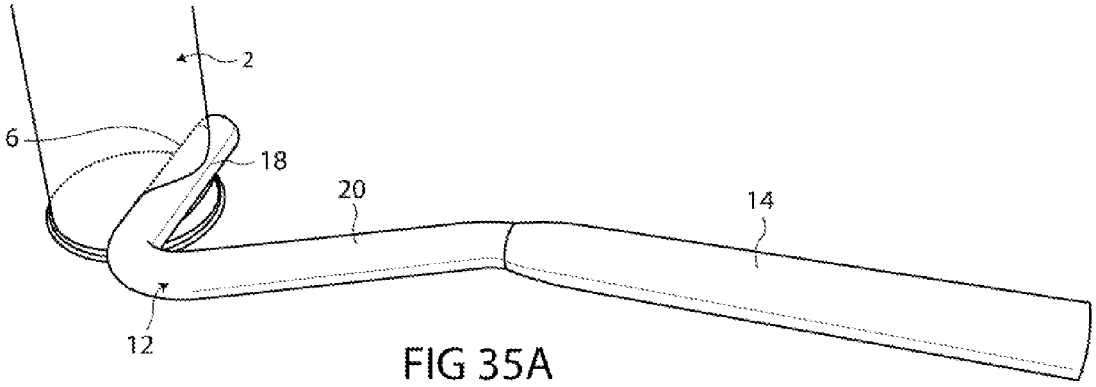
FIGS. 35A to 35C (various dimensional views) show a bottle having a mostly tubular socket member formed into its lower side and a corresponding extension rod in various stages of communication.
Figure 35B:
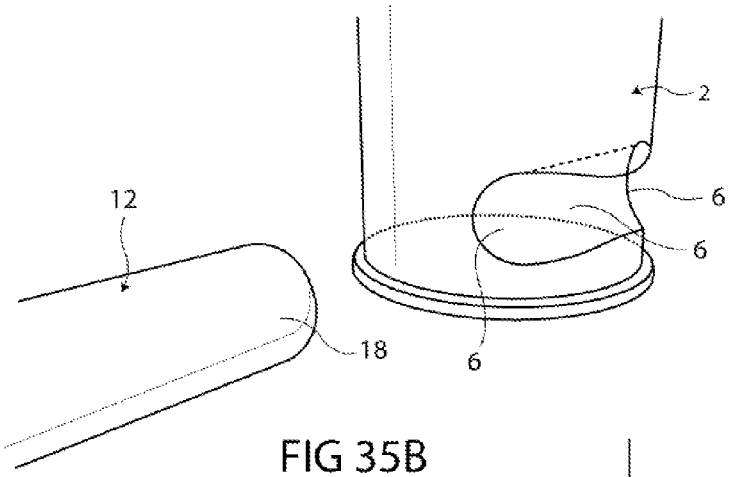
Figure 35C:
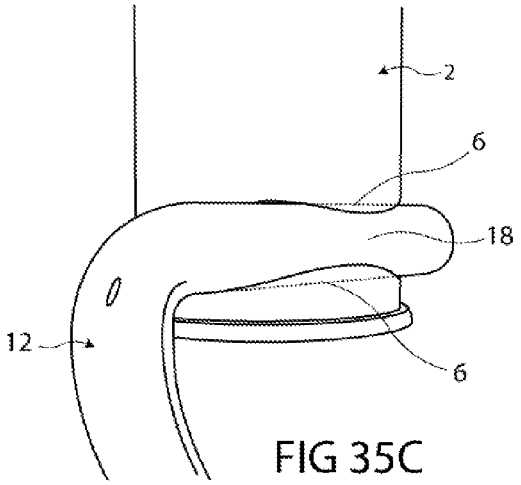

FIGS. 35A to 35C (various views) show a bottle (2) having a mostly tubular socket member (6) traversing through its lower side and a corresponding extension rod (12) in various stages of communication (FIG. 3B).

Figure 36A:
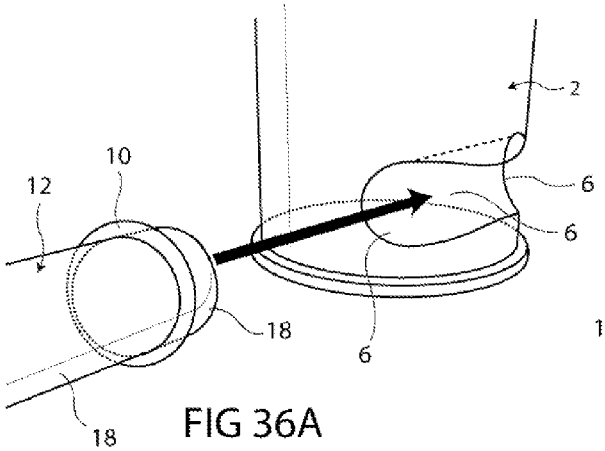
FIGS. 36A to 36C (a dimensional detail views and progressive side view details) show an articulating member having an adherent elastomeric O-ring on its end and furthermore, various stages of communication with a mostly tubular socket member.
Figure 36B:
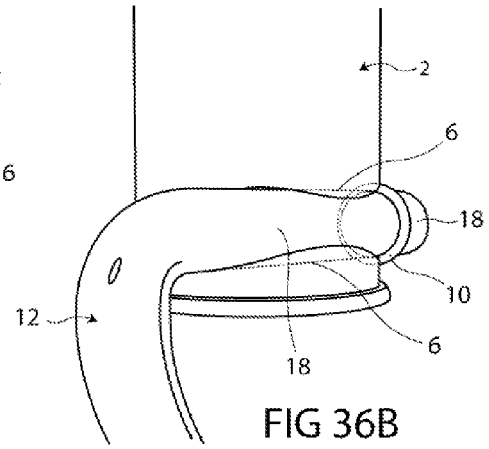
Figure 36C:
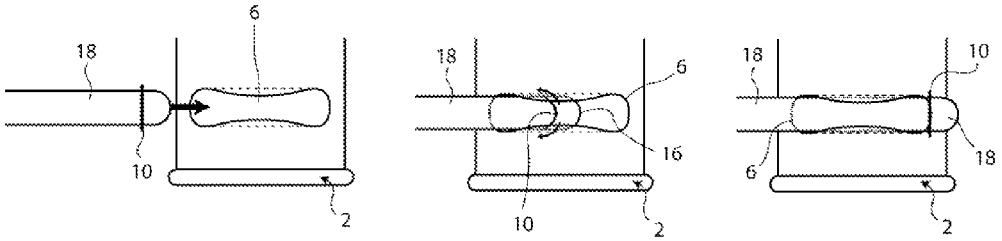

FIGS. 36A to 36C show an extension rod's (12) articulating member (18) having O-ring shaped elastomeric member (10) formed thereon, proximal to its termination (FIGS. 36A and 36B).

As the articulating member (18) enters a corresponding socket member (6), the elastomeric body (10) forms a compressive communication. Furthermore, it aids with socket member (6) retention when the articulating member (18) is fully conjoined (FIG. 36C).

Figure 37:
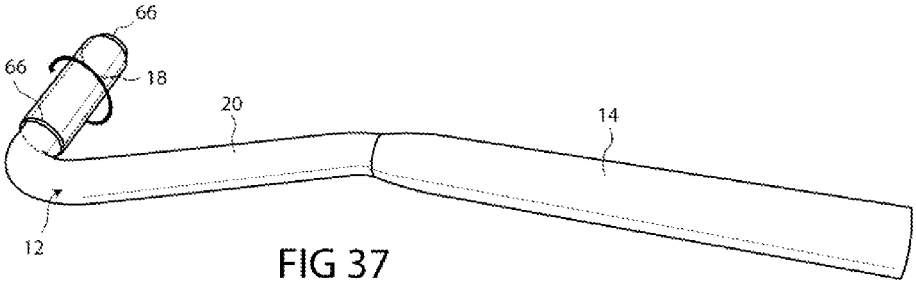
FIG. 37 (dimensional view) shows an extension rod having a rotatable cuff or sleeve sheathing its articulating member.

FIG. 37 shows an extension rod having a spinnable cuff or rotating sleeve (66) sheathing its articulating member (18). This bearing-like cuff (86) operably spins around the articulating member (18) when turned (16). Thus, when a bottle (2) is attached to the sleeve (86) and turned, both the sleeve (66) bottle (2) will rotate around the articulating member (18) (not shown). The sleeve (66) is removably attached to the articulating member (18) using a number interlocking extrusions and or corresponding grooves.

Figure 38:
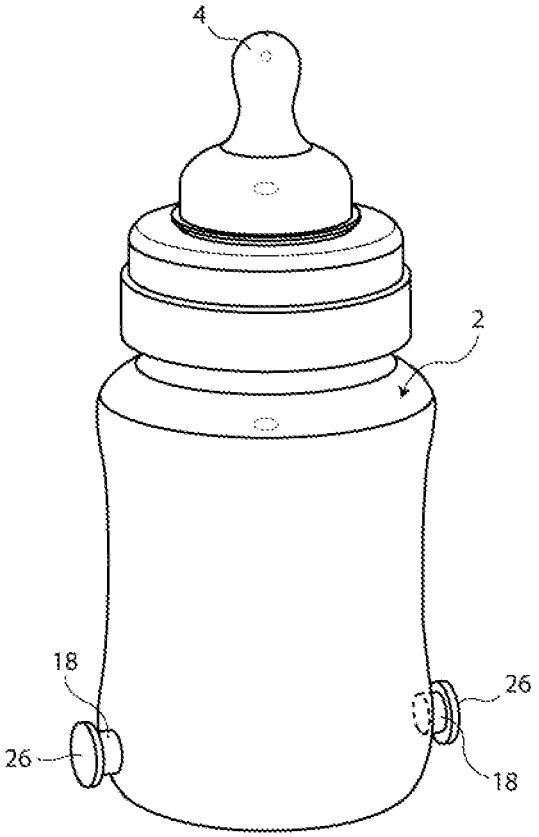
FIG. 38 (dimensional view) shows a bottle having bilateral articular extrusions emerging from its base area, wherein each member extrusion has a sidewall disc on its end.

FIG. 38 shows a bottle (2) having an articular surface comprising bilateral articular extrusions formed onto its lower base area. These axle-like extrusions collectively comprise an articulating member (18). Furthermore, they are sufficiently extruded and axially aligned to conjoin with an extension rod (12) having a corresponding socket member (6) (FIGS. 39 and 40A to 41B). Note, each articular extrusion has a cap, sidewall or disc (26) formed onto its end. These discs (26) are sized and bilaterally spaced to prevent an extension rod (12) from slipping off when conjoined to the articulating member (12). Additionally, they can have with elastomeric bodies (10) thereon to compressively communicate with an extension rod's (12) socket (6). Although the present embodiment depicts a bottle (2) having two bi-laterally formed articulating members (12), this is not limiting. Thus, a bottles (2) articular surface can comprise of one or more articular extrusions, axle rods or axle-like extrusions formed onto or into the bottle so that they can pivotably communicate with an extension rod (12).

Figure 39:
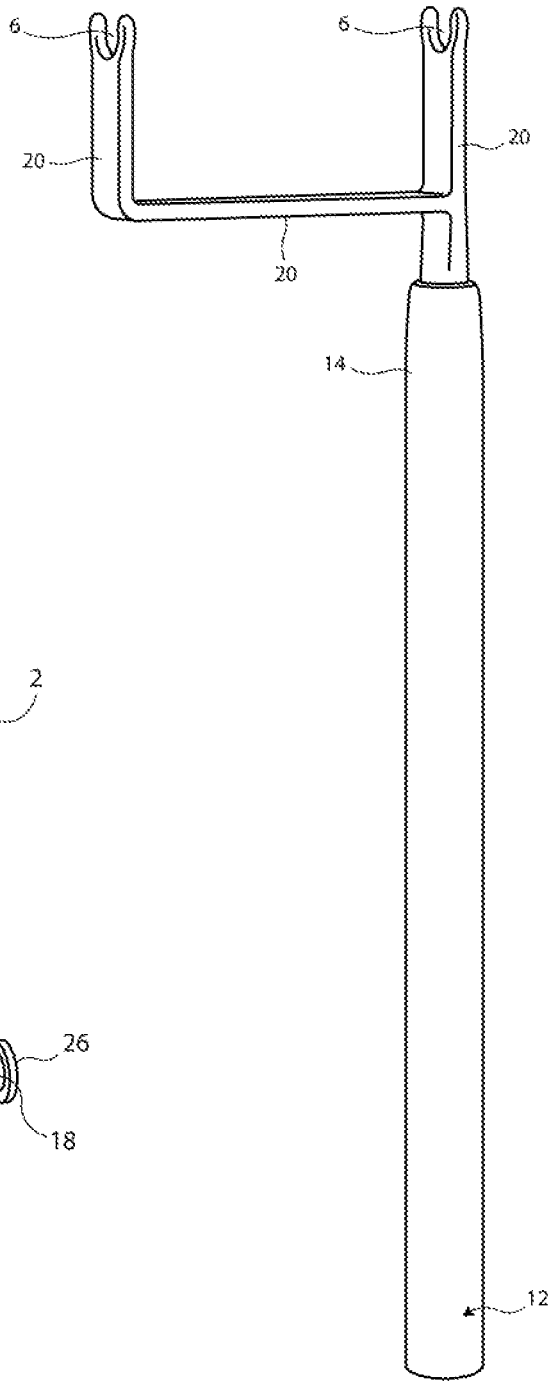
FIG. 39 (dimensional view) shows a generally "L" shaped extension rod having a handle with a bifurcated shaft emerging from thereof, wherein the bifurcated shaft's ends have socket openings formed therein.
Figure 40A:
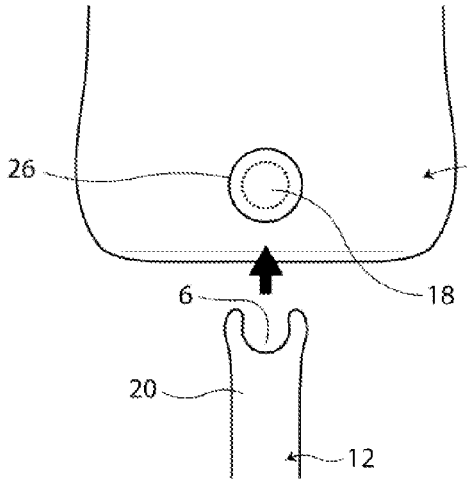
FIGS. 40A and 40B (progressive side view details) show an extension rod's socket member conjoining with a bottle's corresponding articulating member extrusions.
Figure 40B:
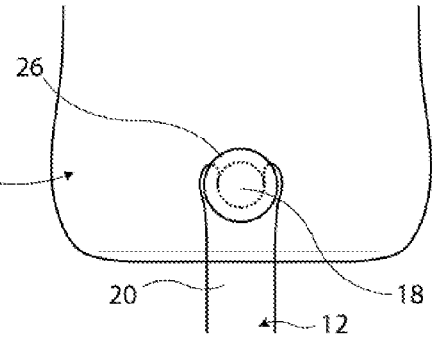
Figure 41A:
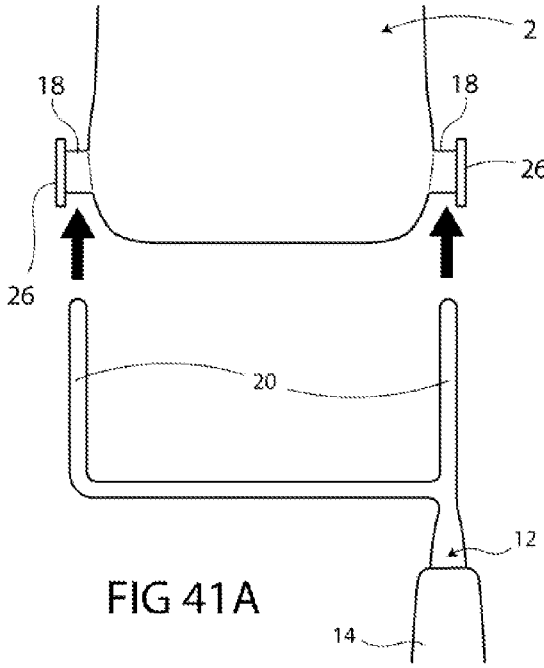
FIGS. 41A and 41B (progressive front view details) show an extension rod's bifurcated shaft sockets conjoining with a bottle's corresponding articulating member extrusions.
Figure 41B:
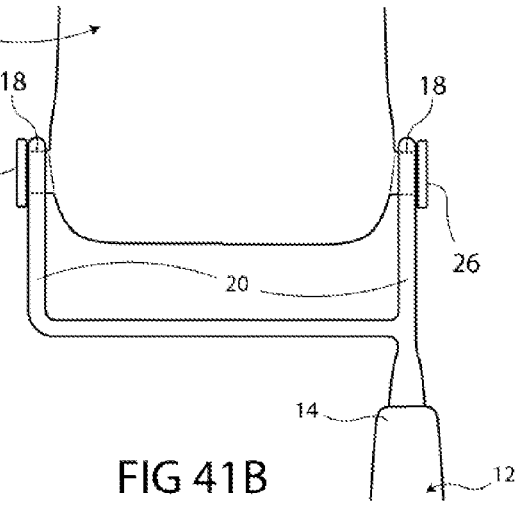

FIG. 39 shows a generally "L" shaped extension rod (12) having a handle (14) with bifurcated shaft (20) emerging from thereof, wherein the handle (14) is offset to one side of the bifurcated shaft (20), and each shaft (20) bifurcation has a substantially semicircular opening formed into its end. Collectively, the bifurcated shaft's (20) semicircular openings comprise a socket member (6) and are sized and bilaterally spaced to pivotably conjoin with a bottle (2) having a corresponding articular extrusions (FIGS. 39, 40A, 40B, 41A, 41B).

Figure 42A:
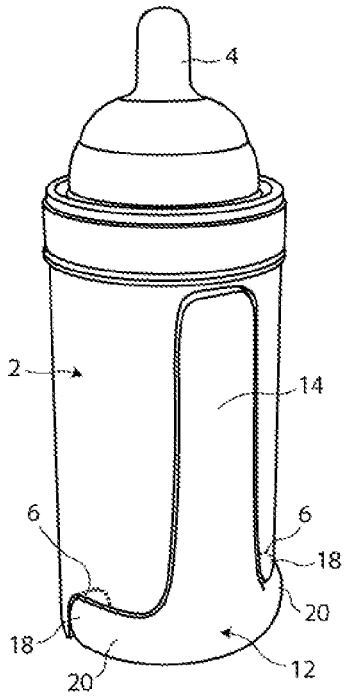
FIGS. 42A to 42C (progressive dimensional views) Show a bottle having a recess formed therein to hold integrated extension rod that is pivotably conjoined the bottle's base.
Figure 42B:
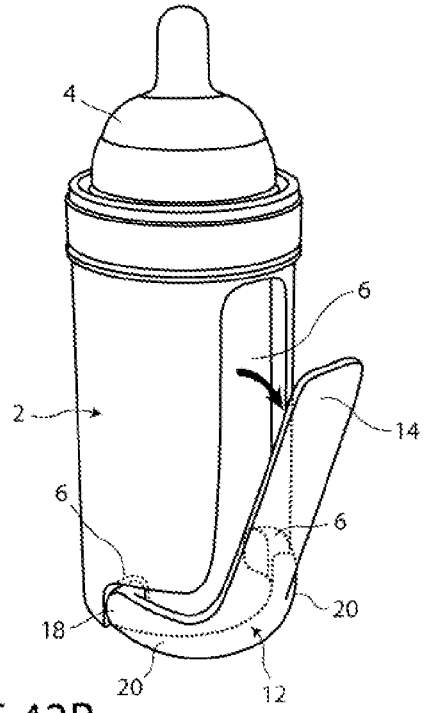
Figure 42C:
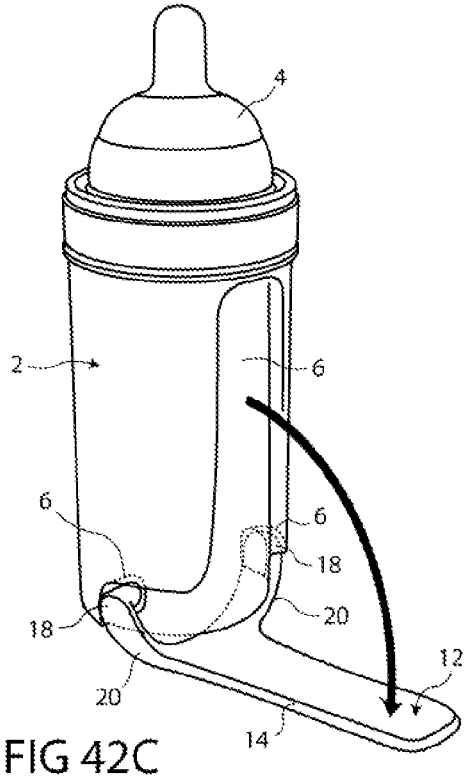
Figure 42D:
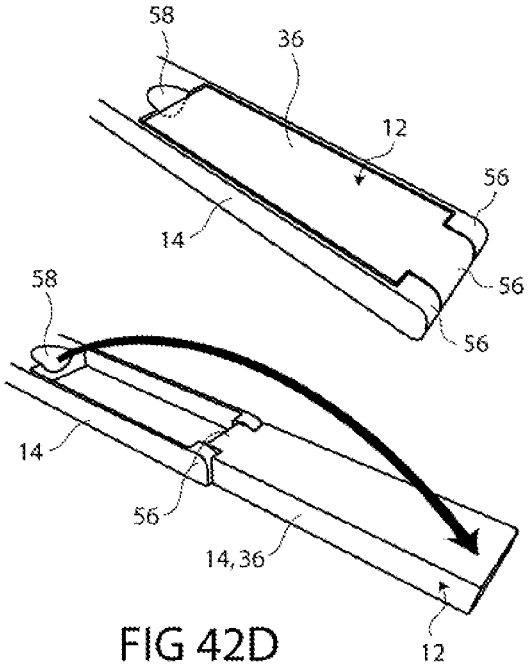
FIG. 42D (dimensional progressive detail views) show an extension rods handle having a pivotably conjoined extending member to increase the handles operating length.

FIGS. 42A to 42D show a bottle (2) having an integrated, but removable extension rod (12). Namely the bottle (2) has a recessed socket member (6) that is dimensionally and recessively correspondent with the integrated extension rod (12) (FIG. 42A). The extension rod (12) has a handle with a bifurcated shaft emerging from thereof, wherein the bifurcated shaft (20) partially wraps around the bottle's (2) base area so that its articulating members (18) can conjoin with the bottle's (2) bilateral socket member (6). Whereby, the extension rod can pivotably dock and undock within the bottles recessively corresponding socket (6) (FIGS. 42B and 42C).

Additionally, the extension rod (12) of this embodiment can have one or more lengthening appendages or extending members (36) to adjustably increase its length. More specifically, the rods (12) handle (14) and shaft (18) area can house, nest or sheath one or more extending members (36), wherein a member (36) can slidably extend, telescope, or pivotably retract from within the handle (14). For example an extending member (36) can slidably retract through the handle's (14) bottom to operably increase the extension rods (12) length. Alternatively, a nested extending member (36) conjoined to the handle's (14) bottom by a hinge (54) can pivotally retract to increase its length (FIG. 21D).

Furthermore, to facilitate extending member (36) retraction, depressions or notches (58) can be formed into an extending member (36) and or corresponding handle (14) area (FIG. 42 D). Note, notches are sufficiently recessed or extruded so that a user can easily grip and retract an extending member (36). Lastly, retaining mechanisms or other locking members may be used to retractably nest or conversely lockably extend the member (36) for operation.

FIGS. 43A-54E shows a number of bottles with holders thereon to removably conjoin with a variety of attaching articular members (60). An attaching articular member (60) comprises a removably attachable cup, plug, ring or sleeve having an attaching side to conjoin with a bottle (2) and an articular side to pivotably conjoin with an extension rod (12).

Note, an articular surface can comprise one or more socket members (6) to pivotably conjoin with an extension rod's (12) articulating member (18) or conversely, comprise one or more axle like articulating members (18) to pivotably conjoin with an extension rod (12) having a corresponding socket member (6)

Note, a bottle's holder and an attaching articular member's attaching side can comprise corresponding snapping extrusions, rings/rims, clips, threading, expanses of Velcro magnets or any other communicating means. Furthermore, a bottle holder can comprise the bottle itself wherein its inherent size and shape is sufficient to conjoin with and hold an attaching articular member thereon.

Figure 43A:
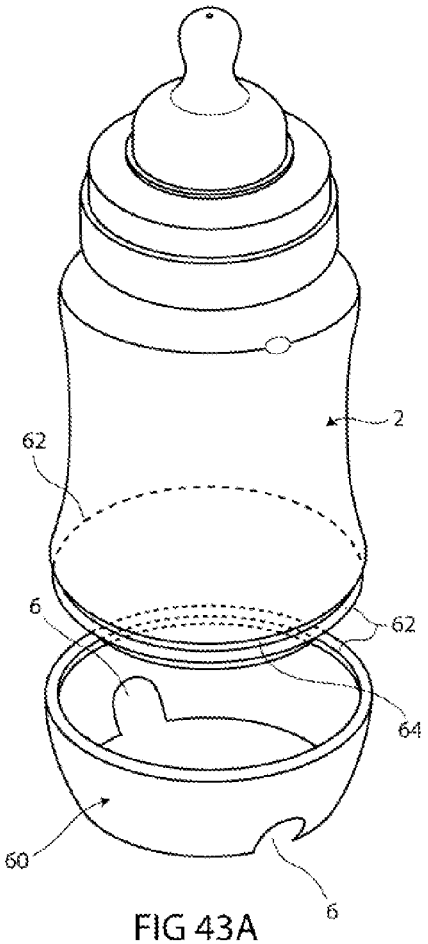
FIGS. 43A to 43C (dimensional view and progressive side view details) show a bottle and corresponding attaching articular member that attaches onto the bottle's base.
Figure 43B:
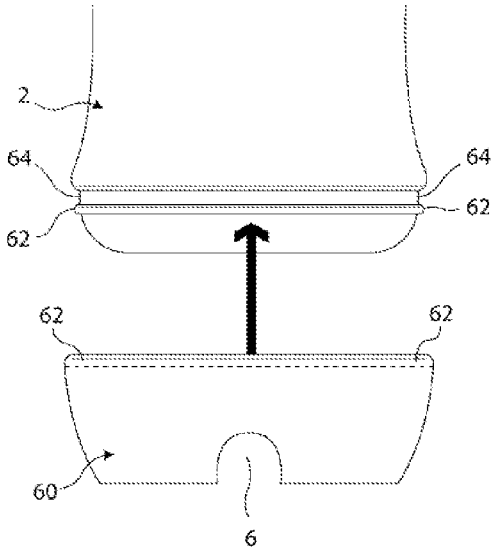
Figure 43D:
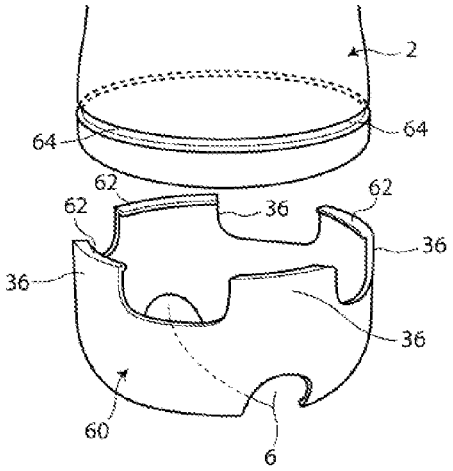
FIG. 43D shows an attaching articulating member with a number of superiorly extending members to attachably conjoin with a corresponding bottles groove.
Figure 43C:
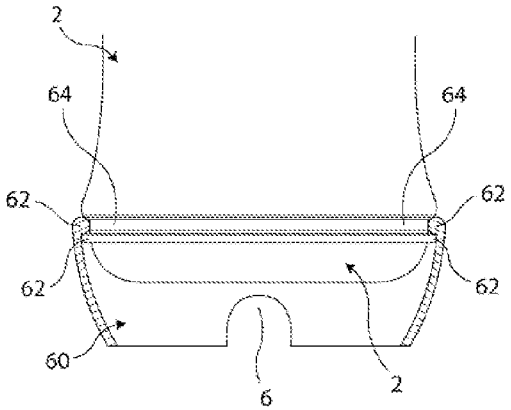

FIGS. 43A to 43C show traditional style bottle a bottle (2) and a corresponding attaching articular member (60) that comprises a removably attachable ring, wherein it has an open top or attaching side to conjoin with the bottle (2) and a bottom having a socket member (6) to pivotably conjoin with an extension rod (12).

The attaching articular members (60) open top has an extruded circumferential lip or rim (62) encircling its opening (FIG. 43A). This first rim (62) attachably corresponds with a second rim (62) formed onto the bottle's base area (2), wherein the second rim has superiorly adjacent groove (64). Accordingly, inserting the attaching articular members (60) open top over the bottles base so that its rim coincides with the bottle's (2) groove will conjoin them and the adjacent rim (62) will hold the attaching articular member (60) thereon (FIGS. 43B and 43C). Note, depending upon the degree of attaching interlocking friction, an attaching articular member (60) may or may not operably swivel around the bottles (2) base when turned. Note, rims (60) can be formed directly through injection molding or they may be independently adherent bodies. They may be formed from a base material (plastic or glass) or comprise an elastomer, metal, wood or any combination thereof. They may have any size, shape or thickness. They may also have corresponding extrusions and notches formed therein, wherein the extrusions and notches can attachably interlocking when conjoined.

FIG. 43D shows an attaching articular member (60) that has four superiorly extruded appendages, prongs or extending members (36) emerging from its top side (the bottle attaching side). Furthermore, each extending member (60) end has a medially protruding lip or rim (62). Accordingly, the height of the extending members (36) in conjunction with the protruding rim (62) attachably correlate with a groove (64) formed around a corresponding bottles (2) base area circumference. Note the extending members (36) are flexible, wherein they can flexibly widen when inserted over a bottles (2) wider bottom. Furthermore, when the extending members (36) enter the bottles groove (6) they reflexively return to their base position whereby anchoring the attaching articular member (60) onto the bottle (2). Note, the attaching friction can be sufficient to allow the attaching articular member (60) to swivel when turned. Alternatively, in lieu a groove, a bottle can have a series depressions, holes or sockets (6) that are positionally correspondent with the extending members (36) rims (62). Thus, when they are mutually aligned, they interlock and anchor the attaching articular member (60) onto the bottle (2) (not shown). In this case, the interlocking series will prohibit swiveling.

Lastly, an attaching articular member (60) may have any number of extending members (36) having any size or width, and its rims (62) can have any shape. Furthermore, a bottle can have any number of grooves (64) or sockets (6) thereon.

Figure 44A:
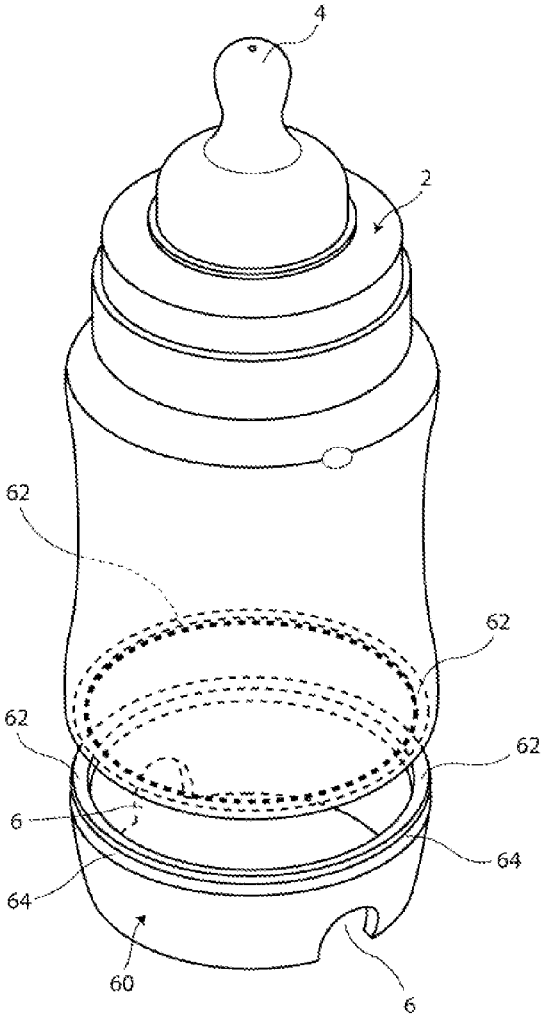
FIGS. 44A to 44C (dimensional view and progressive side view details) show a bottle and corresponding attaching articular member that attaches into the bottle's base.
Figure 44B:
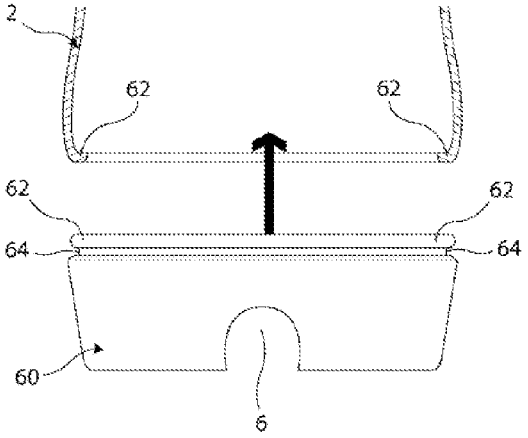
Figure 44C:
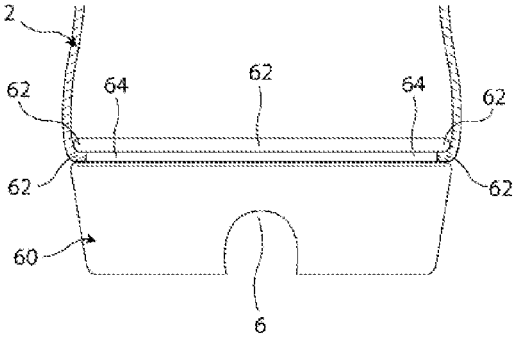

FIGS. 44A to 44C show a liner style bottle (2) and a corresponding attaching articular member (60) that comprises a removably attachable ring, wherein it has an open top to conjoin with the bottle (2) and an open bottom having a socket member (6) to pivotably conjoin with an extension rod (12). The attaching articular member's (60) open top has a circumferential lip or rim (62) with an adjacent inferior groove (64) encircling its outer opening (FIG. 44A). This first rim (62) and groove (64) attachably correspond with a second rim (62) formed into the bottle's open bottom (2).

Accordingly, inserting the attaching articular members (60) rim (62) and groove (64) into the bottles bottom so that its groove (62) coincides with the bottles (2) rim will conjoin them (FIGS. 44B and 44C).

Note, depending upon the degree of attaching interlocking friction, an attaching articular member (60) may or may not operably swivel around the bottle's (2) base when turned.

Figure 45A:
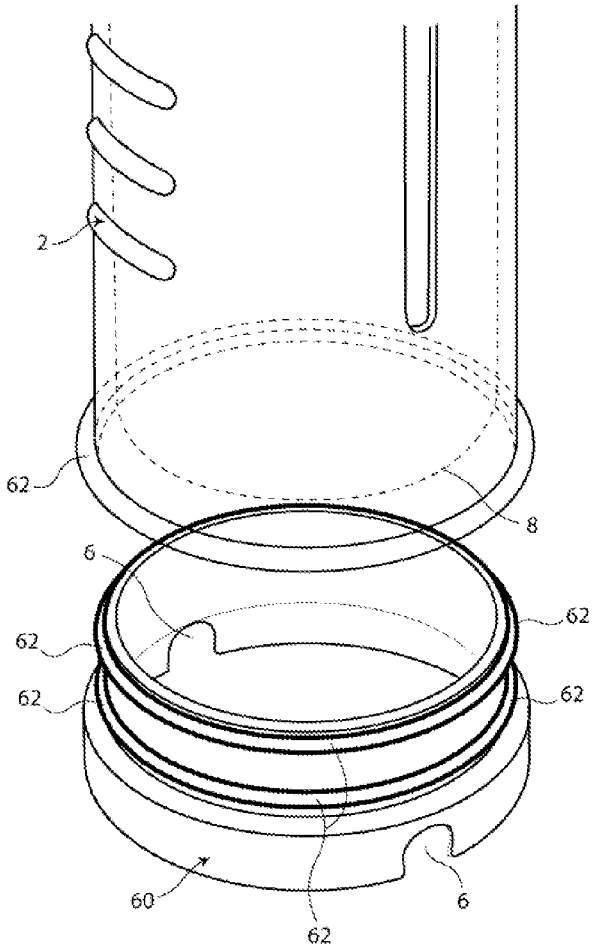
FIGS. 45A to 45C (dimensional view and progressive side view details) show a bottle and corresponding attaching articular member that plugs into a liner style bottle's base interior.
Figure 45B:
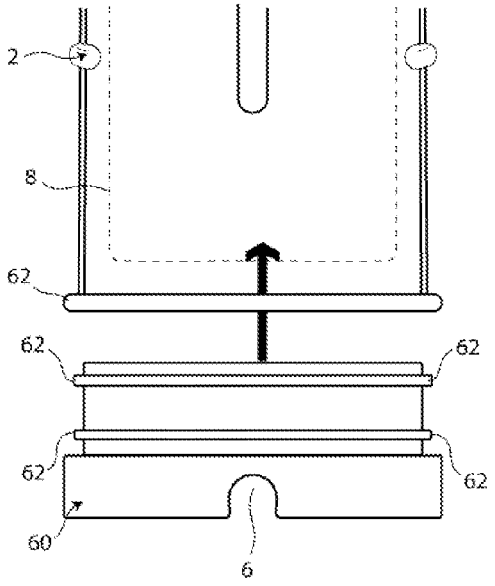
Figure 45C:
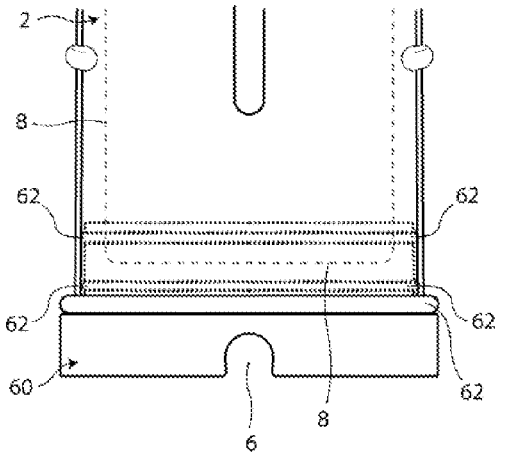

FIGS. 45A to 45C show a bottle (2) and its corresponding attaching articular member (60). The member (60) comprises a removably attachable plug that frictionally inserts into a liner style bottle's interior. It has an open top to circumferentially accommodate a bottle's liner (8) therein and a bottom having a socket member (6) thereon (FIG. 45A). Furthermore, it has a narrower upper area having a number of externally formed circumferential O-rings or rims (62) to frictionally communicate with a bottle's (2) interior circumference (FIGS. 45B and 45C).

Its wider lower area has an extruded, platform-like base that is desirably wider than its upper area, wherein it serves as an insertion stop that determines how far an attaching articular member (60) can be inserted into the bottle (2) (FIG. 45C). Note, the rims (62) may have a number of grooves, notches, openings or extrusions formed therein or thereon to interlock with the bottle's interior having corresponding grooves, notches, openings or extrusions. Lastly, the attaching articular members (60) wider, platform like base can have a clipping means or attaching member to attach to the bottles (2) base rim (60) whole conjoined.

Figure 46A:
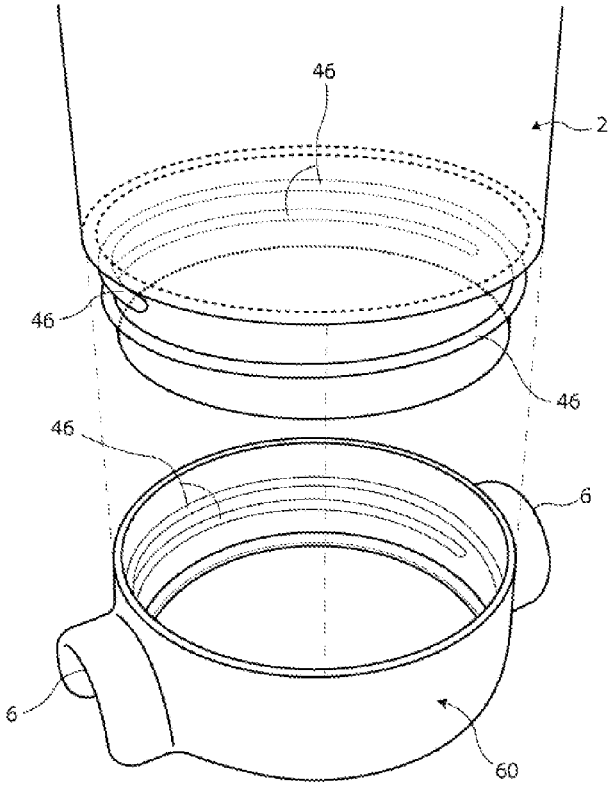
FIGS. 46A to 46C (dimensional detail and progressive detail views) show a bottle having a swiveling attaching articular member that screws onto the bottle's base and spins when turned.
Figure 46B:
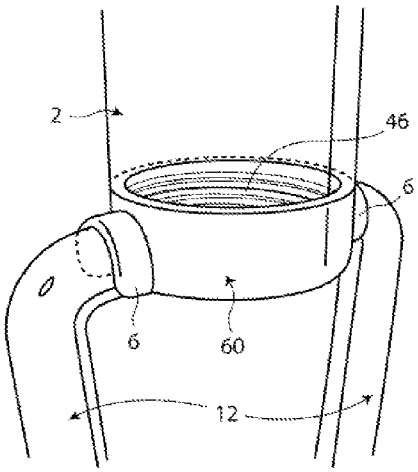
Figure 46C:
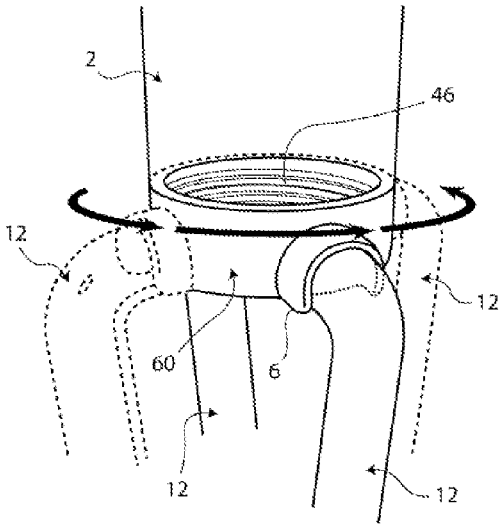

FIGS. 46A to 46C show attaching articular member (60) comprising a threaded (46) ring having an open top removably screw onto a bottle's (2) threaded (46) base and a bottom having a socket member (6) to conjoin with an extension rod (12) (FIGS. 46A and 46B), wherein when fully screwed onto the bottle (2), the attaching articular member (60) can freely rotate around its base without unscrewing (FIG. 46C).

Accordingly, when first conjoined to the attaching articular member (60) and extension rod (12), a bottle (2) can operably rotate 360 degrees when turned. Notably, this embodiment is similar to safety caps found on conventional medicine (and other) bottles. Once fully threaded, the lids cannot be unscrewed without the application of sufficient downward force or other appropriate force. Similarly, removing this embodiment's attaching articular member (60) can be accomplished using adequate downward force (or other appropriate force) while simultaneously unscrewing. Note, other embodiments can have attaching sockets (60) that conventionally screw together, wherein they will not rotate or swivel when fully screwed on.

Figure 47A:
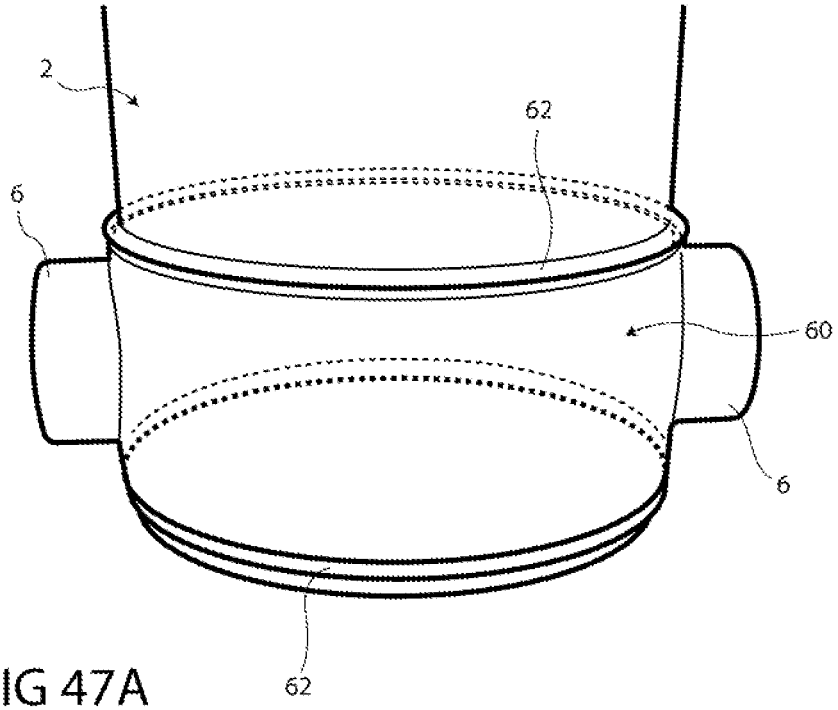
FIGS. 47A and 47B (detail dimensional views) show a swiveling attaching articular member that snaps onto a bottle's base area and spins when turned.
Figure 47B:
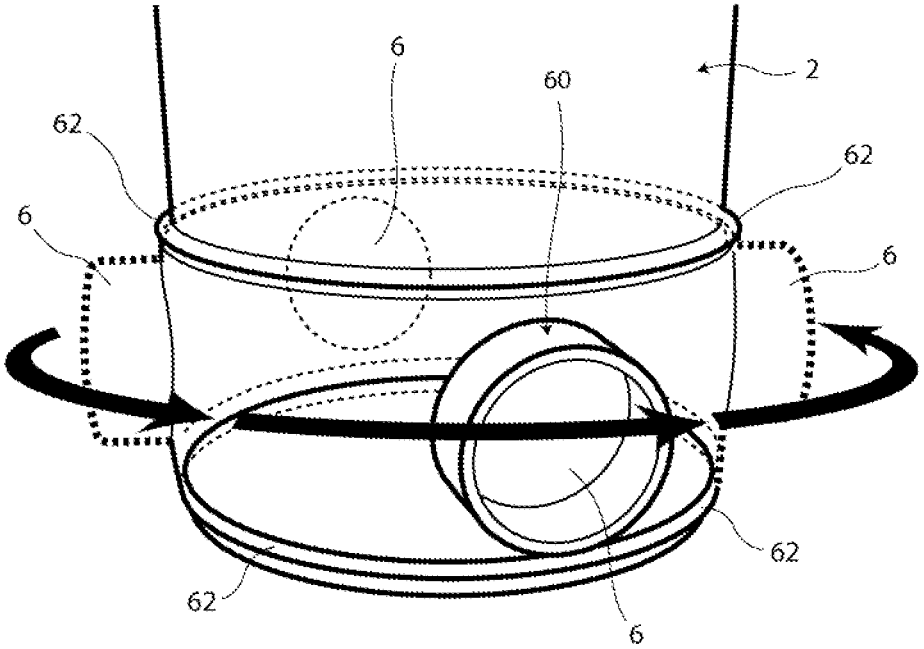

FIGS. 47A and 47B show a bottle (2) and corresponding attaching articular member (60) comprising a removably attachable ring having one or more sockets to pivotably conjoin with an extension rod (12) (FIG. 47A), wherein the ring can rotatably swivel around the bottle (2) when attached. This rotatable socket or swiveling articular member (60) is a cylindrical, tubelike ring that is diametrically larger that the bottle (2) so that it can rotate around a bottle (2) when attached (FIG. 47B). In this embodiment, the attaching articular member (60) is removably held onto the bottle (2) by superior and inferior circumferential extrusions or rims (62). Each rim (62) is sufficiently extruded to operably retain the articular member (62) in-between. To conjoin the attaching member (60) and bottle (2), an operator can insert the articular member (60) over the bottles (2) bottom so that it is sandwiched in-between the rims (62) (not shown) Note, the bottles rims (60) may be integrally formed thereon through injection molding or alternatively, they may comprise any number of adherent bodies.

Furthermore, additional embodiments can incorporate any number of rims, grooves, extrusions or other attaching mechanisms onto the swivel's (60) interior or exterior circumference and or the bottle (2). Note, that this attaching articular member (60) is universally compatible with vent (22) systems since its socket can be variably positioned the bottle (2). Namely, it can rotatably change position to accommodate a vent (52).

Figure 48A:
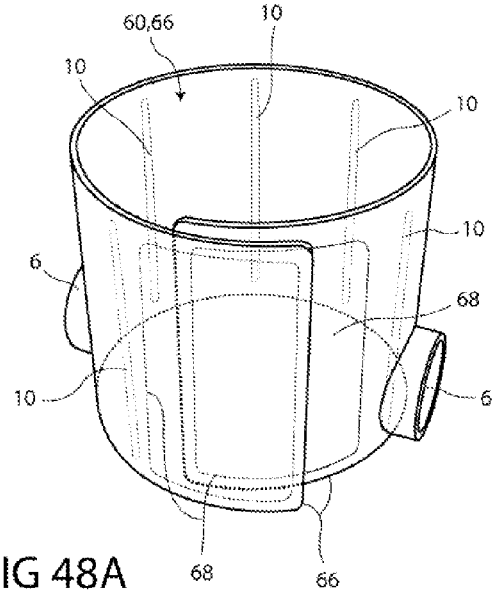
FIGS. 48A to 48C (dimensional and detail dimension views) show an attaching articular member comprising a wrapping sleeve having a socket member to conjoin with an extension rod and attaching Velcro to wrap around a bottle.
Figure 48B:
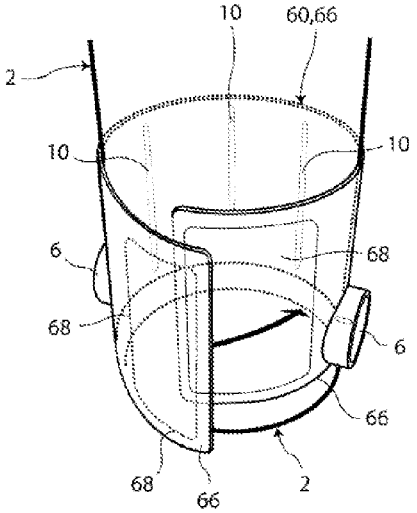
Figure 48C:
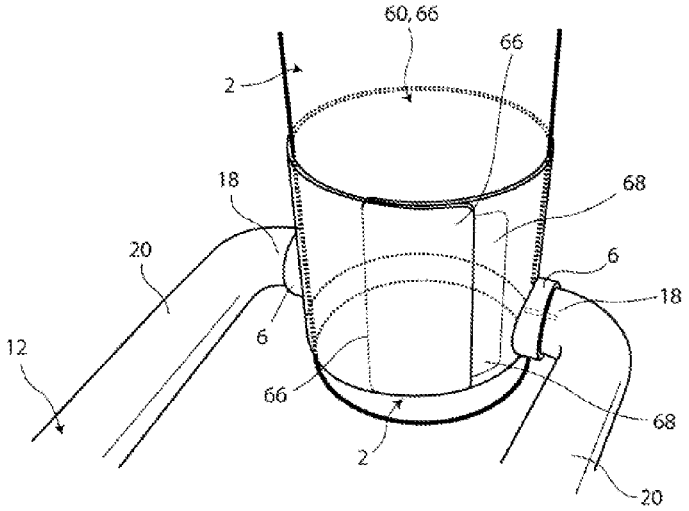

FIGS. 48A to 48C show an attaching articular member (60) comprising a generally cylindrical cuff or sleeve (66), wherein the sleeve (66) has disconnected and overlapping ends to attachably wrap around a bottle (2) (FIG. 48A). Moreover, the sleeve (66) has a socket member (6) formed thereon to pivotally conjoin with an extension rod's (12) articulating member (18). The sleeve's (66) ends have an attaching means thereon to conjoin them around a bottle's (2) circumference when the sleeve is first wrapped around the bottle (2) so that the attaching means correspond (FIG. 48B). Note, in lieu of Velcro, additional embodiments may utilize, adhesives, snaps, magnets, clips straps, latches, or ratchets. The sleeve (66) may be made from a layer of material that is bent, extruded, molded or rolled into shape. It may be made from plastic, elastomer, metal or any other suitable material. In the present embodiment, the sleeve's (66) interior has a number of rubberized strips, ridges or elastomeric bodies (10) thereon. They are interspersed around the sleeves (66) interior circumference, so that when the sleeve is wrapped around a bottle (2), the bodies (10) frictionally can communicate with the bottles (2) outer circumference. The resultant friction desirably prevents independent bottle (2) rotation during operation. Note, additional embodiments may utilize an single or uninterrupted elastomeric body (10) layer or coating (in lieu of a plurality of elastomeric body extrusions).

Such layers may be smooth or texturally embossed. Although the present embodiment depicts a generally cylindrical shaped sleeve (66), it need not be limited to this shape. For example, sleeves (66) can be contoured in any manner. For example, they can be hour glass shaped, asymmetrically shaped, geometrically shaped, or have any combination thereof. Most importantly, they can be shaped to compatibly conjoin with any presently available bottle (2) and all future bottle (2) designs/brands.

Figure 49A:
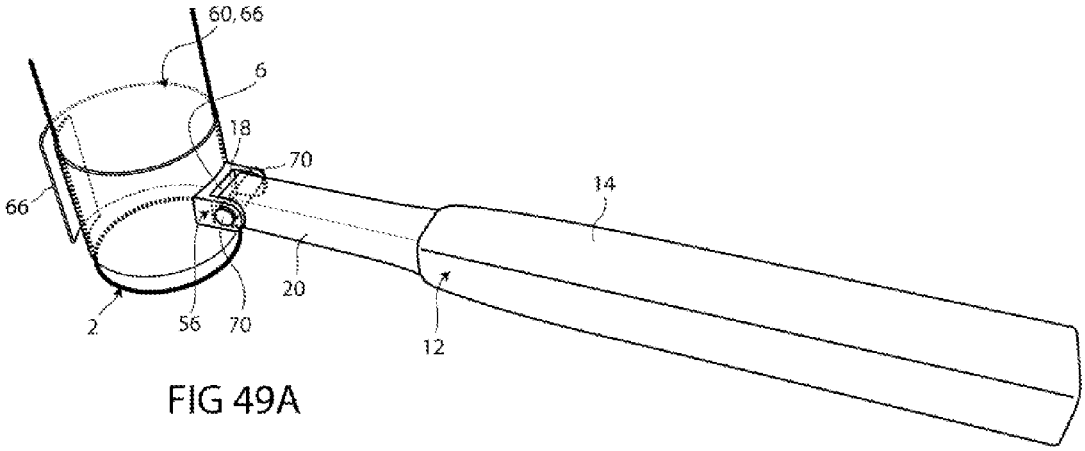
FIGS. 49A and 49B (dimensional and detail dimension views) show an attaching articular sleeve, to attachably wrap around a bottle having an extension rod pivotably conjoined thereon by a hinge.
Figure 49B:
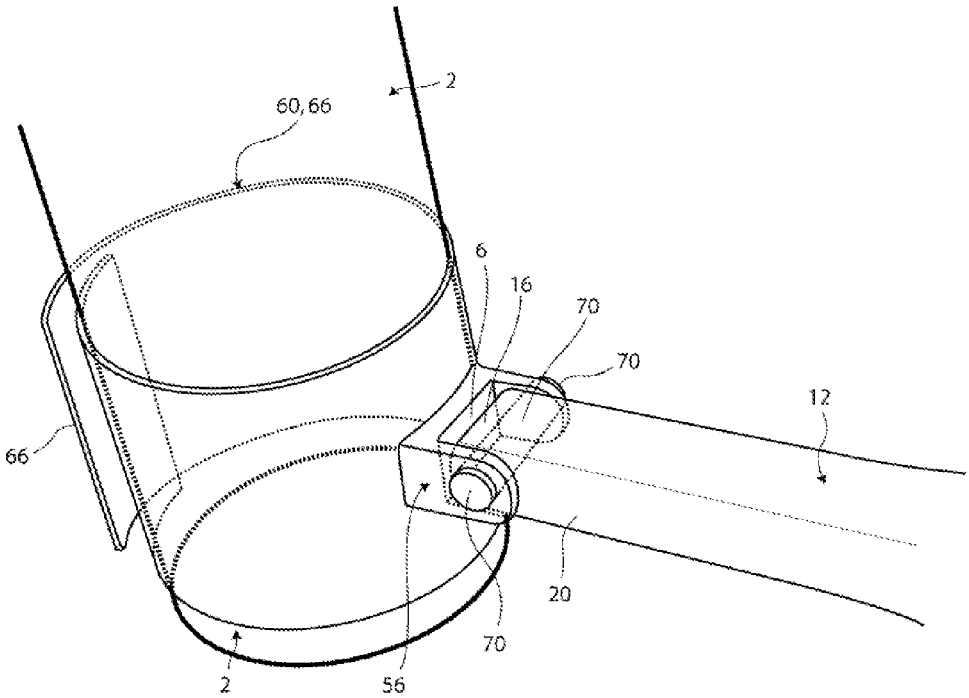

FIGS. 49A and 49B show a sleeve (66) and a corresponding extension rod (12) that are conjoined by a hinge (56). Specifically, the sleeve (66) has a first hinge portion and the extension rod (12) has a second hinge (56) portion, wherein a pin or axle (70) pivotably conjoins the portions together (FIG. 49B).

Figure 50A:
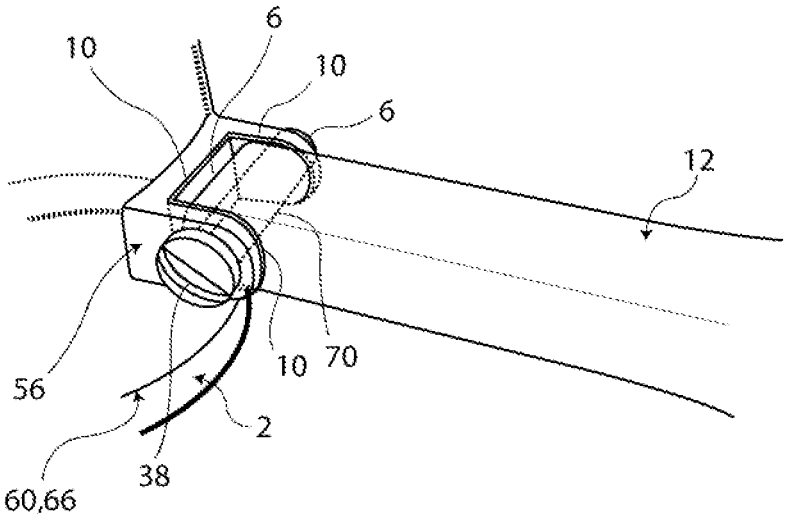
FIGS. 50A and 50B (detail dimensional views) show an attaching sleeve's hinged juncture with an extension rod, wherein the hinges both have a tightening member and elastomeric body thereon, one of which is smooth and another of which has a number of elastomeric extrusions.
Figure 50B:
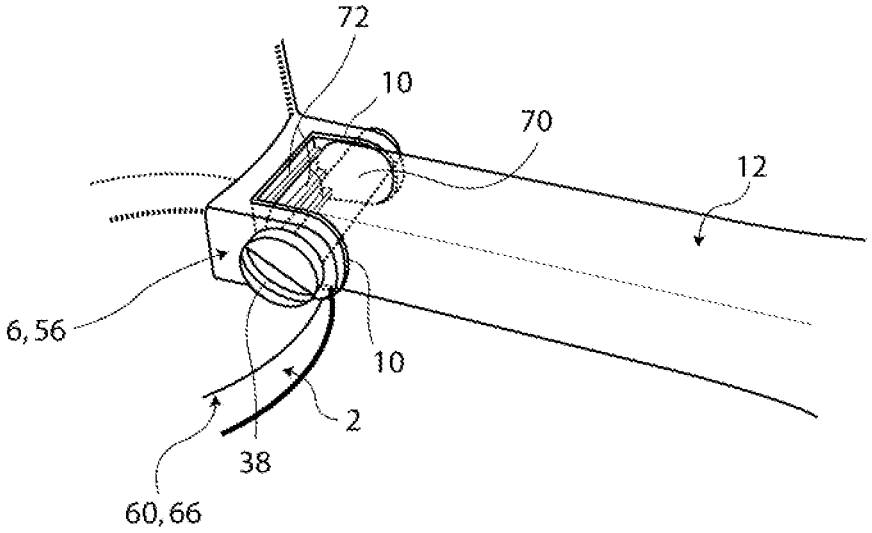

FIGS. 50A and 50B show a sleeve (66) and a corresponding extension rod (12) that are conjoined together by a hinge (56). Specifically, the sleeve (66) has a first hinge portion and the extension rod (12) has a second hinge portion, wherein a pin or axle (70) pivotably conjoins the hinge portions together (FIG. 50B). Furthermore, the hinge has an elastomeric body (10) lining the socket area, one of which is smooth (FIG. 50A), the other of which has a number of elastomer extrusions (72) (FIG. 50B). Moreover, the hinge has a tightening member (38) thereon to pivotably constrict the hinge portions. In this embodiment, the tightening member (38) is a tightening dial that is attached to the hinge's (56) axle rod area (70).

Figure 51A:
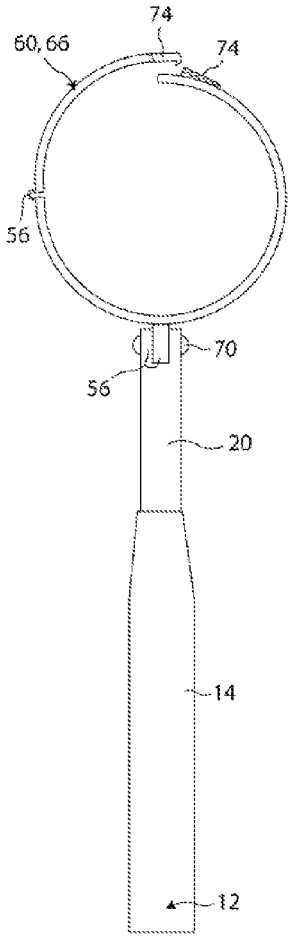
FIG. 51A (plan view) shows attaching articular sleeve with an attaching ratchet thereon and a corresponding extension rod conjoined by a hinge.

FIG. 51A shows a semi helical sleeve (66) having a hinge (56) to pivotably close its disconnected ends. The ends have corresponding ratchet (74) parts, wherein they can adjustably close the sleeve (66) around a bottle (2). Furthermore, the sleeve (56) has an extension rod (10) pivotably conjoined by a hinge (56).

Figure 51B:
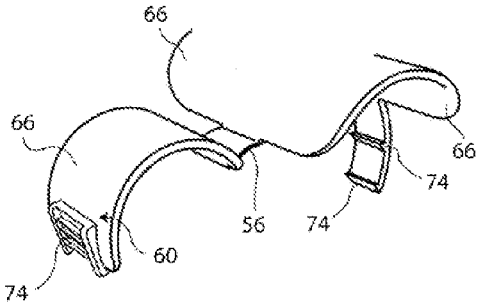
FIG. 51B (dimensional view) shows an open sleeve, its hinge and its ratchet parts.

FIG. 51B shows a fully opened sleeve (66), its hinge (56) and it's ratchet parts (74) in a dimensional view.

Figure 52A:
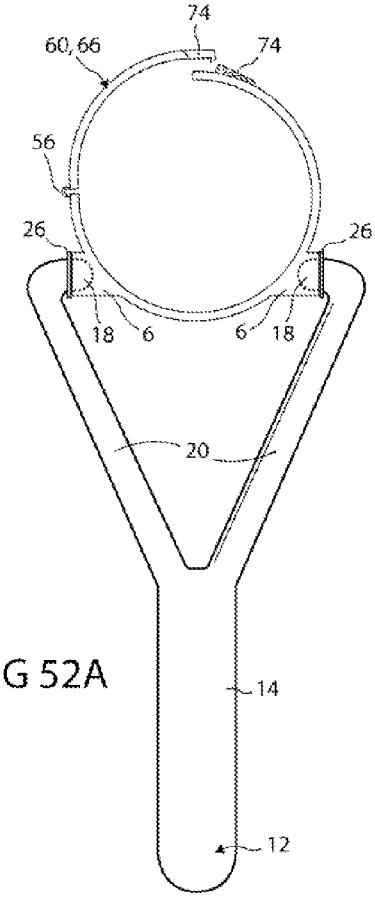
FIG. 52A (plan view) shows attaching articular sleeve having an attaching ratchet and socket member thereon, wherein the sleeve's socket pivotably conjoins with a corresponding extension rod.

FIG. 52A shows a hinged cylindrical sleeve (66) to wrap around a bottle having an adjusting ratchet (74) formed on two disconnected ends. Furthermore, this embodiment has socket member (6) to pivotably conjoin with an extension rod (12). Thus, a user can increase or decrease a sleeve's (66) circumference by adjusting the ratchet (74), wherein it can fit around various bottle (2) sizes.

Figure 52B:
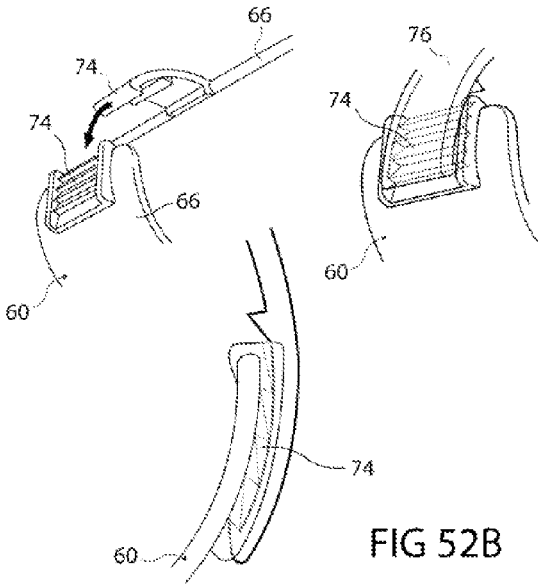
FIG. 52B (progressive detail views) Shows progressive views of a sleeves ratchet parts attachably interlocking.

FIG. 52B shows progressive views of a sleeve's (66) ratchet parts (74) attachably interlocking.

Figure 53A:
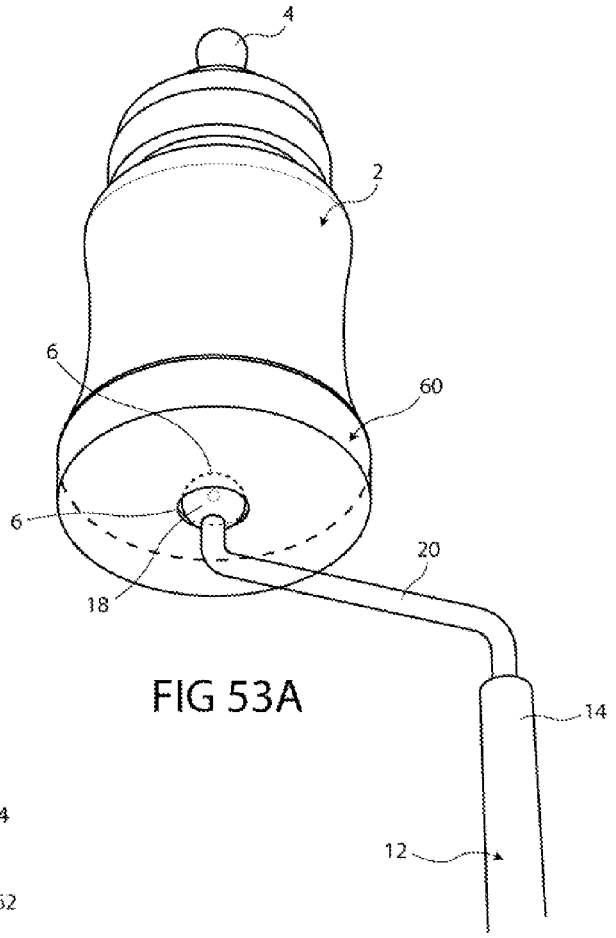
FIG. 53A (dimensional detail view) shows a bottle and an attaching articular member having a generally spherical socket member therein and furthermore, an extension rod having a generally spherical articulating member, wherein when conjoined they collectively form a ball and socket joint.
Figure 53B:
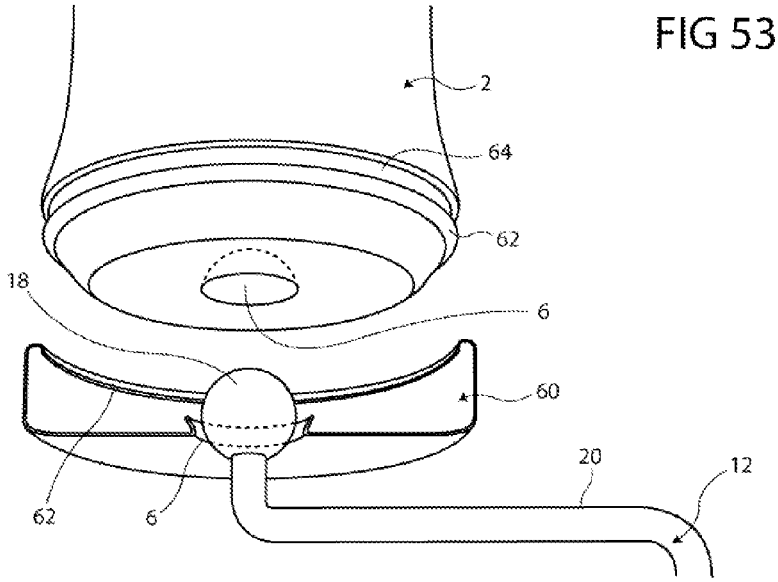
FIG. 53B (dimensional exploded and partial cross section view) shows a dis-conjoined bottle, attaching articular member cross section and an extension rod, which collectively conjoin to form a ball and socket joint.

FIGS. 53A and 53B Show an embodiment that can pivot along a plurality of axes comprising a bottle (2), attaching articular member (60), and corresponding extension rod (12) that attachably conjoin to form a ball and socket joint. Note, the bottle (2) and attaching articular member (60) have corresponding socket portions, wherein when conjoined, form a substantially spherical socket member (6) (FIG. 53B). This generally spherical socket member (6) pivotably holds the extension rods spherical articulating member (18) when is placed therein (FIG. 53A). Note, the extension rod (12) of this embodiment has an operably offset "L" shape, but this is not limiting. The rod (12) may be straight, angled or curved. Furthermore, all parts (articulating member, attaching socket member, bottle and socket member) can selectively have elastomeric bodies (10) thereon. Lastly, a spherical socket member (6) need not have separately formed socket portions. Therefore, a spherical socket member (6) can be entirely formed onto or into the attaching articular member (60), or conversely formed entirely onto or into the bottle (2)

Figure 54A:
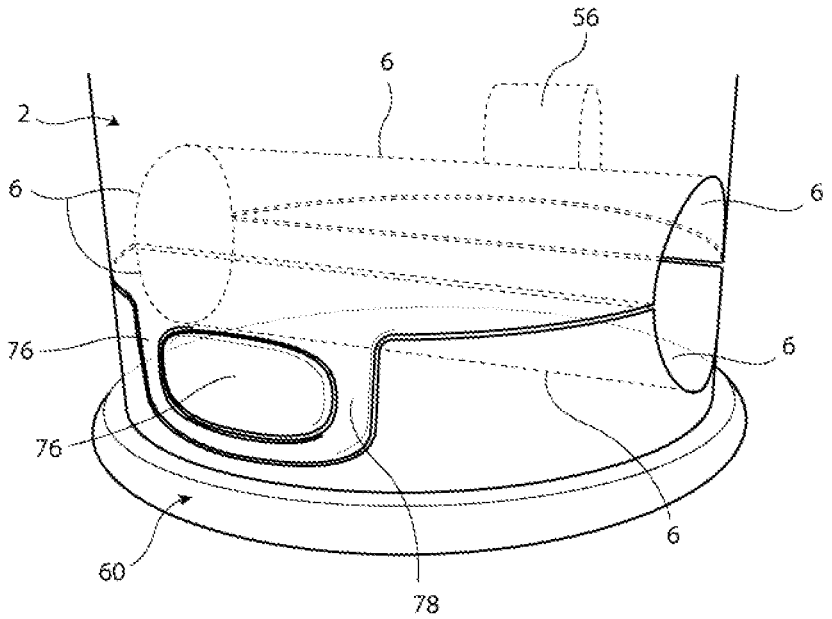
FIGS. 54A and 54B (dimensional front and dimensional back detail views) show a bottle having a attaching articular member comprising a pivoting platform attached to its base by a latching member on its front side and a by hinge on its back side.
Figure 54B:
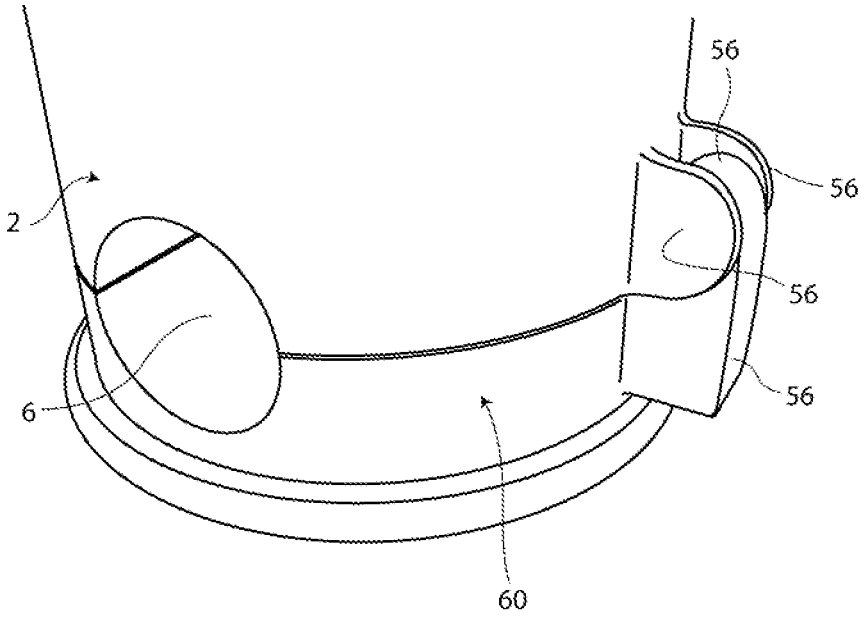
Figure 54C:
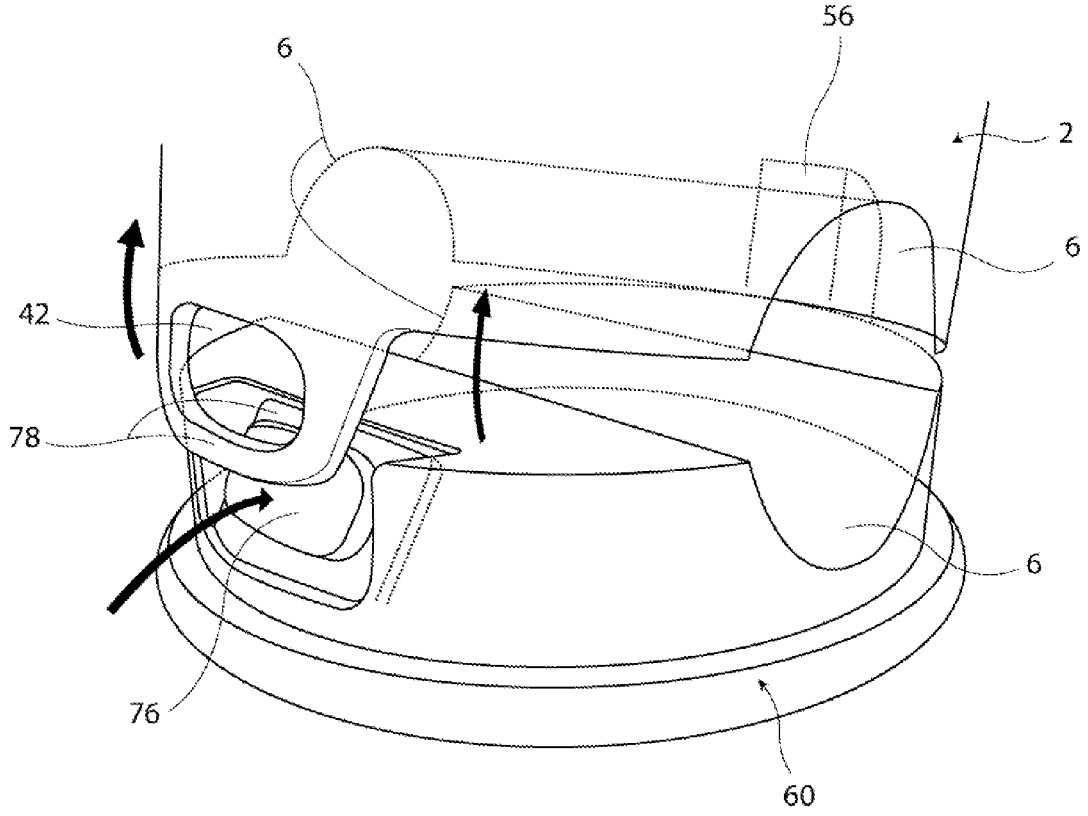
FIG. 54C (dimensional detail view) shows the bottle's latching member depressed and its base pivotably opening.
Figure 54D:
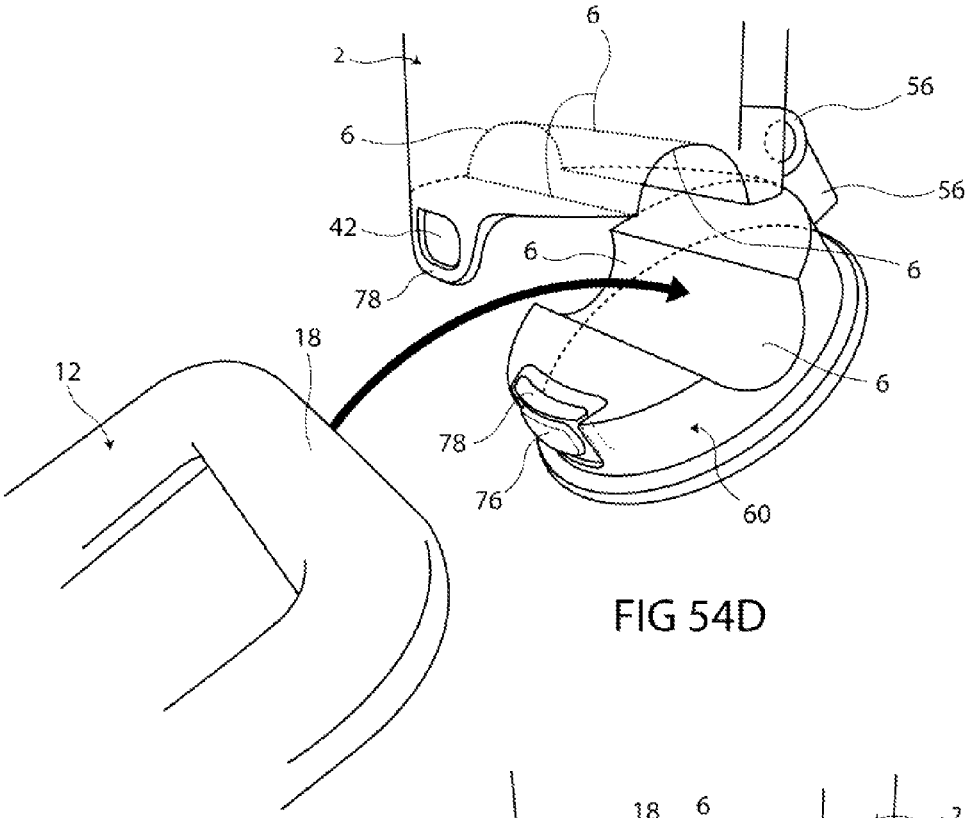
FIGS. 54D and 54E (progressive dimensional detail views) show an extension rod's insertion into a bottle's open base and its subsequent conjoining with the bottle after the base is pivotably closed.
Figure 54E:
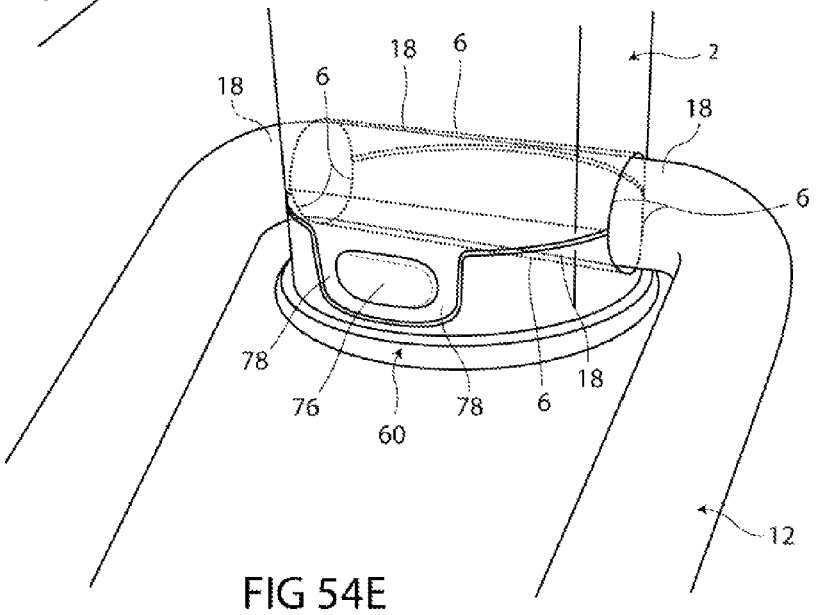

FIGS. 54A to 54D Show various views of a bottle (2) having an attaching articular member (60) comprising a pivoting base that is conjoined to one side by a hinge (46) (FIG. 54A) and releasably conjoined to another side by an engaging means or latching member (78) (FIG. 54B). Both the bottle (2) and hinged base (60) have corresponding socket halves formed therein. An upper half is formed onto the bottle's bottom while a lower half is formed onto the hinged base's (78) top so that when they are together, they form a socket member (6). Operably, disjoining the latching member (78) and pivotally rotating the hinged base (60) to an open position divides the socket member (6) halves so that a user can place an extension rod's (12) articulating member (18) in-between (FIGS. 54C and 54D) Subsequently, an operator can re-latch the base (60) to retain a rod's (12) articulating member (18) within the socket halves (FIG. 54E). The latching member (80) is an interlocking mechanism comprising corresponding male and female parts. The male part is a depressible lever formed into the hinged base (60). Its top and sides are disconnected by a surrounding gap or channel while its bottom is flexibly connected to the surrounding base (60). This flexible connection is a pivotal juncture that enables the lever to be operably depressed. Emerging from the levers center area is a button like eminence or male extrusion (76). This raised male extrusion (76) inter-lockably communicates with a female counterpart. Conversely, the female portion is characterized by a tab-like extension having an aperture (42) therein that extends downward from the bottles (2) bottom so that it corresponds with the male's extrusion. The female aperture (42) is dimensionally correspondent with the male extrusion (82) so that they interlock when communicating. Note, operably applying pressure to the male extrusion (80) will depresses the surrounding lever area and disengage it from the female's aperture (42) so that the hinged base (60) can open (FIG. 54C).

Figure 55A:
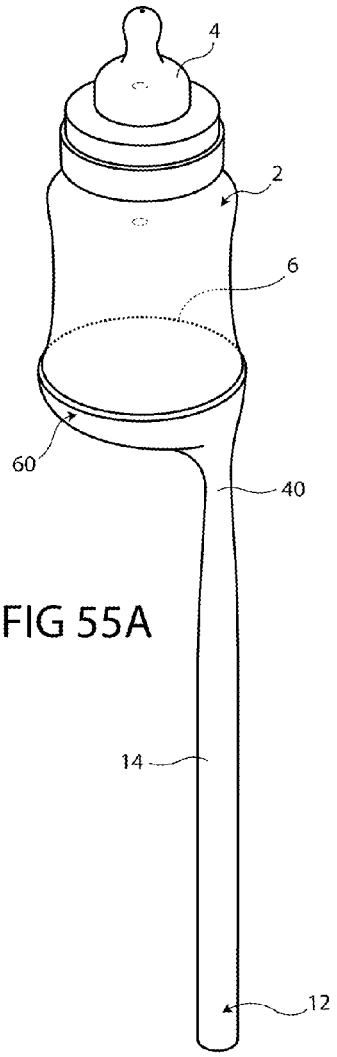
FIGS. 55A and 55B (progressive dimensional views) show a bottle attached to an integrated or combined extension rod/attaching articular member, wherein the rod's handle end and attaching socket end are flexibly conjoined in between by a flexible member.
Figure 55B:
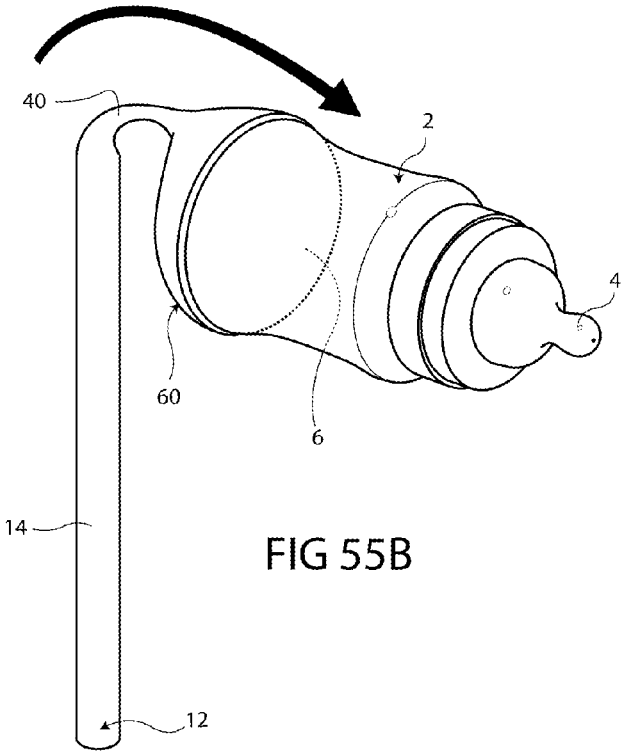
Figure 55C:
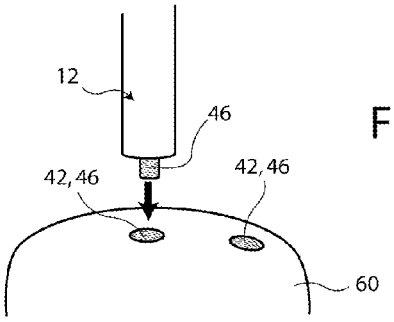
FIG. 55C (dimensional detail view) shows an attaching articular member's bottom having two variably positioned, threaded apertures to screw with an extension rods threaded end.
Figure 55D:
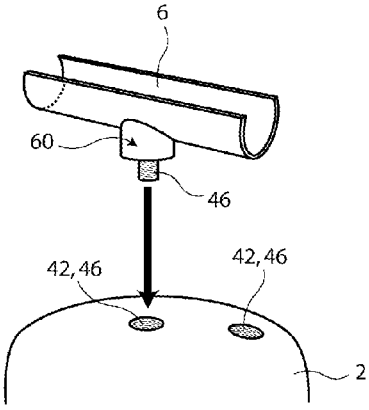
FIG. 55D (dimensional detail view) shows a bottle's bottom having two variably positioned, threaded apertures to screw with an attaching articular member's threaded end.
Figure 56:
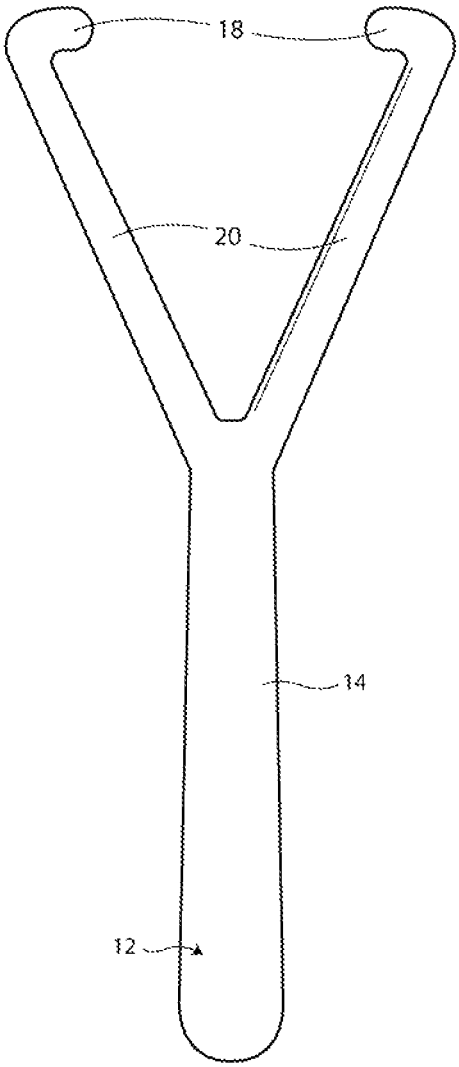
FIG. 56 (plan view) shows an extension rod having a handle with bifurcated shaft emerging from thereof, wherein the bifurcated shaft ends have articulating members formed thereon.

FIGS. 55A and 55B show an attaching socket member (60) comprising a socket member (6) with an integrated extension rod (12). The integrated socket (6) and extension rod (12) are connected in-between by a bendable expanse or flexible member (40). The flexible member (40) in this embodiment comprises a flexible shaft (20) portion that is connectively in between the socket member's (6) bottom and the handle's (14) top. Thus, when conjoined with a bottle (2), a caretaker can operably position the bottle (2) in a plurality of directions by desirably bending the flexible member (40).

FIGS. 57 to 68 show a number of extension rod and socket member variations having bilaterally disconnected articulating members with compatible socket members.

Figure 57:
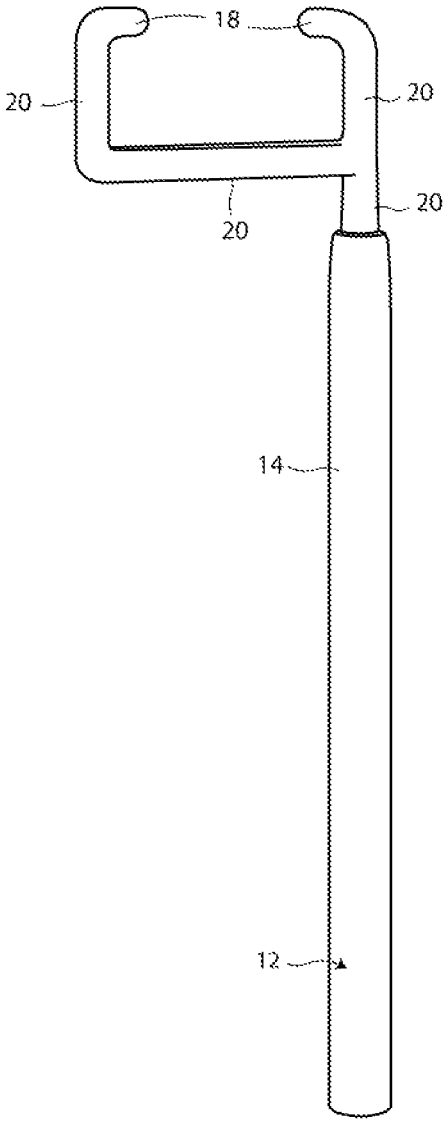
FIG. 57 (dimensional view) shows a generally "L" shaped extension rod having a handle to one side of a bifurcated shaft emerging from thereof, wherein the bifurcated shaft has articulating members formed on its ends.

FIG. 57 shows an extension rod (12) having a handle (14) with a bifurcated shaft (20) emerging from thereof wherein each bifurcated shaft (20) portion has an articulating member (18) at its end. Furthermore, the disconnected articulating members (18) are bilaterally spaced to pivotably communicate with a bottles (2) corresponding socket member (6) (FIGS. 58A, 58B, 59A 59B).

Figure 58A:
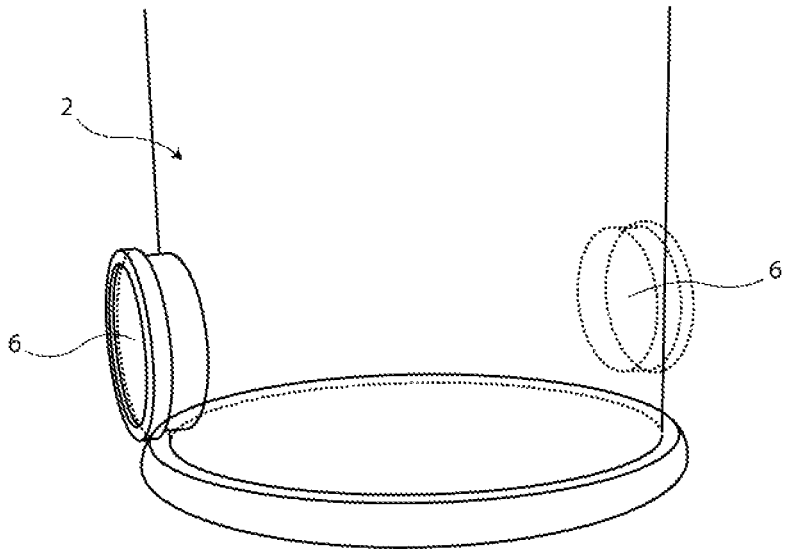
FIG. 58A (dimensional detail view) depicts a bottle having a bilaterally extruded socket member formed onto its sides.
Figure 58B:
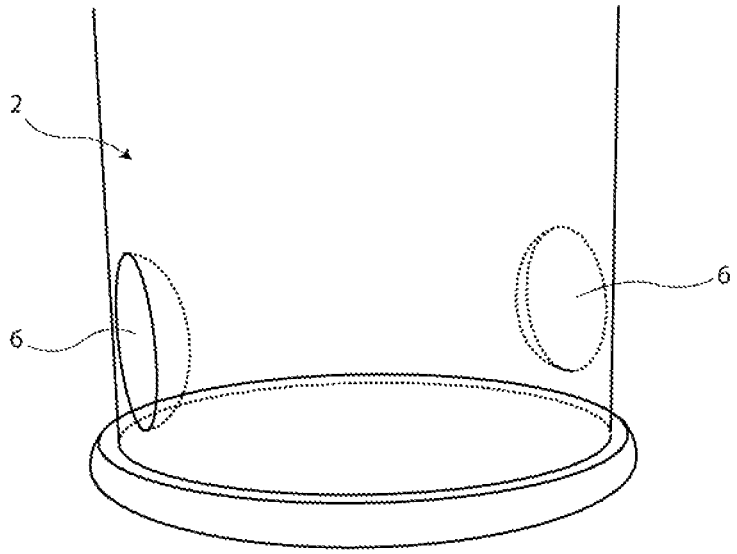
FIG. 58B (dimensional detail view) depicts a bottle having a bilaterally intruded socket member formed into its sides.

FIG. 58 shows a generally "L" shaped extension rod (12) having a handle (14) with bifurcated shaft (20) emerging from thereof, wherein the handle (14) is offset to one side of the bifurcated shaft (20), and each shaft (20) bifurcation has an articulating member (18) on its end. The articulating members (18) are bilaterally spaced to communicate with a corresponding bottles (2) socket member (6) (FIGS. 58A, 58B, 59A 59B).

Figure 59A:
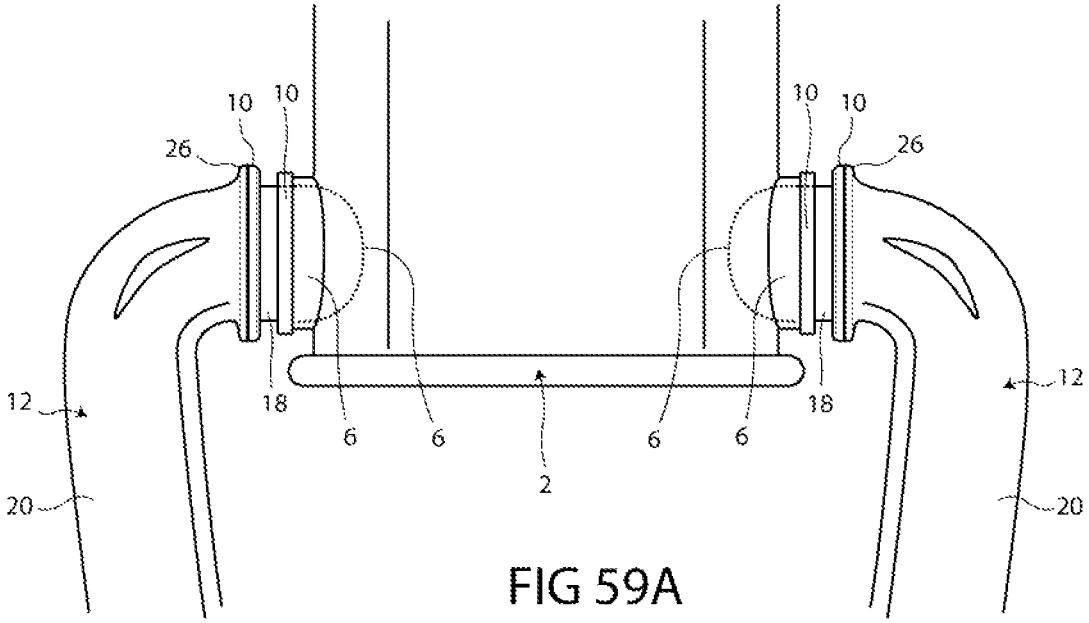
FIG. 59A (side view) shows an extension rod's bifurcated shaft/articulating member passively conjoined with a bottles corresponding socket.
Figure 59B:
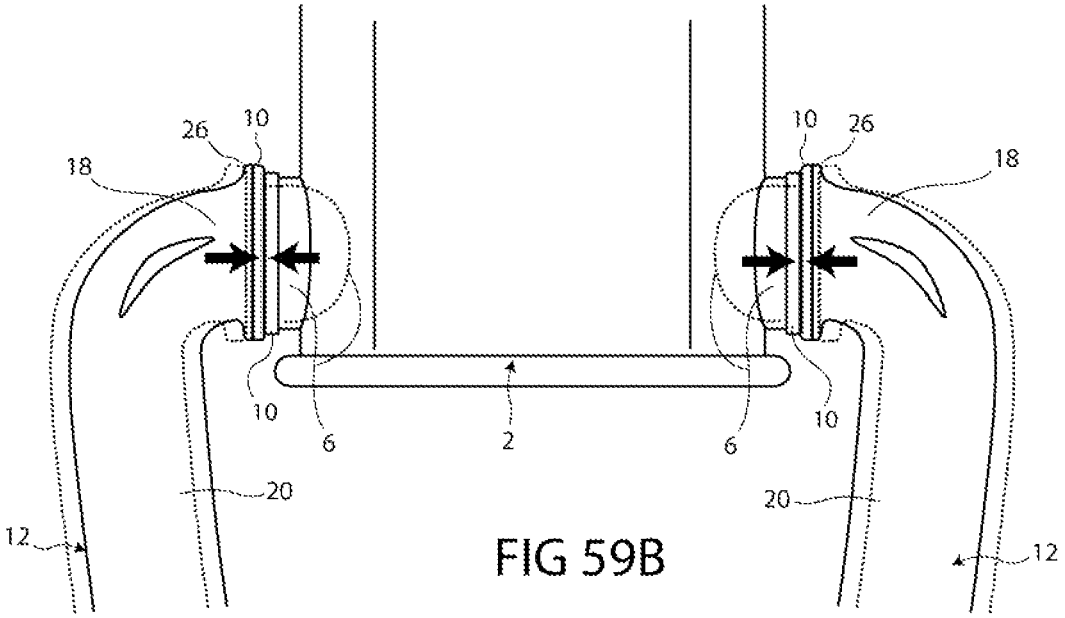
FIG. 59B (side view) shows an extension rod's bifurcated shaft/articulating member squeezably conjoined with a bottle's corresponding socket.

FIGS. 59A and 59B show two socket member (6) variations. Variation one has extruded, bilateral openings. Variation two has intruded, bilateral openings.

These openings are configured to pivotably conjoin with a bifurcated shafts (20) disconnected articulating members (18) (FIGS. 59A and 59B). Either socket (6) can have an elastomeric body (10) applied thereon.

Figure 13A:
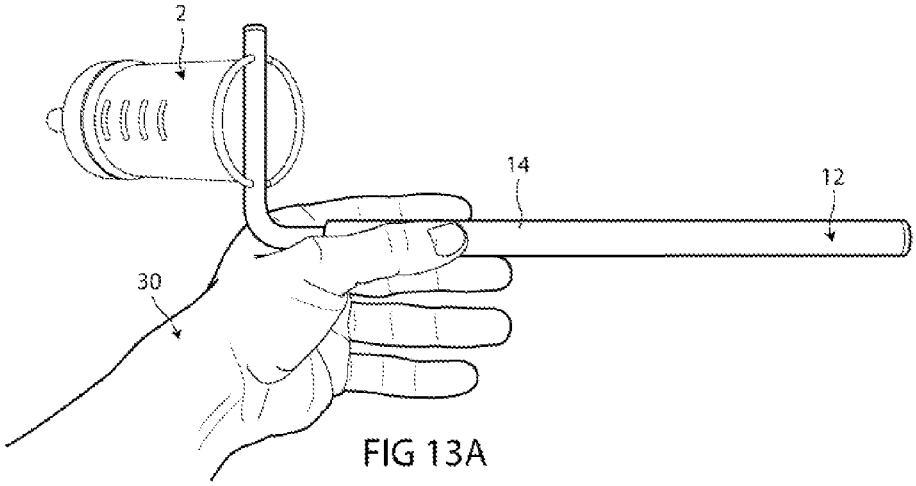
FIGS. 13A to 13C (progressive views) show an operator's utensil style grip while holding an extension rod's handle and several gripping points along thereof.
Figure 13B:
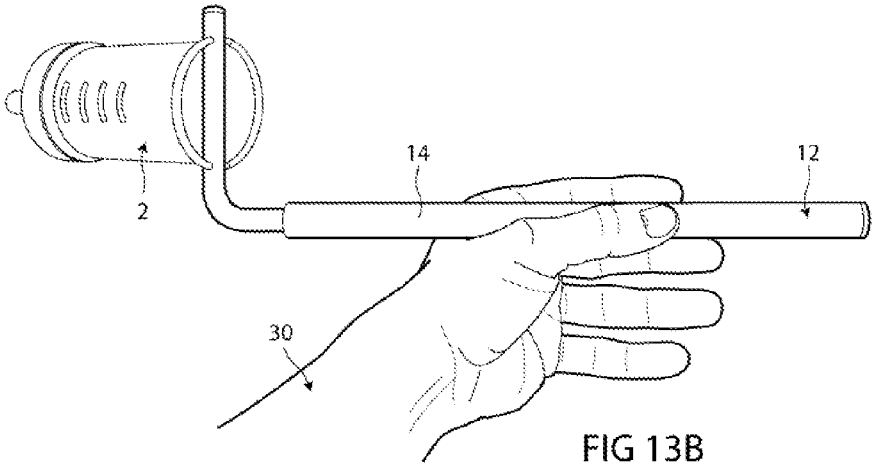
Figure 13C:
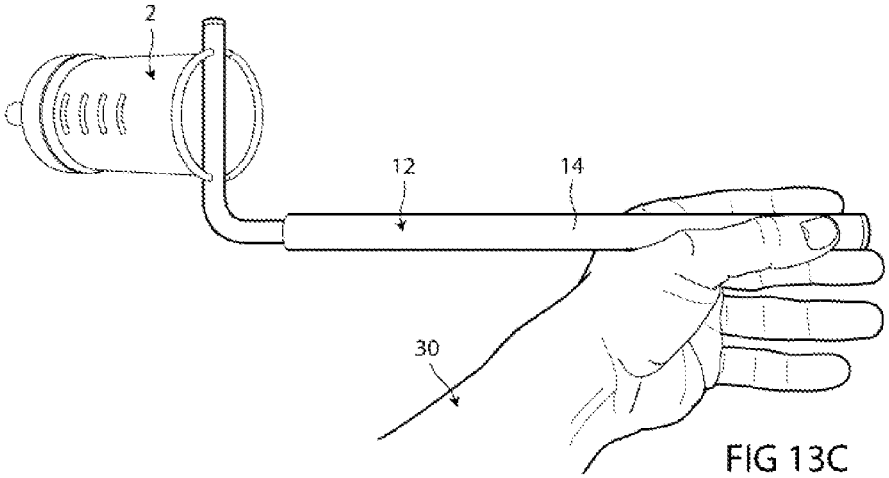
Figure 60A:
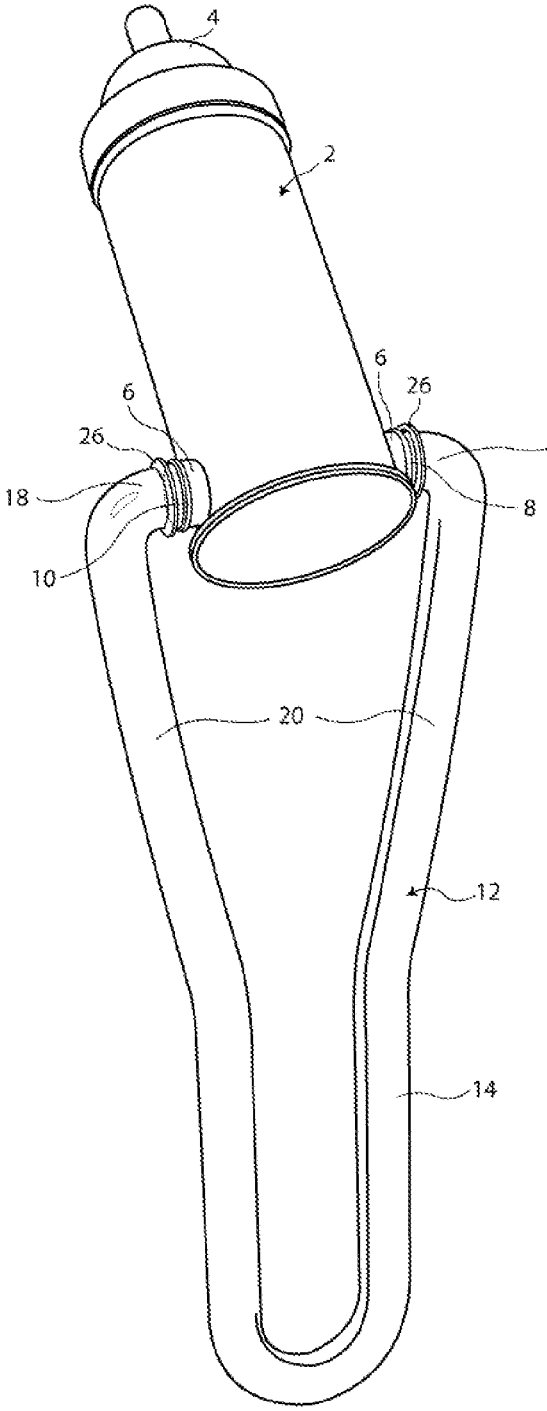
FIG. 60A (dimensional view) shows a tong shaped extension rod conjoined to a bottle in a passive, un-squeezed state.
Figure 60B:
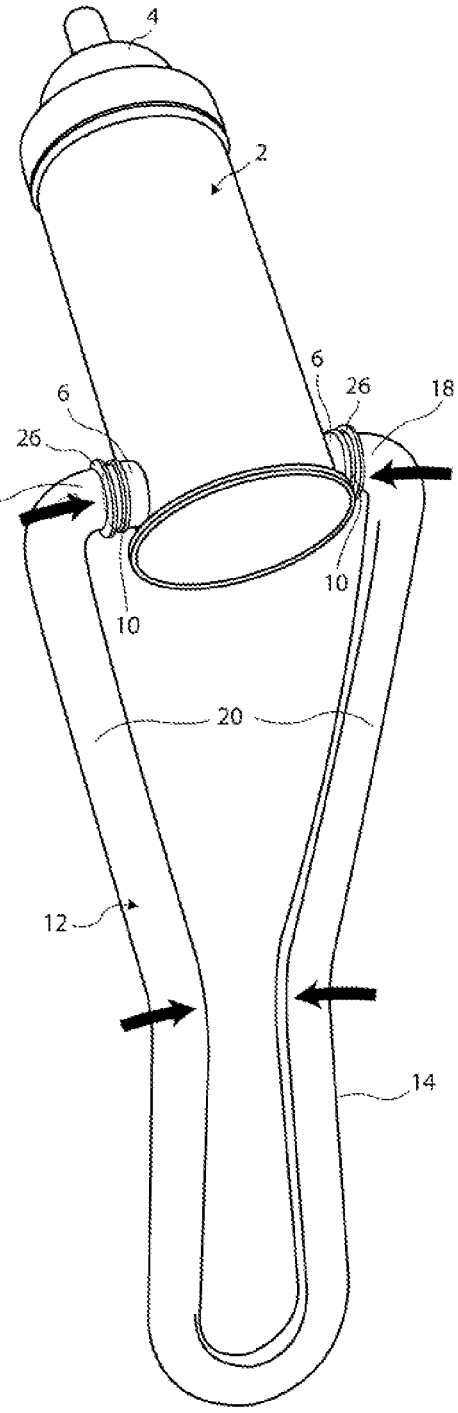
FIG. 60B (dimensional view) depicts a tong shaped extension rod squeezably generating pressure against a conjoined bottles socket member.

FIGS. 60A and 60B show a pressure sensitive, generally tong shaped extension rod (12) comprising a first shaft portion and a second shaft portion that are flexibly conjoined at their bottoms by a radial expanse (FIGS. 13A and 13B). The rod's (12) upper shaft (20) and articular (18) area is wide enough to conjoin with a corresponding bottle's (2) socket member (6) (FIGS. 59A and 59B). Furthermore, the (12) handle (14) is substantially parallel, wherein it provides a consistent gripping width. Accordingly, when the handle (14) is squeezed, the disconnected articulating members (18) are drawn medially together (FIGS. 59B and 60B).

Accordingly, when the extension rod (12) is conjoined with a bottle, squeezing the handle (14)) operably generates pressure and pivotal friction against the socket (6) (FIGS. 59B and 60B). Note, the disconnected articulating member portions (18) can have circumferential extrusions or discs (26) (FIGS. 14A and 14B). These discs (26) are diametrically larger than the surrounding articular (18) area. Furthermore, when the articulating members (18) are conjoined with a bottle (2) the discs are spaced desirably wider than its socket member's (6) exterior. Accordingly, when the extension rod's handle (12) is squeezed, the discs (26) draw against the socket's (6) exterior to form a bilateral squeezing communication. This resultant squeezing generates friction to modulate a bottle's (2) pivotal rotation (FIGS. 14A and 14B). Furthermore, the discs (26) of this embodiment can have adherent elastomeric O-rings or bodies (10) thereon to compressibly communicate with a socket (6) (FIG. 14B) when the extension rod (12) is squeezed.

Note, the disc's (26) of this embodiment are similar in scope to a vehicular disc brake (Pressure applied to the disc produces rotatable friction to slow or stop a wheel).

Figure 61A:
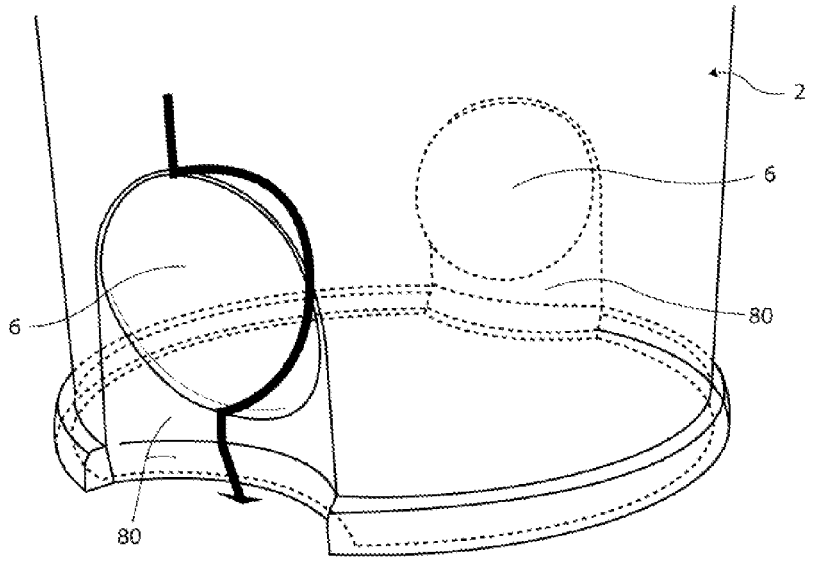
FIGS. 61A to 61D (dimensional detail view and progressive side views) show a bottle's bilateral, intruded socket member having lead in channels and several side views of a corresponding extension rod's insertion therein.
Figure 61B:
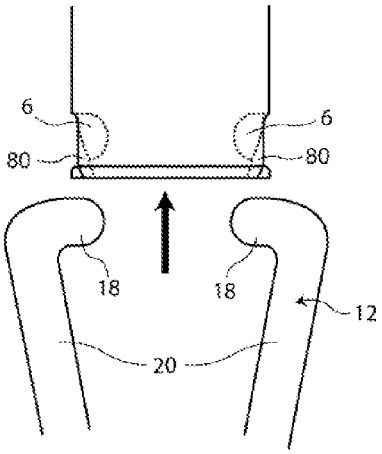
Figure 61C:
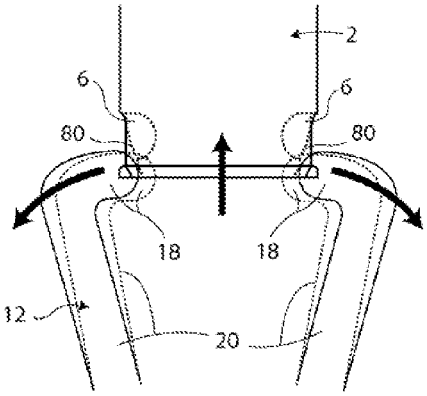
Figure 61D:
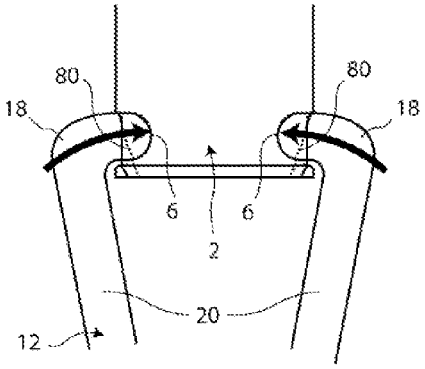

FIGS. 61A to 61D Show a bottle (2) having indented or concave channels that lead into bilaterally depressed or intruded sockets (6). These fluted paths or lead in channels (80) originate inferiorly at the bottles (2) bottom and end superiorly at the socket's (6) lower periphery (6) (FIG. 61A). When viewed from the side, the width in-between the channels (80) is narrower at the bottom and wider at the top (FIG. 61B). This graduated bilateral spacing facilitates the extension rods (12) insertion into the socket (6) inferiorly, while conversely helping to retain it within the socket (6) superiorly (FIG. 61C). Note the extension rod's bifurcated shaft (20) and disconnected articulating members (18) adaptively flex outwards (12) when inserted into the lead in channels (80) (FIGS. 61B to 61C).

Figure 62A:
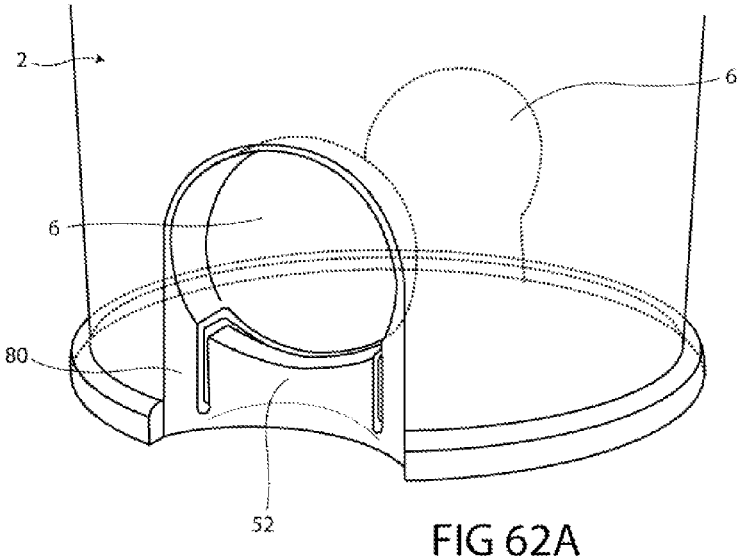
FIGS. 62A to 62D (dimensional detail view and progressive side views) shows a bilaterally formed, intruded socket member having inferiorly formed lead in channels, wherein the channels each have a pressure sensitive clipping member formed therein.
Figure 62B:
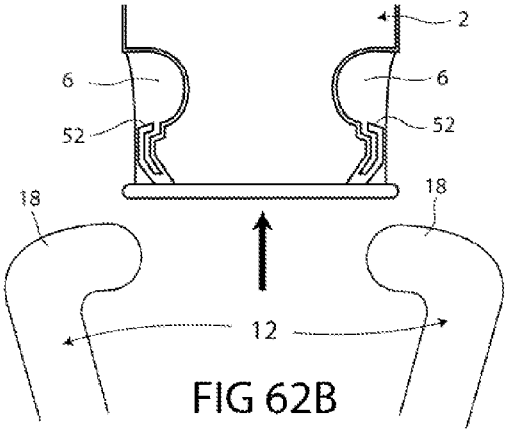
Figure 62C:
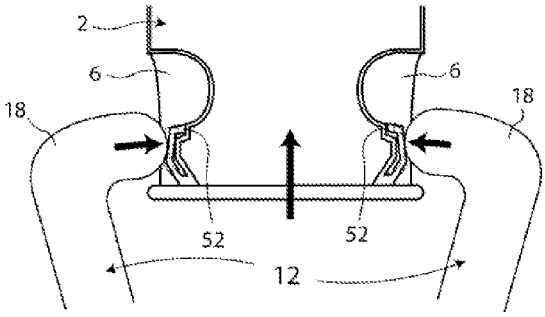
Figure 62D:
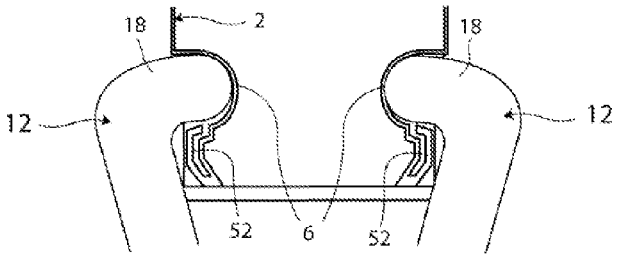

FIGS. 62A to 62D Show a bottle having bilateral concave channels that lead into diametrically opposed, intruded sockets (6). These fluted paths or lead in channels (80) originate inferiorly at the bottles (2) bottom and end superiorly at the socket's (6) lower periphery (6). Furthermore, each lead in channel (80) has a depressible lever, or clipping member (52) integrally formed therein, wherein its top and sides are disconnected and its bottom is flexibly connected to the bottle (2). More specifically, the clipping member (52) originates near the bottom of the lead in channel (80) and ends superiorly as a part of the sockets (6) lower periphery. It's top and sides are disjoined from the bottle (2) by a gap or groove like channel while its bottom is flexibly conjoined to the bottle (2) (FIG. 62A). This flexible connection serves as a pivot juncture whereby allowing the clipping members (52) to inwardly depress. Thus, when the clipping members (80) are bilaterally depressed, the width in-between them (80) adjustably narrows to facilitate a rod's (12) entry into the socket (6). Once inside the socket (6), the clipping members (80) reflexively return to their non-depressed state to facilitate retention within the socket (6) (FIG. 62C). In summary, the bilateral clipping members (80) depressively adjust inwards to reduce the width in-between them whereby allowing an extension rod's (12) articulating member (18) to retentively enter a corresponding socket member (6) (FIG. 62C).

Figure 63A:
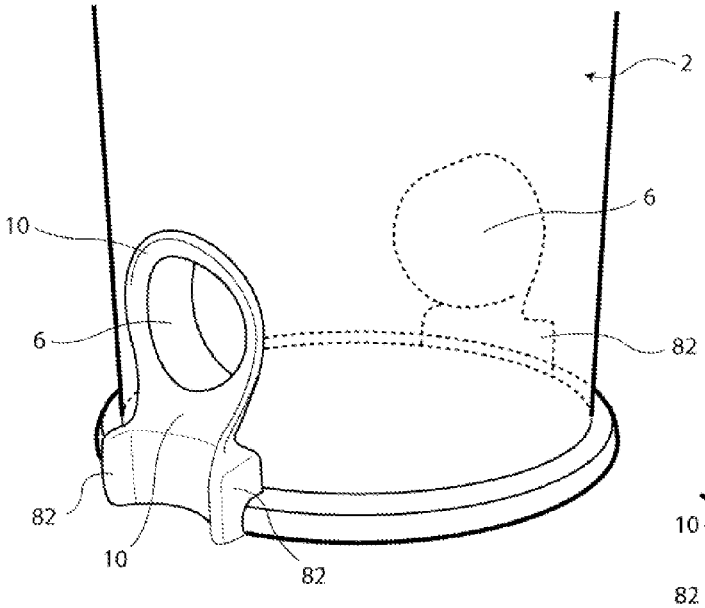
FIGS. 63A to 63D (dimensional detail view, top plan view, and progressive dimensional views) show a bottles socket member area having a locking member thereon.
Figure 63B:
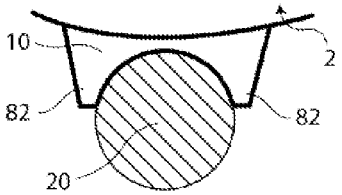
Figure 63C:
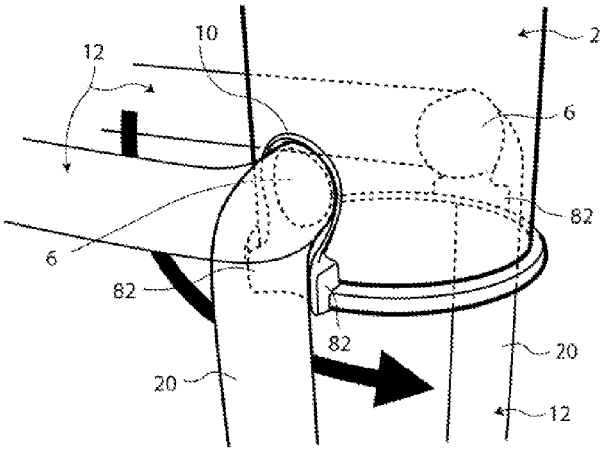
Figure 63D:
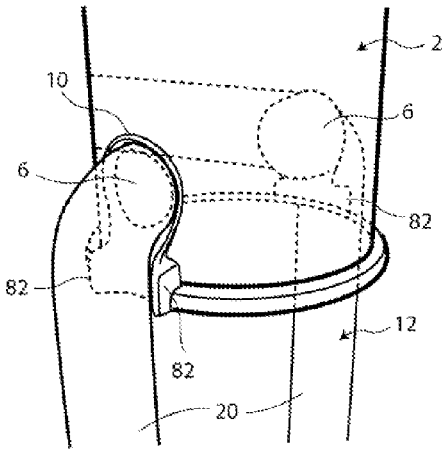

FIGS. 63A to 63D show a bottle (2) having a retaining means or locking member (82) formed into its socket member (6). Specifically, the locking member (82) comprises a depressed holding channel that is sandwiched in-between bilateral extrusions. When an extension rod's (12) shaft (20) area is rotated in-between, it is retentively sandwiched within the holding channel. Note, in this embodiment, the lock's (82) fluted surface and bilateral extrusions originate from the elastomeric bodies (8) lower area (below the socket holes) (FIG. 63A). Accordingly, rotating the (2) shaft (20) area in-between the (82) extrusions will pivotally lock the bottle (2) so that it cannot rotate (FIGS. 63C and 63D). Note, for additional or alternative embodiments, a locking member (82) may comprise one or more holding channels sandwiched in-between holding extrusions, wherein a bottle (2) can be locked in a number of positions. Furthermore, a lock (82) may comprise plastic or elastomer. It may be injection molded or adhesively glued or bonded onto the bottle (2).

Figure 64A:
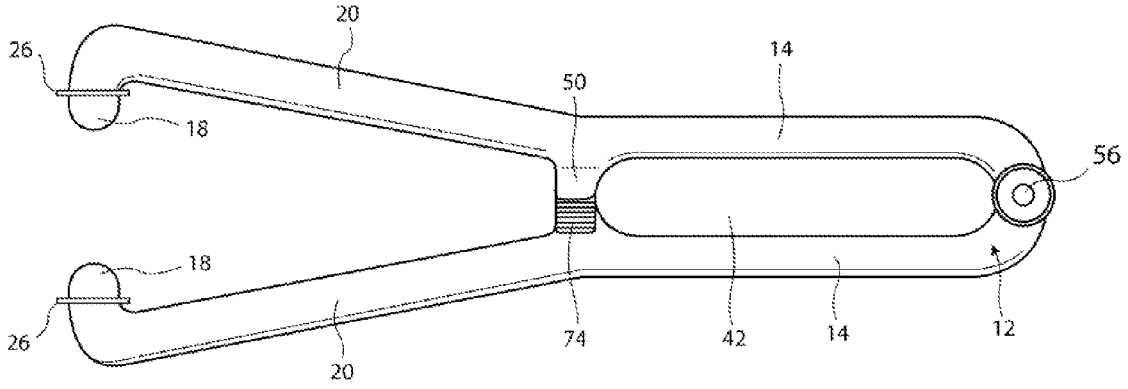
FIGS. 64A and 64B (plan view and dimensional hinge detail view) show a tong-like extension rod that it pivotably conjoined at its bottom by a hinge, wherein the rod has an abridging ratchet to modulate width in-between it's bifurcated shafts.
Figure 64B:
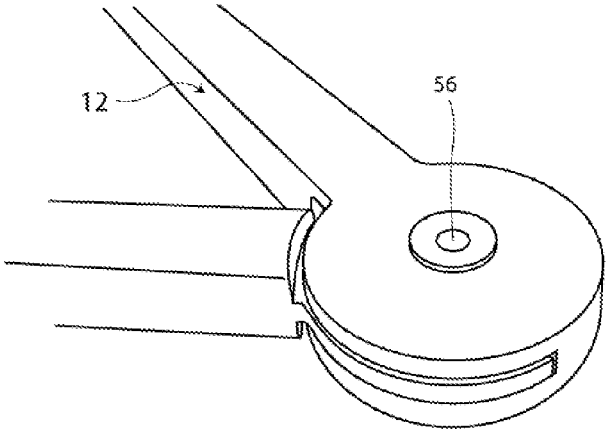

FIGS. 64A and 64B show an extension rod (12) having corresponding rod halves that are pivotably conjoined at the bottom by a hinge (56), wherein the rod (12) can squeezably create pressure between its disconnected articulating members (18) when attached to a socket member (6). This embodiment also has a disconnected abridgement or stabilizer (24) that medially spans the rod halves. The stabilizer (50) has corresponding ratchet (74) parts formed into its disconnected ends so that it can adjustably modulate the width in-between the rod halves.

Figure 65A:
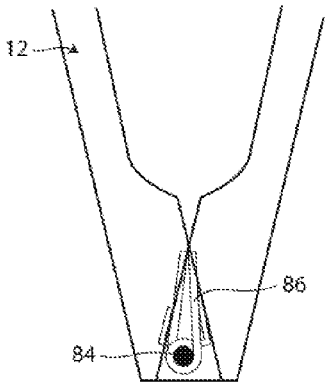
FIGS. 65A and 65B (progressive side views, bottom detail) show an extension rod that is pivotably conjoined at its bottom by a spring hinge.
Figure 65B:
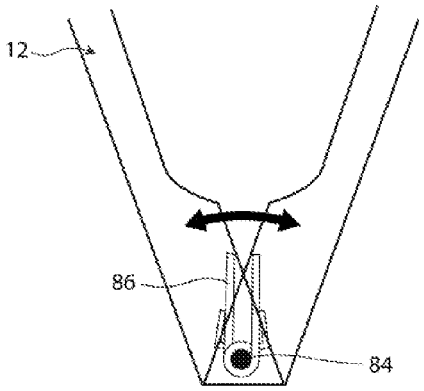

FIGS. 65A and 65B show an extension rod (12) that is pivotably conjoined at its bottom by a spring hinge (84). The spring hinge (84) generates desirable resistance when the rod halves are pulled apart (the reverse of a spring action kitchen tong). When released, the accumulated spring tension pulls the rod (12) halves and articular (18) portions medially. Accordingly, when conjoined to a bottle (2), the rods (12) spring tension will generate sufficient retaining pressure and pivotal friction against a corresponding socket member (6) area.

Alternatively, the spring tension can be reversed, wherein it is identical to a commonly available kitchen tong. A common kitchen tong generates resistance when its halves are squeezed together (a kitchen tong's default position is spread apart and open).

Furthermore, they commonly incorporate lock mechanisms on their bottoms, wherein they can lockably close for storage. Thus, an additional rod (12) embodiment can utilize the spring resistance and locking mechanisms of a common tong. Accordingly, a rod (12) of this embodiment can be squeezed to communicate with a corresponding socket member (6) and subsequently locked to conjoin the rod (12) thereon.

Figure 66A:
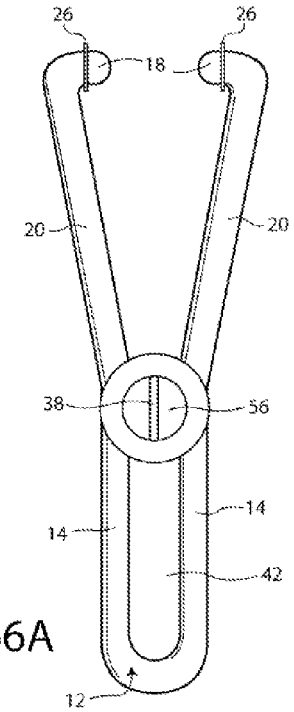
FIGS. 66A and 66B (plan views) show an extension rod having a bifurcated shaft that is pivotably conjoined to its handle by a hinge, wherein the bifurcated shaft can laterally open and close.
Figure 66B:
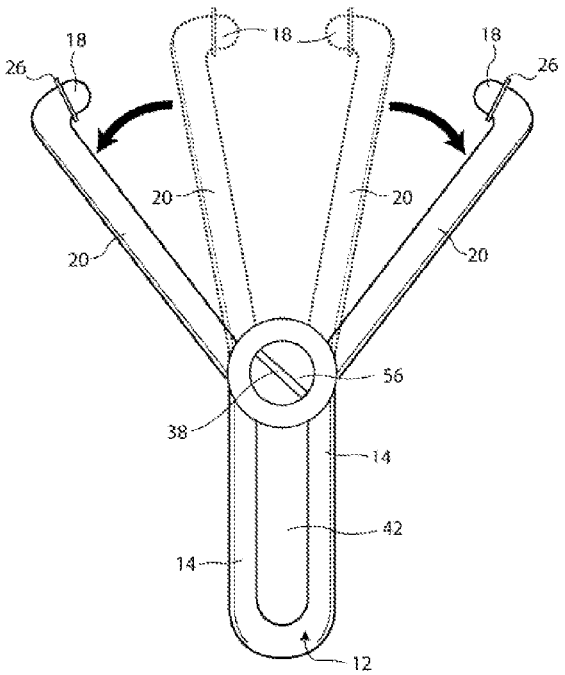

FIGS. 66A and 66B show an extension rod (12) having a bifurcated shaft (20) that is pivotably conjoined at its bottom by a hinge (56), wherein the bifurcated shaft (20) halves can pivotably open and close. Thus, when the shaft (20) halves are pivotably opened, their disconnected articulating member (18) ends are substantially wider than a corresponding bottles (2) socket member (6). Conversely, when the opened shaft (18) members are pivotably closed, their articulating member (16) ends can attachably conjoin with a corresponding socket member (6). Note, a locking member or tightening member can be attached to the hinge (56) area to operably facilitate retention within a socket member (6).

Figure 67A:
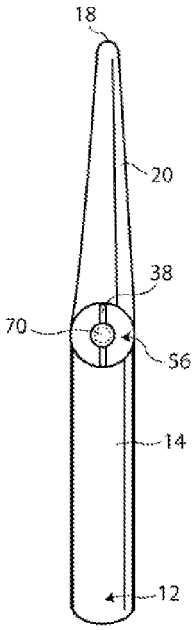
FIGS. 67A and 67B (progressive side views) show an extension rod having a shaft that is pivotably conjoined to the handle by a hinge, wherein it can pivot forwards or backwards and the hinge join has a tightening member thereon.
Figure 67B:
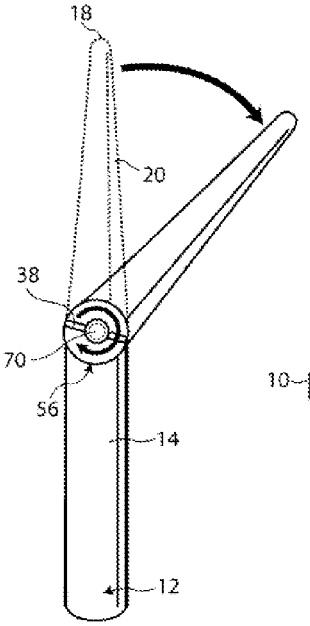

FIGS. 67A and 67B show an extension rod (12) having a shaft (20) pivotably conjoined to a handle (14) by a hinge (56), wherein the shaft (20) can pivotably change its operating angle (relative to its handle) in a forwards and backwards direction. Furthermore, a tightening member (38) is attached to the hinge (56), wherein it can lock the shaft (20) in a number of positions. Thus, an operator may first loosen the tightening dial to adjust the shafts angle forwards or backwards and then second retighten it to lock the shaft (18) in a desirable operating angle.

Figure 67C:
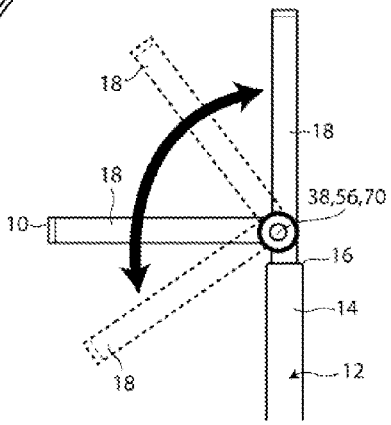
FIG. 67C show an extension rod having an articulating member that is pivotably conjoined to its handle by a hinge.

FIG. 67C shows an "L" shaped extension rod (12) having an articulating member (18) pivotably conjoined to its handle (14) by a hinge (56). The hinge has a tightening means or tightening member (38) thereon so that an operator can adjustably lock the articulating member (18) at a desired operating angle (relative to the handle).

Figure 68:
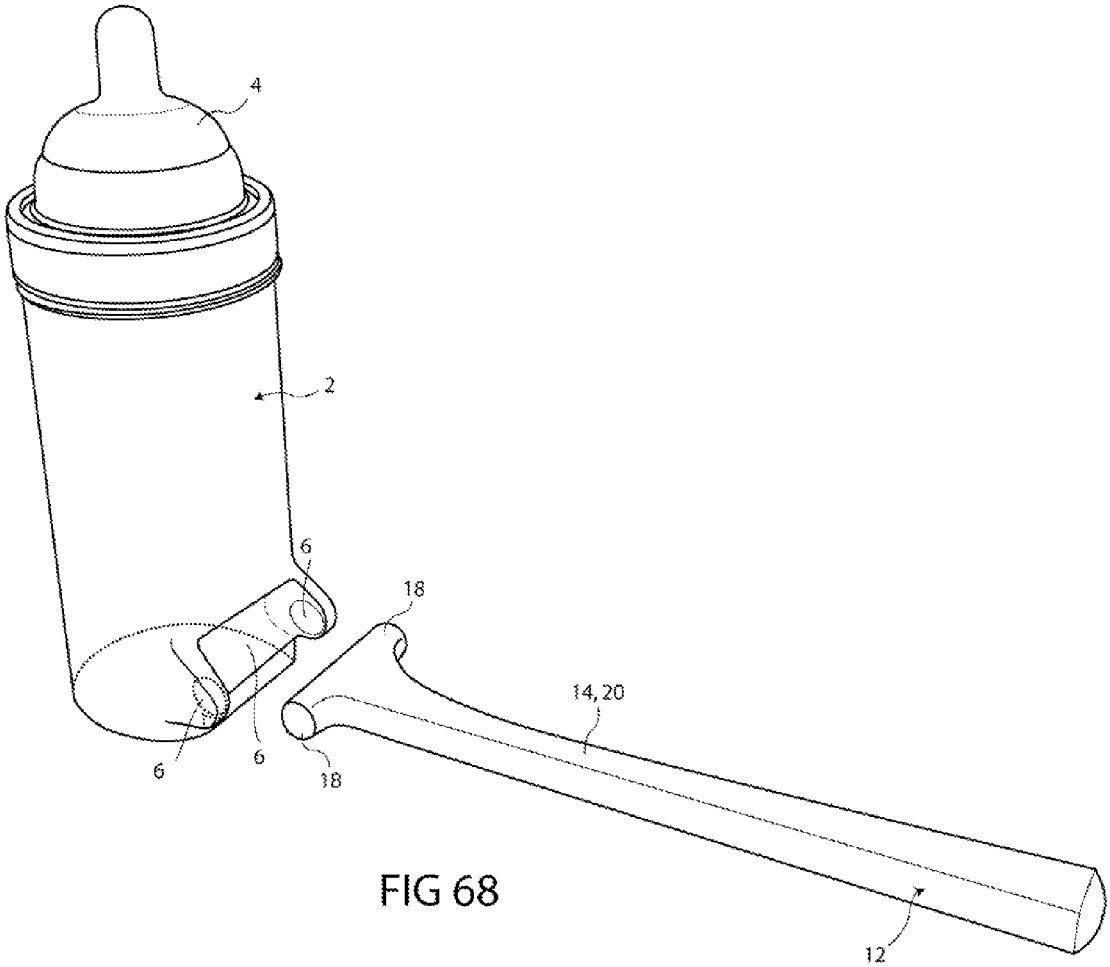
FIG. 68 (dimensional dis-conjoined view) shows a "T" shaped bifurcated shaft and a corresponding bottle having a socket member formed into one side.

FIG. 68 shows a bottle (2) having an extruded socket member (6) externally formed onto its side to conjoin with a corresponding "T" shaped extension rod (10) having a bifurcated shaft that is perpendicular to the handle (14).

Operation—FIGS. 3A-7

Figure 16A:
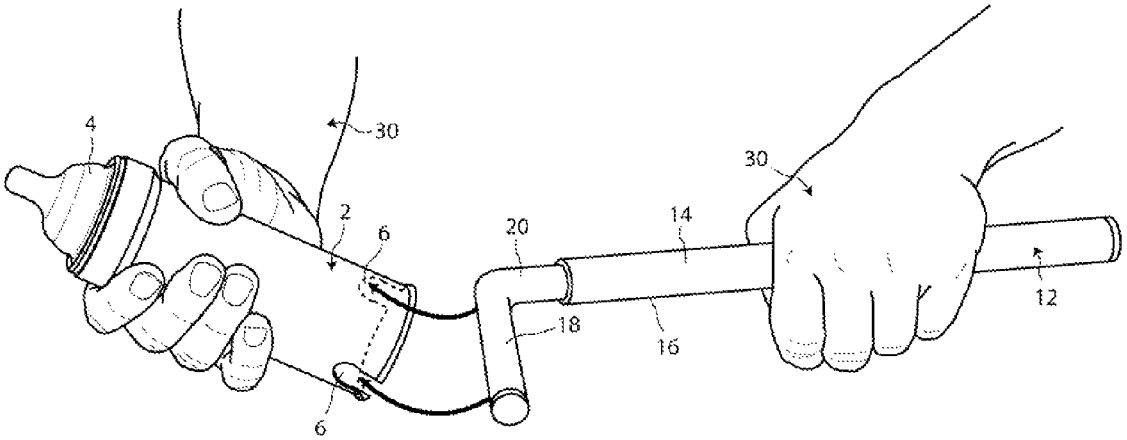
FIGS. 16A and 16B (progressive views) show an operator conjoining an extension rods articulating member with a bottles socket member.
Figure 16B:
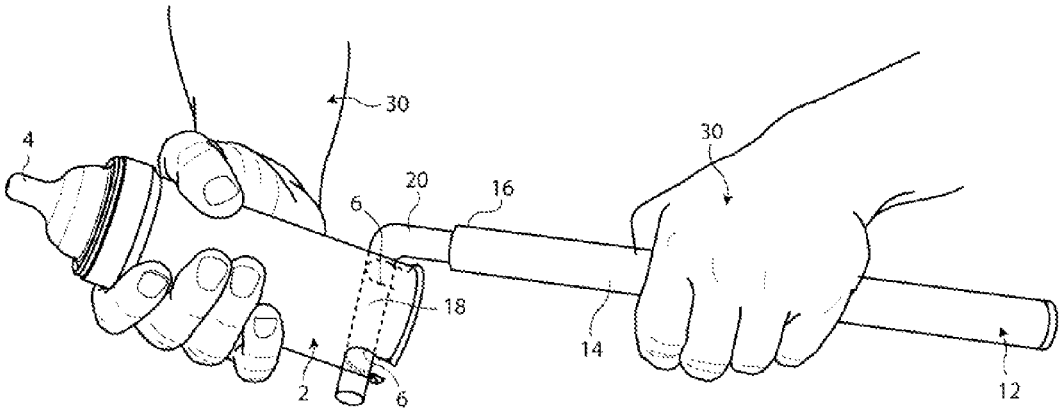
Figure 18:
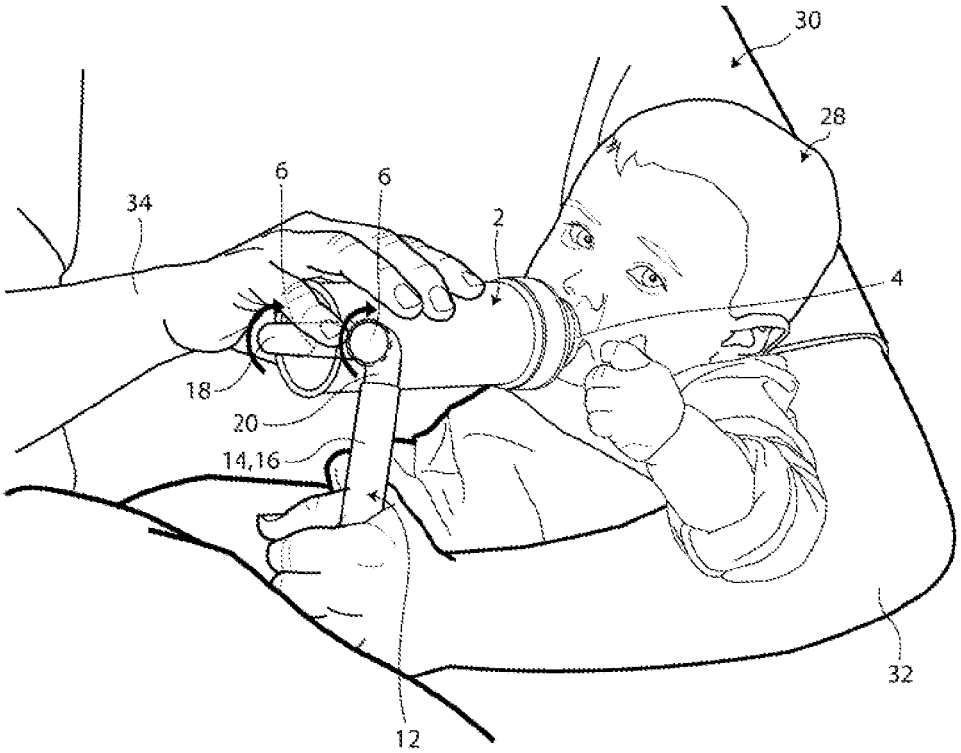
Figure 22:
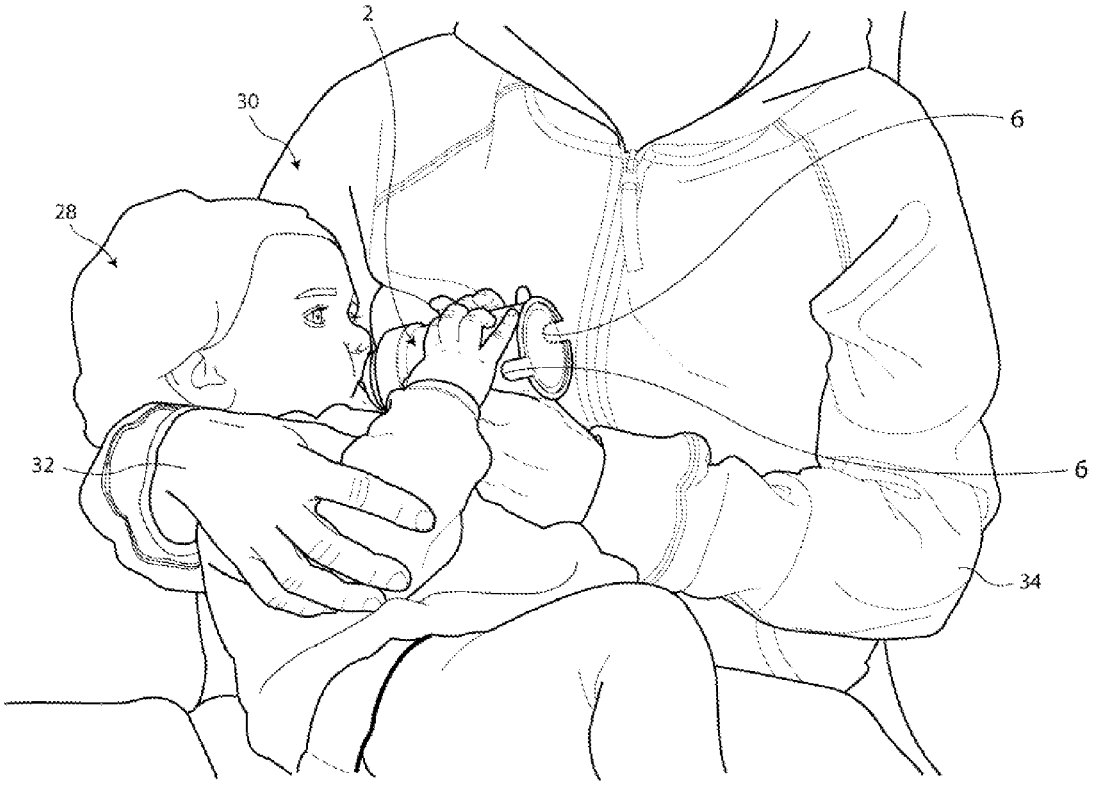
FIG. 22 (operative view) shows an operator traditionally feeding an infant after removing the bottle from the extension rod.

Note a standard feeding (34) arm is any arm that is traditionally used to hold/prop a bottle (2) while feeding an infant (FIG. 22). A cradling arm (32) is any arm that is traditionally used to hold an infant (28) while feeding infant (FIG. 22). Prior to operation, an operator (30) must first prepare a feeding liquid and place it within a bottle (2) (not shown). Next, they should secure the nipple over the bottle's (2) open top (not shown). Next, in operative preparation, the user (30) should grasp the bottle (2) in one hand and grasp the extension rod (12) in the other so that the articulating member (18) and socket member (6) align (FIGS. 1A, 3A and 16A). Using adequate force, the operator (30) should next insert the rod's (12) articulating member (18) into the bottles (2) socket member (6) (FIGS. 1B, 3B and 16B). Note, conjoining the articulating member (18) with the socket member (6), will form a hinge between the two, whereby allowing the bottle (2) to operably pivot around the articulating member (16) (FIG. 4 and FIG. 18). After conjoining the two, the operator (30) should next choose a feeding position. Namely, if an operator (30) wants a free arm to multitask, relax, or have increased intimacy with the infant (30), they should use the extension rod (12) to feed the infant (26) with their cradling arm (32).

Figure 17:
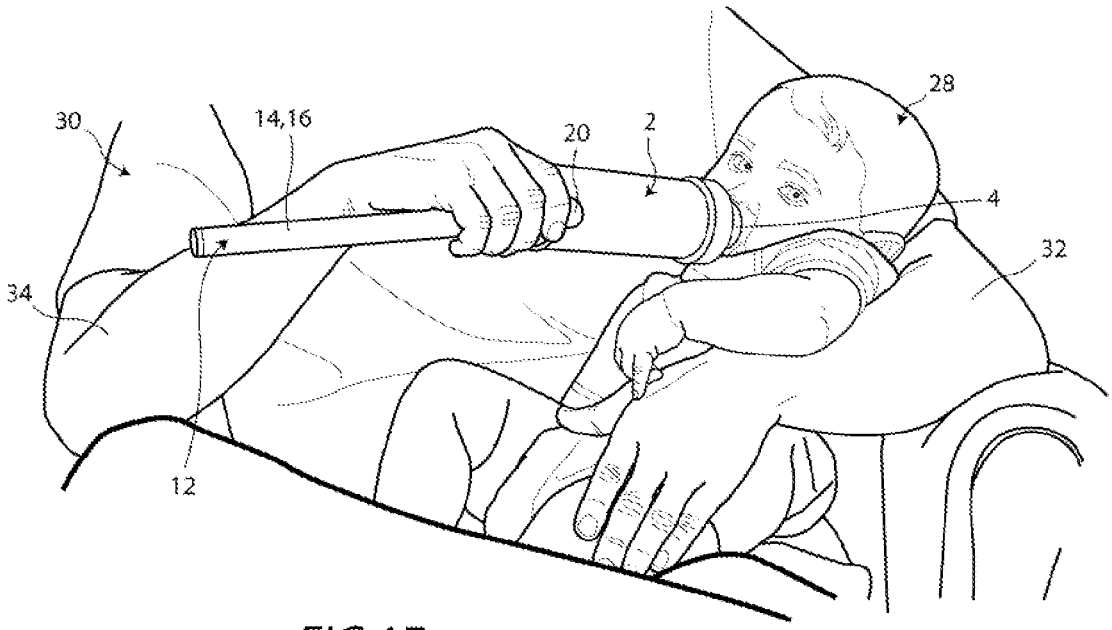
FIG. 17 (operative view) shows an operator and infant prior to feeding, wherein the operator is positioning the extension rod and bottle for feeding, FIG. 18 (operative view) shows an operator and infant in a feeding position, wherein the operator's cradle arm is holding the infant, the extension rod and the conjoined bottle while the standard feeding arm is positionally pivoting the bottle for feeding.
Figure 19A:
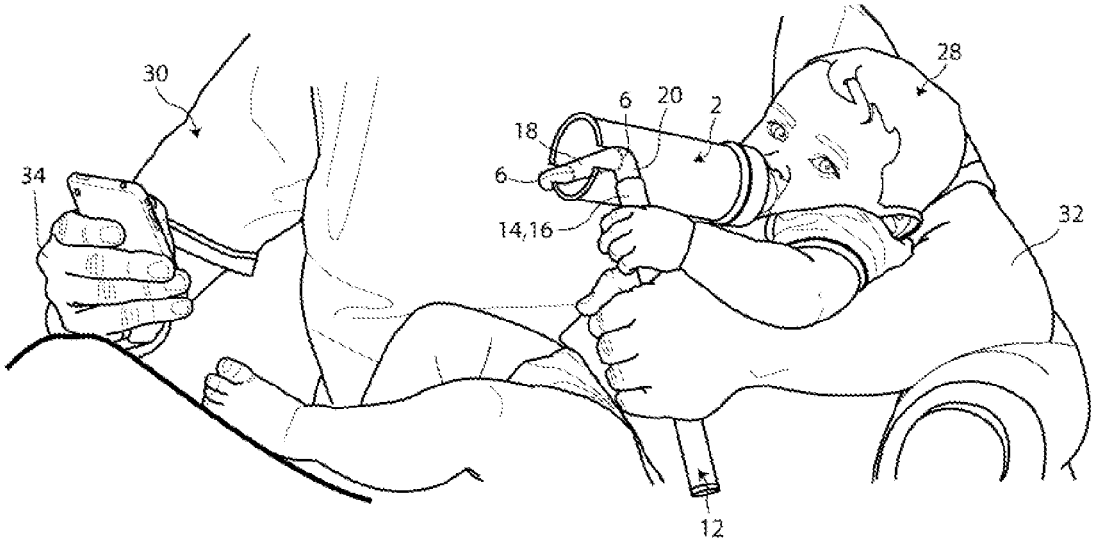
FIG. 19A (operative view) shows an operator feeding an infant using a handle gripping style while simultaneously multitasking with their standard feeding arm.
Figure 19B:
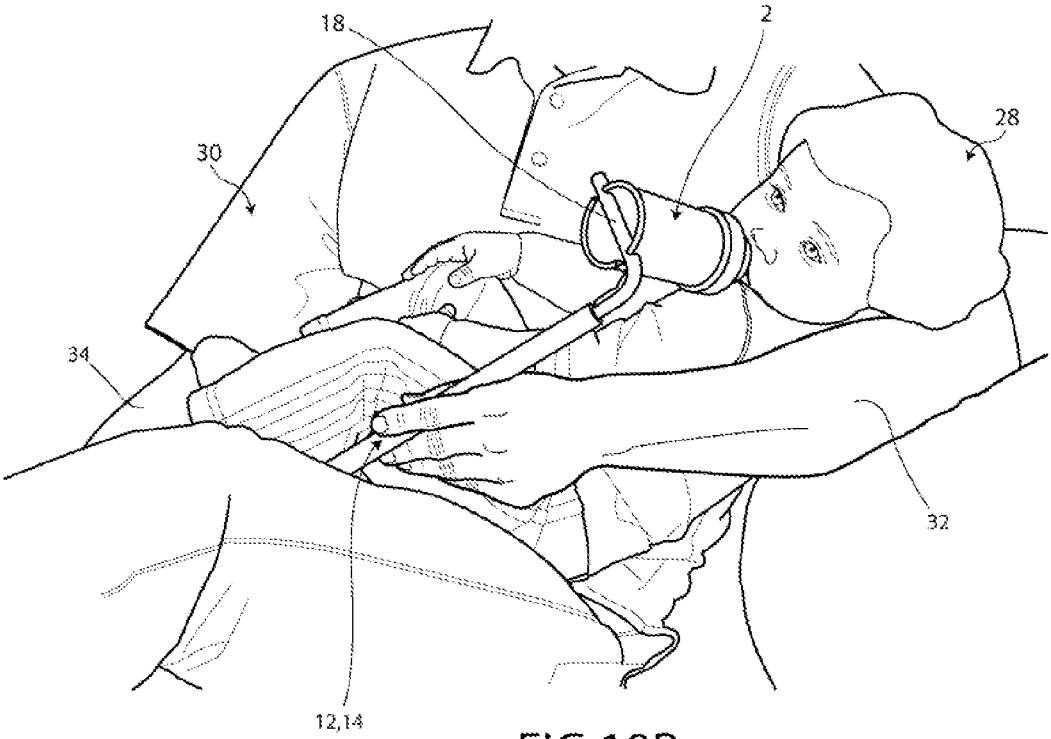
FIG. 19B (operative view) shows an operator feeding an infant using a utensil gripping style while simultaneously relaxing their standard feeding arm.
Figure 20:
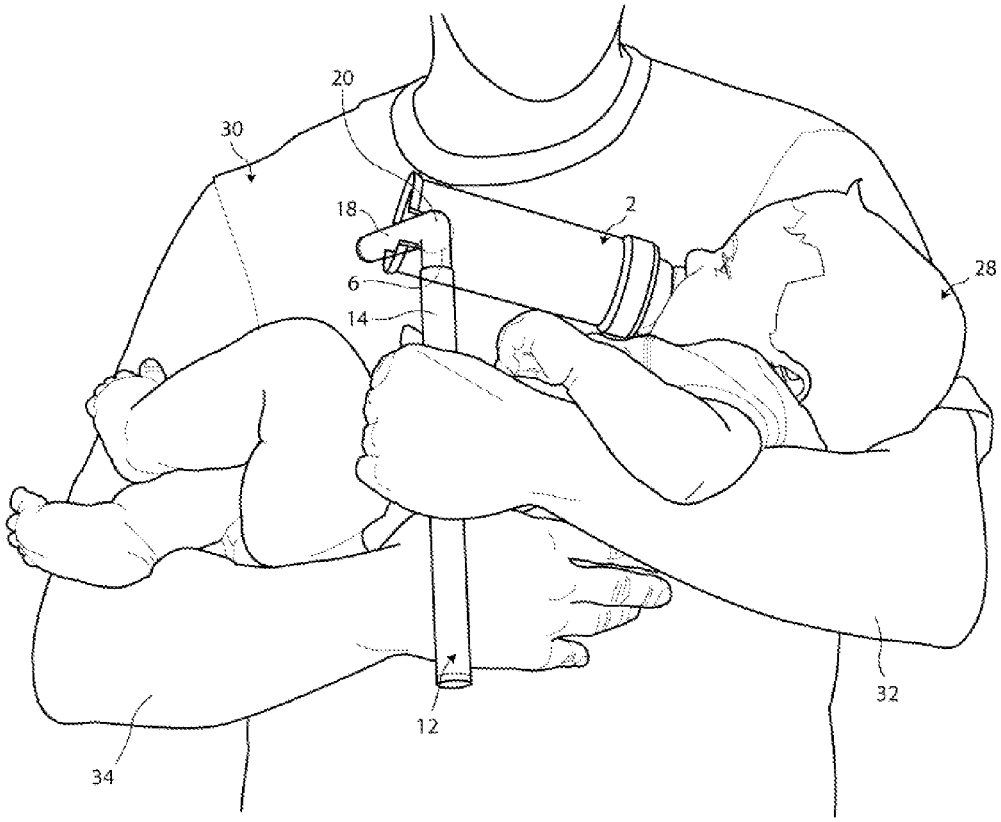
FIG. 20 (operative detail view) shows an operator using a standard feeding arm to cradle an infant.
Figure 21:
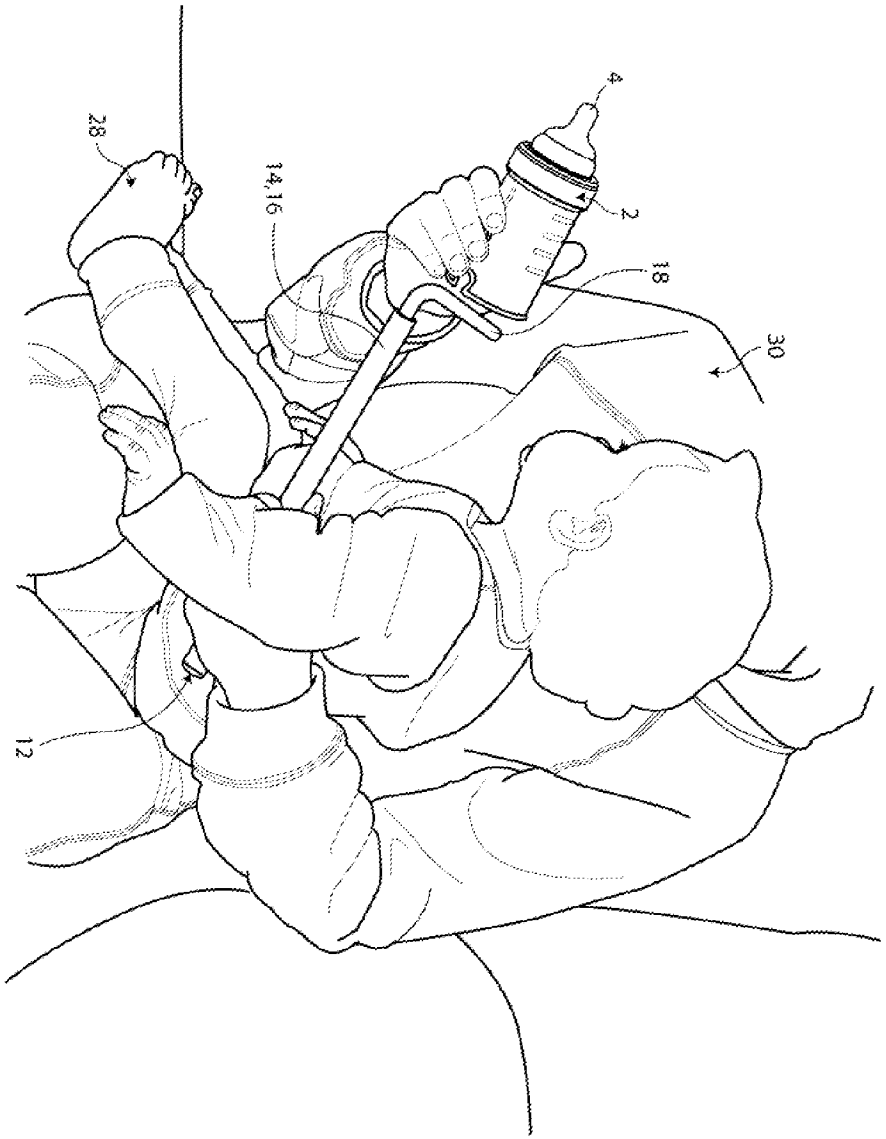
FIG. 21 (operative view) shows an operator removing the bottle from the extension rod so that they can transition to a traditional feeding position.

Accordingly, the operator (30) should first grasp the extension rod (12) and conjoined bottle (2) and settle into a comfortable feeding position (or vice versa) (FIG. 17). Next, they should grasp the extension rods (12) handle (14) with their cradling arm's (32) hand and then use their standard feeding arm (34) to pivotably position the bottle (2) for feeding (FIG. 18). Note, attaining a comfortable feeding position may require gripping style/gripping position adjustments. Therefore, depending preferences, an operator (30) can employ a handle gripping style (along various points of the handle) while feeding an infant (28) (FIGS. 12A, 12C and 19A) or alternatively, use a utensil gripping style (along various points of the handle) while feeding an infant (28) (FIGS. 13A, 13B and 19B). After the operator (30) is comfortably feeding, they can use their unencumbered standard feeding arm (34) to multitask (FIG. 19A), relax (FIG. 19B) or cuddle (FIG. 20) with the infant. Note, at some point it may become necessary to adjust or change feeding positions. To adjust a position, the operator (30) can grasp the extension rods (12) shaft (20) and conjoined bottle (2) with their standard feeding arm (34) and then reposition as necessary (FIG. 17). Moreover, it may be necessary or desirable to assume a traditional feeding position. In this instance, the operator (30) should decouple the bottle (2) from the extension rod's (12) articulating member (18) (FIG. 21). After decoupling, they can reposition so that their standard feeding (34) arm is holding/propping the bottle and their cradling arm (32) is holding the infant (28) (FIG. 22).

CONCLUSION, RAMIFICATION, AND SCOPE

Accordingly, the reader will see that the variably ergonomic bottle extension system of this invention creates a new feeding paradigm heretofore not possible or practicable.

Specifically, it surmounts traditional bottle feeding's inherent constraints. Namely, it transcends double armed bottle feeding. Double armed bottle feeding requires one arm for holding a bottle and one arm for cradling the infant. In stark contrast, this invention allows a caretaker to hold and feed an infant with one arm only: their cradling arm. Holding and feeding an infant with one arm frees a caretakers remaining arm for other purposes. For example a caretaker can read book, drink a beverage, relax, or cuddle the infant with their free arm. The reader will further see that the inherent power of this invention lies in the extension rods ability to pivotably extend the feeding range of a bottle. By substantially increasing a bottles feeding range, a caretaker can surmount their cradling arms compromised reach and range of motion and use it for feeding. Accordingly the reader will discover that the variably ergonomic bottle extension system bestows a caretaker with newfound opportunities to counter the frequent, time consuming, and highly repetitive task of traditional bottle feeding. Namely, it frees a caretaker from the ergonomically static routine of double armed feeding. It allows a caretaker greater freedom to relax, multitask or most critically have greater cuddling intimacy with an infant. Ultimately, this invention grants a caretaker the freedom of choice. A caretaker can utilize the extension rod for enhanced feeding freedom if they so choose. Conversely, they can remove it and feed traditionally if necessary. It's simple, switching between the two methods takes seconds. Furthermore, the variably ergonomic bottle feeding system has the additional advantages in that:

- The extension rod is simple to attach and detach thereby negating the need for preoperative assembly.
- The addition of a socket immaterially alters an existing bottle's functional design.
- Socket bearing bottles can be used seamlessly with or without an extension rod.
- There is no need for clamps or adapters or additional hardware.
- It can easily fit in a purse or bag for transport.
- It has a simple learning curve.
- They system is easily cleaned and can be dishwasher safe.

Although the description above contains much specificity, this should not be construed as limiting the scope of the invention but as merely providing illustrations of some of the presently preferred embodiments of this invention. For example, an extension rod can have any length necessary. It may be made from any material or any combination of materials. It can be rigid or bendable. It can be extendable, stretchable or expandable. It may be angled, twisted, or bent in any direction and to any degree. It may have any number of hinges, tightening members or other adjusting means thereon. It can have apertures formed therein or extrusions formed thereon to dock with various attachments or other appendages. It can have elastomeric bodies and or grips incorporated anywhere deemed necessary. Lastly it can assume any shape necessary for optimal function. An extension rod's articulating member can be straight or curved. It can be cylindrical or non-cylindrical. It may have any number of interlocking mechanisms to stably conjoin with a bottle. It can be embossed or grooved to pivotably communicate with a bottles corresponding socket member. Moreover, an extension rod's shaft area can be rigid, bendable, hinged or comprise a number of flexibly conjoined members. It can have a flexible wire core therein. Bendable shafts can be made from metal, plastic, flexible tubing, wire, elastics or other materials (or any combination thereof).

A bottle can have any number of articular holders thereon. Furthermore, they can have any size or shape. For example, a bottle can have a plurality of sockets so that extension rod can conjoin at different points along thereof. Sockets may be introverted, extroverted or tubular. Articular holders can comprise cylindrical axles or extrusions. Holders may or may not be diametrically opposed. They can have asymmetric openings. Sockets may have geometric shapes or peripheries. They may be partially or fully circumferential.

Sockets may be partially tubular or fully tubular. They may contain any number of notches, channels, gaps or grooves formed therein to flexibly accommodate an extension rod's articulating head. Furthermore, the may be placed anywhere on the bottle. Lastly, sockets may have rotating members formed within their socket holes. These bearing-like sockets allow the rotating member freely rotate within the socket holes when turned. Attaching articular members can have any size or shape. They can be introverted or extroverted. They may comprise rings, cups, or plugs. The can screw onto a bottle or screw into a bottle. They can utilize attaching magnets, adhesives or suctions. They may have sockets openings or conversely have articulating member extrusions to conjoin with a corresponding extension rod. Attaching member embodiments using wrapping sleeves may have any shape to fit a specific bottle profile. They can have connected ends or disconnected ends. Sleeve ends can overlap or not overlap. Sleeves can incorporate connective elastic bands to constrictively sheath or wrap around a bottle. They can use adhesives, clamps, screws, straps, magnets or clasps attaching or tightening means to secure around a bottle. Thus, the scope of the invention should be determined by the appended claims and their legal equivalents, rather than by the examples given.

I claim:

1. A variably ergonomic bottle extension system comprising:

a baby bottle having a top end and a base area, a first articular surface at a peripheral rim of the base area and the first articular surface having two bilateral openings, each bilateral opening with a superior constrictive portion;

an extension rod having a second articular surface, wherein the first articular surface is sized and shaped to pivotably conjoin with the second articular surface to create a joint so that the baby bottle can pivot along one or more axes; and wherein the baby bottle is configured to rotate 360 degrees relative to the extension rod around the joint when the first articular surface and the second articular surface are conjoined and whereby conjoining the first and second articular surfaces pivotably extends a bottles feeding range, and furthermore pivotably accommodates a number of feeding positions.

2. The variably ergonomic bottle extension system of claim 1 wherein said baby bottle is made from a BPA free plastic.

3. The variably ergonomic bottle extension system of claim 1 wherein said baby bottle is made from glass.

4. The variably ergonomic bottle extension system of claim 1 wherein said baby bottle is made from metal.

5. The variably ergonomic bottle extension system of claim 1 wherein said first articular surface is a constrictive member formed onto or into said bottle.

6. The variably ergonomic bottle extension system of claim 1 wherein said extension rod comprises an elongated gripping handle having a generally cylindrical, axle-like articulating member on one end.

7. The variably ergonomic bottle extension system of claim 1 wherein said extension rod comprises an elongated gripping handle offset to one side of a generally cylindrical axle-like articulating member, wherein the generally cylindrical member and handle form a ninety degree angle.

8. The variably ergonomic bottle extension system of claim 1 wherein said extension rod comprises a hollow gripping body that houses a retractable shaft having a desirably angled articulating member on its end, wherein the gripping body and retracting shaft are adjustably conjoined by a tightening member or collar.

9. The variably ergonomic bottle extension system of claim 1 wherein said extension rod has a an extending member nested therein to operably increase said extension, wherein said extending member comprises a telescoping shaft having a generally cylindrical, axle-like articulating member bent at about ninety degrees at its end.

10. The variably ergonomic bottle extension system of claim 1 wherein said second articular surface is an axle rod.

11. The variably ergonomic bottle extension system of claim 1 wherein said second articular surface has a smooth elastomeric body adherent thereon.

12. The variably ergonomic bottle extension system of claim 1 wherein said second articular surface has an embossed or fluted elastomeric body adherent thereon.

* * * * *